US006165707A

United States Patent [19]

Hirano et al.

[11] Patent Number: 6,165,707

[45] Date of Patent: Dec. 26, 2000

[54] PHOTOTHERMOGRAPHIC OR THERMOGRAPHIC IMAGE-FORMING MATERIAL

[75] Inventors: Shigeo Hirano; Satoru Toda; Masahiko Taniguchi; Hiroyuki Suzuki, all of Minami Ashigara, Japan

[73] Assignee: Fuji Photo Film Co., Ltd., Kanagawa, Japan

[21] Appl. No.: 09/333,271

[22] Filed: Jun. 15, 1999

[30] Foreign Application Priority Data

Jun. 17, 1998 [JP] Japan ..... 10-186929
Jun. 17, 1998 [JP] Japan ..... 10-186936

[51] Int. Cl.[7] ..... G03C 1/498; G03C 1/34

[52] U.S. Cl. ..... 430/619; 430/531; 430/600; 430/607

[58] Field of Search ..... 430/619, 600, 430/607, 531

[56] References Cited

U.S. PATENT DOCUMENTS 4,152,160 5/1979 Ikienoue et al. .
4,847,187 7/1989 Ono et al. ..... 430/528

OTHER PUBLICATIONS

Patent Abstracts of Japan, Publication No. 09160165, Jun. 20, 1997.

*Primary Examiner*—Thorl Chea
*Attorney, Agent, or Firm*—Birch, Stewart, Kolasch & Birch, LLP

[57] ABSTRACT

An image-forming material comprising a support and a constituent layer(s) comprising at least (a) a thermographic image-forming layer containing a reducible silver salt, a reducing agent of the reducible silver salt and a binder or (b) a photothermographic image-forming layer containing a light-sensitive silver halide as a photocatalyst, reducible silver salt, a reducing agent of the reducible silver salt and a binder, wherein the image-forming material comprises a compound represented by formula (I-1) or (II-1) in at least one constituent layer:

(I-1)

wherein R represents a secondary alkyl group or a cycloalkyl group; and $M^1$ and $M^2$ each represents a hydrogen atom, a metal ion or an ammonium ion;

(II-1)

wherein $R^1$ represents a secondary alkyl group, a cycloalkyl group, an aryl group, or a primary alkyl group substituted with a substituent bonded via a hetero atom; and $M^1$ and $M^2$ each represents a hydrogen atom, a metal ion or an ammonium ion.

20 Claims, No Drawings

PHOTOTHERMOGRAPHIC OR THERMOGRAPHIC IMAGE-FORMING MATERIAL

FIELD OF THE INVENTION

The present invention relates to a photothermographic or thermographic image-forming material.

BACKGROUND OF THE INVENTION

Reduction of waste solutions has been strongly desired in recent years in the medical or printing industrial field from the viewpoint of environmental protection and space saving. Accordingly, techniques concerning a photothermographic material for medical diagnosis and photography which can be exposed efficiently with a laser/image setter or a laser/imager and can form a clear black image exhibiting high resolving power and sharpness have been desired. Such a photothermographic material can offer to customers a simpler and environmentally benign heat development processing system in which the use of solution-based processing chemicals can be done away with.

On the other hand, techniques of a semiconductor laser which have rapidly progressed in recent years have made it possible to realize a compact size image output apparatus. Techniques of infrared ray-sensitive photothermographic silver halide photographic materials in which a semiconductor laser can be used as a light source have of course been developed. For example, techniques of spectral sensitization are disclosed in JP-B-3-10391 (the term "JP-B" as used herein means an "examined Japanese patent publication"), JP-B-6-52387, JP-A-5-341432 (the term "JP-A" as used herein means an "unexamined published Japanese patent application"), JP-A-6-194781, JP-A-6-301141 and EP-A-803764. Techniques for preventing halation are disclosed in JP-A-7-13295 and U.S. Pat. No. 5,380,635. Photosensitive materials which are premised on infrared ray exposure can largely reduce the absorption of sensitizing dyes and antihalation dyes in a visible ray region and substantially colorless photothermographic or thermographic materials can be manufactured easily.

However, there is a problem even in these photothermographic materials such that storage stability before and after image formation is not satisfactory, therefore, the improvement of such a problem has been desired.

SUMMARY OF THE INVENTION

Accordingly, an object of the present invention is to provide a photothermographic or thermographic image-forming material of high sensitivity and low fog which is excellent in the storage stability before and after image formation, excellent in handling property, and provides an image of blue black tone.

The above object of the present invention has been attained by the following.

(1) An image-forming material comprising a support and a constituent layer(s) comprising at least (a) a thermographic image-forming layer containing a reducible silver salt, a reducing agent of the reducible silver salt and a binder or (b) a photothermographic image-forming layer containing a light-sensitive silver halide as a photocatalyst, reducible silver salt, a reducing agent of the reducible silver salt and a binder, wherein the image-forming material comprises a compound represented by formula (I-1) or (II-1) in at least one constituent layer:

(I-1)

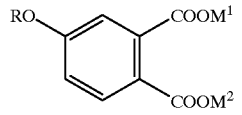

wherein R represents a secondary alkyl group or a cycloalkyl group; and $M^1$ and $M^2$ each represents a hydrogen atom, a metal ion or an ammonium ion;

(II-1)

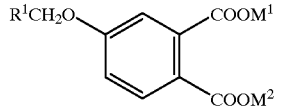

wherein $R^1$ represents a secondary alkyl group, a cycloalkyl group, an aryl group, or a primary alkyl group substituted with a substituent bonded via a hetero atom; and $M^1$ and $M^2$ each represents a hydrogen atom, a metal ion or an ammonium ion.

Preferred embodiments of the present invention are described below.

(2) The image-forming material according to claim 1, wherein the constituent layer(s) comprises at least (b) the photothermographic layer.

(3) The image-forming material according to claim 1, wherein the compound is represented by formula (II-1).

(4) The image-forming material according to claim 1, wherein the constituent layer contains a nucleating agent.

(5) The image-forming material according to claim 1, wherein the compound is added to the image-forming layer or to a layer farther than the image-forming layer from the support side.

(6) The image-forming material according to claim 1, wherein the compound is represented by formula (II-a):

(II-a)

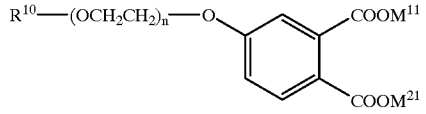

wherein R represents a hydrogen atom or an alkyl group; n represents an integer of from 1 to 6; and $M^{11}$ and $M^{21}$ each represents a hydrogen atom, a metal ion or an ammonium ion.

(7) The image-forming material according to claim 1, wherein the compound is contained of $10^{-3}$ to 10 mol per mol of Ag.

(8) The image-forming material according to claim 1, wherein the heat-sensitive imaging layer or the light-sensitive imaging layer was provided by coating and drying a coating composition which contains the binder in the state of aqueous latex or polymer dissolved or dispersed in a water-base solvent.

DETAILED DESCRIPTION OF THE INVENTION

The present invention is described in detail below.

The thermographic image-forming material according to the present invention contains a reducible silver salt, a reducing agent, and a binder, and an image is formed by heat development. The photothermographic image-forming material according to the present invention further contains a photosensitive silver halide as a photocatalyst. By the incorporation of the compound represented by formula (I-1) or (II-1), a photothermographic or thermophotographic image-forming material having high sensitivity and low fog, exhibiting fine tone and excellent storage stability before and after image formation can be obtained. While when the compound is different from the compound represented by formula (I-1) is a compound in which R represents a primary alkyl group or a hydrogen atom, or when the compound is different from the compound represented by formula (II-1), e.g., the compound in which the primary alkyl group is substituted with an alkoxyl group or a hydroxyl group in which the substituent at the 4-position of the phthalic acid is not substituted with a substituent bonded via a hetero atom, sensitivity lowers and storage stability before and after image formation deteriorates therefore practicable properties cannot be obtained.

The compound represented by formula (I-1) according to the present invention is described in further detail below.

In formula (I-1), R represents a secondary alkyl group or a cycloalkyl group, which may be substituted with a substituent.

Examples of secondary alkyl groups represented by R include those having from 3 to 16 carbon atoms (e.g., isopropyl, 2-butyl, 2-hexyl, 3-pentyl, 2-octyl).

Examples of cycloalkyl groups represented by R include those having from 3 to 16 carbon atoms (e.g., cyclopentyl, cyclohexyl, cyclooctyl, cyclododecyl).

These alkyl groups represented by R may have a substituent. The total carbon atoms of the alkyl group including the carbon atoms of the substituent are preferably from 3 to 18.

Examples of substituents of these alkyl groups represented by R include a halogen atom and groups bonded via a carbon atom, an oxygen atom, a nitrogen atom or a sulfur atom.

As substituents bonded via a carbon atom, e.g., an alkyl group, an alkenyl group, an alkynyl group, an aryl group, an acyl group, an oxycarbonyl group, a carbamoyl group, a carboxyl group and a cyano group can be exemplified.

Examples of substituents bonded via an oxygen atom include a hydroxyl group, an alkoxyl group, an aryloxy group, an acyloxy group, a carbamoyloxy group, and a sulfonyloxy group. Examples of substituents bonded via a nitrogen atom include an acylamino group, an amino group, an alkylamino group, an arylamino group, a ureido group, a sulfamoylamino group, an alkoxycarbonylamino group, an aryloxycarbonylamino group, a sulfonamido group, and an imido group. Examples of substituents bonded via a sulfur atom include an alkylthio group, an arylthio group, a sulfamoyl group, a sulfonyl group and a sulfinyl group. These substituents may further be substituted with an alkyl group, an alkenyl group, an alkynyl group, an aryl group, a hydroxyl group, a cyano group, a halogen atom or a substituent bonded via an oxygen atom, a nitrogen atom, a sulfur atom, or a carbon atom.

Specific examples of the substituents of R are described below.

Examples of halogen atoms are, e.g., a fluorine atom, a chlorine atom and a bromine atom.

Examples of alkyl groups include straight chain, branched or cyclic alkyl groups having from 1 to 16, preferably from 1 to 12, carbon atoms (e.g., methyl, ethyl, isopropyl, 2-hydroxyethyl, benzyl, 2-methanesulfonamidoethyl, 2-methoxyethyl, cyclopentyl, 2-carboxyethyl).

Examples of alkenyl groups include alkenyl groups having from 2 to 16, preferably from 2 to 10, carbon atoms (e.g., vinyl, 1-propenyl, 1-hexenyl, styryl).

Examples of alkynyl groups include alkynyl groups having from 2 to 16, preferably from 2 to 10, carbon atoms (e.g., ethynyl, 1-butynyl, 1-dodecenyl, phenylethynyl).

Examples of aryl groups include aryl groups having from 6 to 24, preferably from 6 to 12, carbon atoms (e.g., phenyl, naphthyl, p-methoxyphenyl).

Examples of acyl groups include acyl groups having from 1 to 18, preferably from 1 to 10, carbon atoms (e.g., acetyl, benzoyl).

Examples of oxycarbonyl groups include alkoxycarbonyl groups and aryloxycarbonyl groups. Examples of alkoxycarbonyl groups include alkoxycarbonyl groups having from 2 to 18, preferably from 2 to 10, carbon atoms (e.g., methoxycarbonyl, benzyloxycarbonyl). Examples of aryloxycarbonyl groups include aryloxycarbonyl groups having from 7 to 18, preferably from 7 to 12, carbon atoms (e.g., phenoxycarbonyl).

Examples of carbamoyl groups include carbamoyl groups having from 1 to 18, preferably from 1 to 10, carbon atoms (e.g., carbamoyl, N-ethylcarbamoyl, N-octylcarbamoyl, N-phenylcarbamoyl).

Examples of alkoxyl groups include alkoxyl groups having from 1 to 16, preferably from 1 to 10, carbon atoms, which may be groups containing alkyleneoxy, such as ethyleneoxy or propyleneoxy, as a repeating unit (e.g., methoxy, ethoxy, 2-methoxyethoxy, 2-methanesulfonylethoxy, benzyloxy).

Examples of aryloxy groups include aryloxy groups having from 6 to 24, preferably from 6 to 12, carbon atoms (e.g., phenoxy, 4-methoxyphenoxy, 3-chlorophenoxy).

Examples of acyloxy groups include acyloxy groups having from 1 to 16, preferably from 1 to 10, carbon atoms (e.g., acetoxy, benzoyloxy, 4-hydroxybutanoyloxy).

Examples of carbamoyloxy groups include carbamoyloxy groups having from 1 to 16, preferably from 1 to 10, carbon atoms (e.g., N,N-dimethylcarbamoyloxy, N-methylcarbamoyloxy, N-phenylcarbamoyloxy).

Examples of sulfonyloxy groups include sulfonyloxy groups having from 1 to 16, preferably from 1 to 10, carbon atoms (e.g., methanesulfonyloxy, benzenesulfonyloxy).

Examples of acylamino groups include acylamino groups having from 1 to 16, preferably from 1 to 10, carbon atoms (e.g., acetamido, 2-methoxypropionamido, p-chlorobenzoylamido).

Examples of alkylamino groups include alkylamino groups having from 1 to 16, preferably from 1 to 10, carbon atoms (e.g., N,N-dimethylamino, N,N-diethylamino, N-(2-phenoxyethyl)amino).

Examples of arylamino groups include arylamino groups having from 6 to 24, preferably from 6 to 12, carbon atoms (e.g., anilino, m-nitroanilino, N-methylanilino).

Examples of ureido groups include ureido groups having from 1 to 16, preferably from 1 to 10, carbon atoms (e.g., ureido, methylureido, N,N-diethylureido, 2-methanesulfonamidoethylureido).

Examples of sulfamoylamino groups include sulfamoylamino groups having from 0 to 16, preferably from 0 to 10, carbon atoms (e.g., dimethylsulfamoylamino, methylsulfamoylamino, 2-methoxyethylsulfamoylamino).

Examples of alkoxycarbonylamino groups include alkoxycarbonylamino groups having from 2 to 16, preferably from 2 to 10, carbon atoms (e.g., methoxycarbonylamino, ethoxycarbonylamino, 3-methanesulfonylpropyloxycarbonylamino).

Examples of aryloxycarbonylamino groups include aryloxycarbonylamino groups having from 7 to 24, preferably from 7 to 12, carbon atoms (e.g., phenoxycarbonylamino, 4-cyanophenoxycarbonylamino, 2,6-dimethoxyphenoxycarbonylamino).

Examples of sulfonamido groups include sulfonamido groups having from 1 to 16, preferably from 1 to 10, carbon atoms (e.g., methanesulfonamido, p-toluenesulfonamido, 2-methoxyethanesulfonamido).

Examples of imido groups include imido groups having from 4 to 16 carbon atoms (e.g., N-succinimido, N-phthalimido).

Examples of alkylthio groups include alkylthio groups having from 1 to 16, preferably from 1 to 10, carbon atoms (e.g., methylthio, butylthio, 2-phenoxyethylthio).

Examples of arylthio groups include arylthio groups having from 6 to 24, preferably from 6 to 12, carbon atoms (e.g., phenylthio, 2-chlorophenylthio, 4-cyanophenylthio).

Examples of sulfamoyl groups include sulfamoyl groups having from 0 to 16, preferably from 0 to 10, carbon atoms (e.g., sulfamoyl, methylsulfamoyl, phenylsulfamoyl).

Examples of sulfonyl groups include sulfonyl groups having from 1 to 16, preferably from 1 to 10, carbon atoms (e.g., methanesulfonyl, ethanesulfonyl, benzenesulfonyl).

Examples of sulfinyl groups include sulfinyl groups having from 1 to 16, preferably from 1 to 10, carbon atoms (e.g., methanesulfinyl, benzenesulfinyl).

Preferred examples of substituents of R include a halogen atom, a hydroxyl group, an alkoxyl group, an alkylthio group, and a sulfonyl group, and more preferred are a hydroxyl group and an alkoxyl group.

R preferably represents a secondary alkyl group. A secondary alkyl group which is substituted with an alkoxyl group or a hydroxyl group is most preferred.

$M^1$ and $M^2$, which may be the same or different, each represents a hydrogen atom, a metal ion or an ammonium ion. As metal ions, a sodium ion and a potassium ion can be exemplified. As ammonium ions, an ammonium ion, a pyridinium ion, a triethylammonium ion, and a tetrabutylammonium ion can be exemplified. $M^1$ and $M^2$ each preferably represents a hydrogen atom or an alkali metal ion.

Specific examples of the compounds represented by formula (I-1) for use in the present invention are shown below, but the present invention is not limited thereto.

1-1

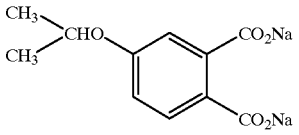

1-2

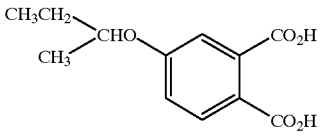

-continued 1-3

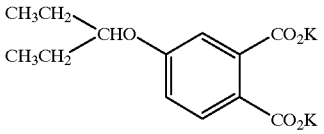

1-4

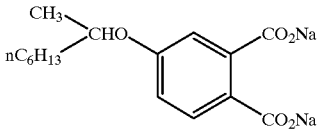

1-5

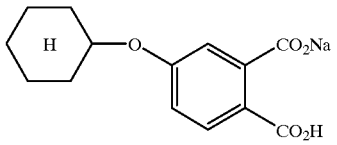

1-6

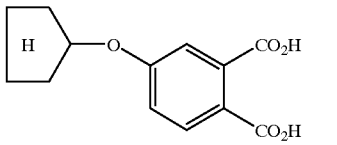

1-7

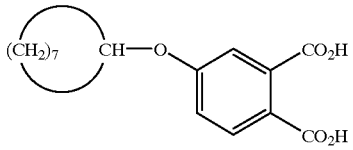

1-8

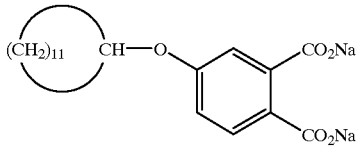

1-9

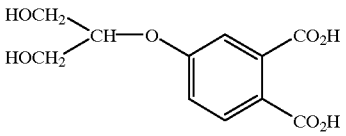

1-10

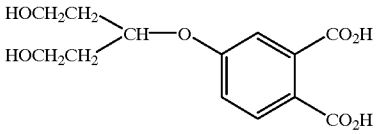

1-11

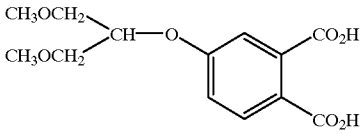

1-12

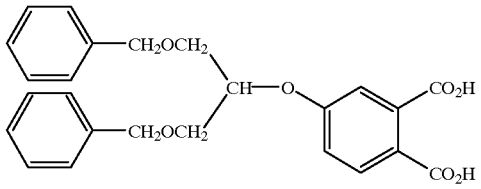

-continued 1-13

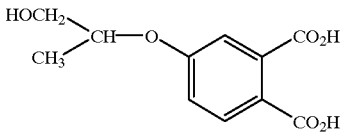

1-14

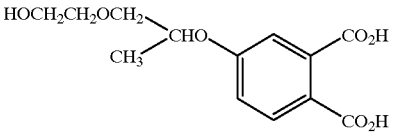

1-15

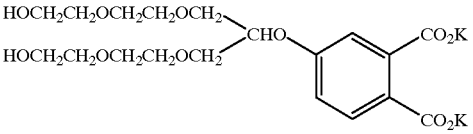

1-16

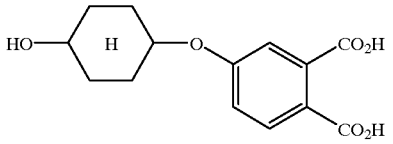

1-17

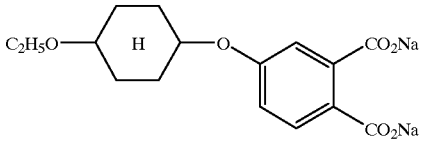

1-18

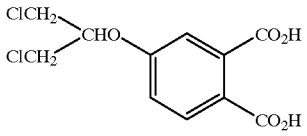

1-19

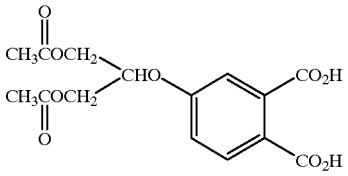

1-20

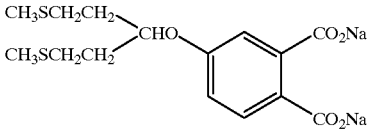

1-21

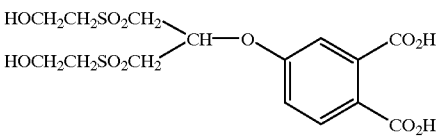

1-22

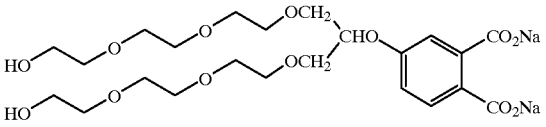

-continued 1-23

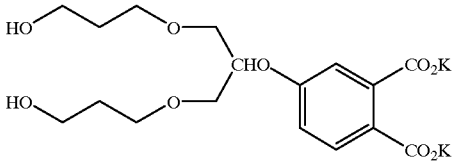

1-24

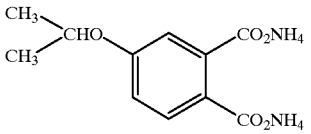

A synthesis example of the compound represented by formula (I-1) according to the present invention is described below. Other compounds can also be synthesized according to equivalent methods.

1. SYNTHESIS OF COMPOUND 1-1

To 100 ml of dimethylacetamide were added 5.0 g of 4-hydroxyphthalic acid, 37.4 g of isopropyl iodide, and 22.8 g of potassium carbonate. The mixture was allowed to react for 6 hours at 120° C. with stirring. The solvent was distilled off under reduced pressure to concentrate the reaction solution, 100 ml of water was added thereto, and extracted with 100 ml of ethyl acetate. The ethyl acetate layer was washed with water and followed by concentration using an evaporator, thereby 6.8 g of an oily product was obtained.

Two hundred (200) ml of methanol was added thereto, then a solution of 5 ml of water containing 3.1 g of sodium hydroxide was added and the reaction solution was then refluxed with heating for 2 hours. Subsequently, acetic acid was added to adjust pH to 8 and the methanol was distilled off and followed by the addition of 200 ml of acetonitrile. The crystals precipitated were filtered off, washed with acetonitrile and dried under reduced pressure to thereby obtain 4.5 g of the objective compound (yield: 61%).

NMR (DMSO/a small amount of $D_2O$): δ 1.35 (br, 6H), 4.65 (br, 1H), 6.75 (br, 2H), 7.45 (d, 1H).

The compound represented by formula (II-1) according to the present invention is described further in detail below.

In formula (II-1), $R^1$ represents a secondary alkyl group, a cycloalkyl group, an aryl group, or a primary alkyl group substituted with a substituent bonded via a hetero atom. These groups may be substituted with a substituent.

Examples of secondary alkyl groups include those having from 3 to 16 carbon atoms (e.g., isopropyl, 2-butyl, 2-hexyl, 3-pentyl, 3-heptyl, 2-octyl, 5-undecyl, 7-pentadecyl).

Examples of cycloalkyl groups include those having from 3 to 16 carbon atoms (e.g., cyclopentyl, cyclohexyl, cyclooctyl, cyclododecyl).

Examples of aryl groups include those having from 6 to 18 carbon atoms (e.g., phenyl, naphthyl).

A primary alkyl group substituted with a substituent bonded via a hetero atom is described below. Examples of primary alkyl groups include those having from 1 to 16 carbon atoms, e.g., methyl, ethyl, propyl, butyl, hexyl and dodecyl.

Examples of substituents of these primary alkyl groups bonded via a hetero atom include a halogen atom or substituents bonded via an oxygen atom, a nitrogen atom, or a sulfur atom. Examples of substituents bonded via an oxygen atom include a hydroxyl group, an alkoxyl group, an aryloxy group, an acyloxy group, a carbamoyloxy group, and a sulfonyloxy group. Examples of substituents bonded via a nitrogen atom include an acylamino group, an amino group, an alkylamino group, an arylamino group, a ureido group, a sulfamoylamino group, an alkoxycarbonylamino group, an aryloxycarbonylamino group, a sulfonamido group, and an imido group. Examples of substituents bonded via a sulfur atom include an alkylthio group, an arylthio group, a sulfamoyl group, a sulfonyl group and a sulfinyl group. These substituents may further be substituted with an alkyl group, an alkenyl group, an alkynyl group, an aryl group, a hydroxyl group, a cyano group, a halogen atom or a substituent bonded via an oxygen atom, a nitrogen atom, a sulfur atom, or a carbon atom.

When $R^1$ represents a primary alkyl group, specific examples of substituents bonded via a hetero atom which $R^1$ may have are described below. Examples of halogen atoms are a fluorine atom, a chlorine atom and a bromine atom.

Examples of alkoxyl groups include alkoxyl groups having from 1 to 16, preferably from 1 to 10, carbon atoms, which may be groups containing alkyleneoxy, such as ethyleneoxy or propyleneoxy, as a repeating unit (e.g., methoxy, ethoxy, propoxy, 2-methoxyethoxy, 2-methanesulfonylethoxy).

Examples of aryloxy groups include aryloxy groups having from 6 to 24, preferably from 6 to 12, carbon atoms (e.g., phenoxy, 4-methoxyphenoxy, 3-chlorophenoxy).

Examples of acyloxy groups include acyloxy groups having from 1 to 16, preferably from 1 to 10, carbon atoms (e.g., acetoxy, benzoyloxy, 4-hydroxybutanoyloxy).

Examples of carbamoyloxy groups include carbamoyloxy groups having from 1 to 16, preferably from 1 to 10, carbon atoms (e.g., N,N-dimethylcarbamoyloxy, N-methylcarbamoyloxy, N-phenylcarbamoyloxy).

Examples of sulfonyloxy groups include sulfonyloxy groups having from 1 to 16, preferably from 1 to 10, carbon atoms (e.g., methanesulfonyloxy, benzenesulfonyloxy).

Examples of acylamino groups include acylamino groups having from 1 to 16, preferably from 1 to 10, carbon atoms (e.g., acetamido, 2-methoxypropionamido, p-chlorobenzoylamido).

Examples of alkylamino groups include alkylamino groups having from 1 to 16, preferably from 1 to 10, carbon atoms (e.g., N,N-dimethylamino, N,N-diethylamino, N-(2-phenoxyethyl)amino).

Examples of arylamino groups include arylamino groups having from 6 to 24, preferably from 6 to 12, carbon atoms (e.g., anilino, m-nitroanilino, N-methylanilino).

Examples of ureido groups include ureido groups having from 1 to 16, preferably from 1 to 10, carbon atoms (e.g., ureido, methylureido, N,N-diethylureido, 2-methanesulfonamidoethylureido).

Examples of sulfamoylamino groups include sulfamoylamino groups having from 0 to 16, preferably from 0 to 10, carbon atoms (e.g., dimethylsulfamoylamino, methylsulfamoylamino, 2-methoxyethylsulfamoylamino).

Examples of alkoxycarbonylamino groups include alkoxycarbonylamino groups having from 2 to 16, preferably from 2 to 10, carbon atoms (e.g., methoxycarbonylamino, ethoxycarbonylamino, 3-methanesulfonylpropyloxycarbonylamino).

Examples of aryloxycarbonylamino groups include aryloxycarbonylamino groups having from 7 to 24, preferably from 7 to 12, carbon atoms (e.g., phenoxycarbonylamino, 4-cyanophenoxycarbonylamino, 2,6-dimethoxyphenoxycarbonylamino).

Examples of sulfonamido groups include sulfonamido groups having from 1 to 16, preferably from 1 to 10, carbon atoms (e.g., methanesulfonamido, p-toluenesulfonamido, 2-methoxyethanesulfonamido).

Examples of imido groups include imido groups having from 4 to 16 carbon atoms (e.g., N-succinimido, N-phthalimido).

Examples of alkylthio groups include alkylthio groups having from 1 to 16, preferably from 1 to 10, carbon atoms (e.g., methylthio, butylthio, 2-phenoxyethylthio).

Examples of arylthio groups include arylthio groups having from 6 to 24, preferably from 6 to 12, carbon atoms (e.g., phenylthio, 2-chlorophenylthio, 4-cyanophenylthio).

Examples of sulfamoyl groups include sulfamoyl groups having from 0 to 16, preferably from 0 to 10, carbon atoms (e.g., sulfamoyl, methylsulfamoyl, phenylsulfamoyl).

Examples of sulfonyl groups include sulfonyl groups having from 1 to 16, preferably from 1 to 10, carbon atoms (e.g., methanesulfonyl, benzenesulfonyl).

Examples of sulfinyl groups include sulfinyl groups having from 1 to 16, preferably from 1 to 10, carbon atoms (e.g., methanesulfinyl, benzenesulfinyl).

When $R^1$ represents a primary alkyl group substituted with a substituent bonded via a hetero atom, preferred examples of such substituents include a halogen atom, a hydroxyl group, an alkoxyl group, an alkylthio group, and a sulfonyl group, more preferred examples are a hydroxyl group and an alkoxyl group.

In addition to the foregoing substituents bonded via a hetero atom which $R^1$ may have, as substituents bonded via a carbon atom, e.g., an alkyl group, an alkenyl group, an alkynyl group, an aryl group, an acyl group, an oxycarbonyl group, a carbamoyl group, a carboxyl group and a cyano group can be exemplified.

Examples of alkyl groups include straight chain, branched or cyclic alkyl groups having from 1 to 16, preferably from 1 to 12, carbon atoms (e.g., methyl, ethyl, isopropyl, 2-hydroxyethyl, benzyl, 2-methanesulfonamidoethyl, 2-methoxyethyl, cyclopentyl, 2-carboxyethyl).

Examples of alkenyl groups include alkenyl groups having from 2 to 16, preferably from 2 to 10, carbon atoms (e.g., vinyl, 1-propenyl, 1-hexenyl, styryl).

Examples of alkynyl groups include alkynyl groups having from 2 to 16, preferably from 2 to 10, carbon atoms (e.g., ethynyl, 1-butynyl, 1-dodecenyl, phenylethynyl).

Examples of aryl groups include aryl groups having from 6 to 24, preferably from 6 to 12, carbon atoms (e.g., phenyl, naphthyl, p-methoxyphenyl).

Examples of acyl groups include acyl groups having from 1 to 18, preferably from 1 to 10, carbon atoms (e.g., acetyl, benzoyl).

Examples of oxycarbonyl groups include alkoxycarbonyl groups and aryloxycarbonyl groups. Examples of alkoxycarbonyl groups include alkoxycarbonyl groups having from 2 to 18, preferably from 2 to 10, carbon atoms (e.g., methoxycarbonyl, benzyloxycarbonyl). Examples of aryloxycarbonyl groups include aryloxycarbonyl groups having from 7 to 18, preferably from 7 to 12, carbon atoms (e.g., phenoxycarbonyl).

Examples of carbamoyl groups include carbamoyl groups having from 1 to 18, preferably from 1 to 10, carbon atoms (e.g., carbamoyl, N-ethylcarbamoyl, N-octylcarbamoyl, N-phenylcarbamoyl).

The total carbon atoms of $R^1$ including the carbon atoms of the substituent are preferably from 3 to 18 when $R^1$ represents a secondary alkyl group, preferably from 3 to 18 when $R^1$ represents a cycloalkyl group, preferably from 6 to 20 when $R^1$ represents an aryl group, and preferably from 1 to 18 when $R^1$ represents a primary alkyl group substituted with a substituent bonded via a hetero atom.

$R^1$ preferably represents a primary alkyl group substituted with a substituent bonded via a hetero atom, more preferably a primary alkyl group substituted with a hydroxyl group or an alkoxyl group.

$M^1$ and $M^2$, which may be the same or different, each represents a hydrogen atom, a metal ion or an ammonium ion.

As metal ions, a sodium ion and a potassium ion can be exemplified. As ammonium ions, an ammonium ion, a pyridinium ion, a triethylammonium ion, and a tetrabutylammonium ion can be exemplified. $M^1$ and $M^2$ each preferably represents a hydrogen atom or an alkali metal ion.

The compound represented by formula (II-1) according to the present invention is preferably represented by formula (II-a):

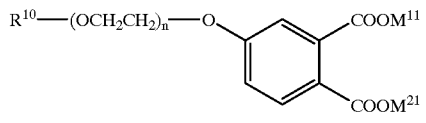

(II-a)

wherein $R^{10}$ represents a hydrogen atom or an alkyl group; n represents an integer of from 1 to 6; and $M^{11}$ and $M^{21}$ each has the same meaning as $M^1$ and $M^2$ in formula (II-1) and preferred groups are also the same.

Specific examples of the compounds represented by formula (II-1) for use in the present invention are shown below, but the present invention is not limited thereto.

2-1

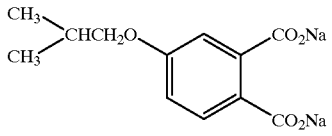

2-2

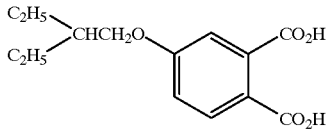

2-3

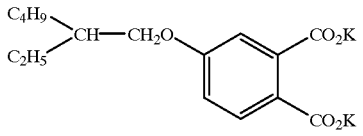

2-4

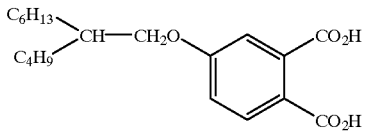

2-5

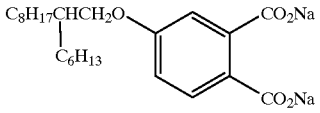

2-6

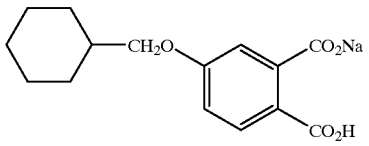

2-7

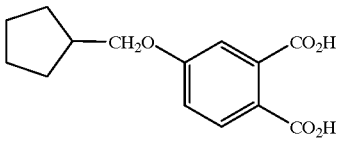

-continued
2-8
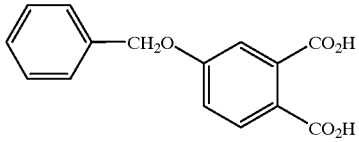
2-9
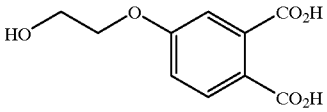
2-10
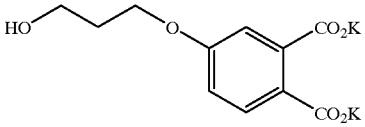
2-11
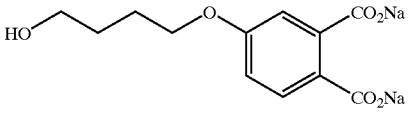
2-12
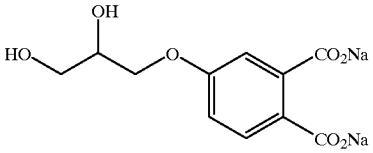
2-13
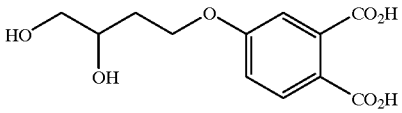
2-14
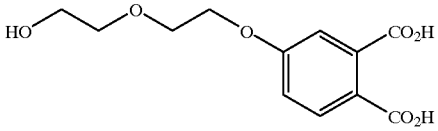
2-15
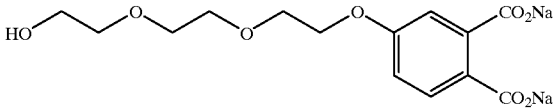
2-16
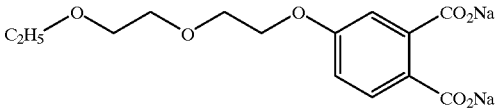
2-17
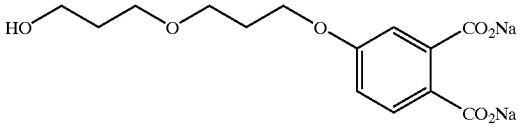
2-18
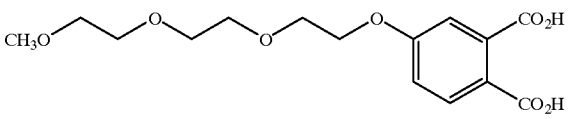

-continued
2-19
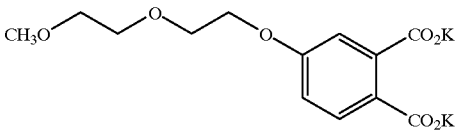
2-20
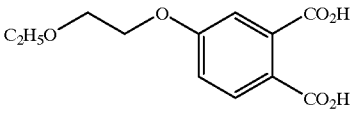
2-21
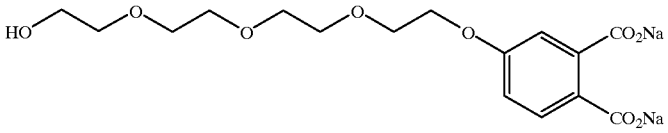
2-22
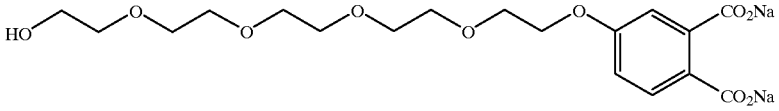
2-23
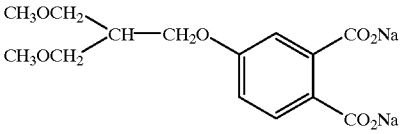
2-24
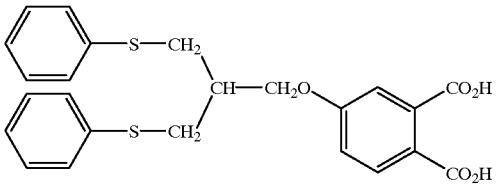
2-25
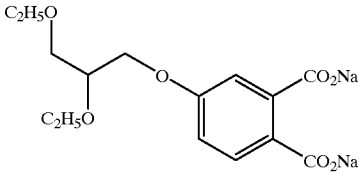
2-26
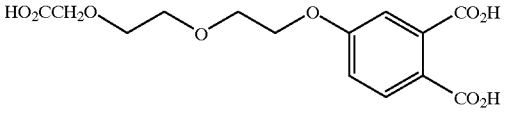
2-27
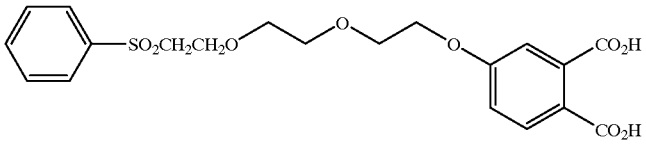
2-28
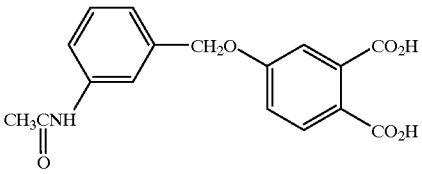

-continued 2-29

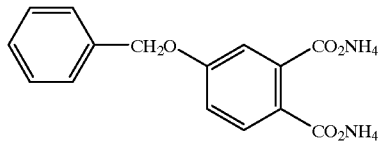

2-30

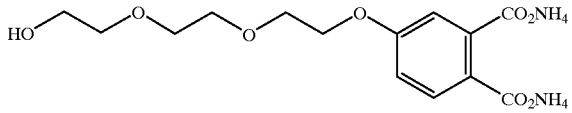

Synthesis examples of the compounds represented by formula (II-1) according to the present invention are described below. Other compounds can also be synthesized according to equivalent methods.

1. SYNTHESIS OF COMPOUND 2-10

Five point zero (5.0) grams of 4-hydroxyphthalic acid and 13 g of 3-bromo-1-propanol were allowed to react in dimethylformamide while refluxing with heating in the presence of 10 g of potassium carbonate, a catalytic amount of 18-crown-6 and a catalytic amount of potassium iodide. The reaction was pursued with thin layer chromatography (TLC), heating was stopped when the reaction product became homogeneous and the temperature was lowered to room temperature. The reaction mixture was acetylated by the addition of acetic anhydride and triethylamine. Water was added to the reaction solution thereby the reaction was stopped. This mixture was extracted with ethyl acetate and the organic layer was concentrated. A methanol solution containing potassium hydroxide was added thereto and refluxed with heating, thereby white solids were formed. The solids formed were filtered, washed with ethyl acetate, and then dried, thereby 1.7 g of dipotassium 4-(3-hydroxypropoxy)-phthalate was obtained.

NMR ($D_2O$): δ 1.93 (tt, J=6.3, 6.3Hz, 2H), 3.68 (t, J=6.3 Hz, 2H), 4.09 (t, J=6.3 Hz, 2H), 6.86 (m, 2H), 7.43 (d, J=9.2 Hz, 1H).

2. SYNTHESIS OF COMPOUND 2-15

To 400 ml of dimethylformamide were added 84.1 g of dimethyl 4-hydroxyphthalate, 87.7 g of 2-[2-(2-chloroethoxy)-ethoxy]ethanol, 71.8 g of potassium carbonate, and 3 g of sodium iodide. The mixture was allowed to react for 6 hours at 120° C. with stirring. The solvent was distilled off under reduced pressure and the reaction solution was concentrated, then a mixed solution comprising 300 ml of ethyl acetate and 300 ml of methanol was added thereto and followed by filtration. The filtrate was concentrated using an evaporator, thereby 121 g of an oily product was obtained.

Eight hundred (800) ml of methanol was added thereto, then a solution of 45 ml of water containing 38.4 g of sodium hydroxide was added and the reaction system was then refluxed with heating for 5 hours. The reaction solution was allowed to be cooled, then 20 ml of acetic acid was added to adjust pH to 8 and 550 ml of the methanol was distilled off and followed by the addition of 600 ml of acetonitrile. The crystals precipitated were filtered, washed with a mixed solvent of methanol/acetonitrile (½) and dried under reduced pressure to thereby obtain 106 g of the objective compound (yield: 74%).

NMR ($D_2O$): δ 3.6–3.8 (m, 8H), 3.9 (2H), 4.25 (2H), 6.95 (2H), 7.55 (1H).

3. SYNTHESIS OF COMPOUND 2-16

Synthesis of Intermediate

A solution of 30 ml of dimethylacetamide containing 5 g of dimethyl 4-hydroxyphthalate, 4.4 g of 1-(2-chloroethoxy)-2-ethoxyethane, 3.9 g of potassium carbonate, and 0.3 g of potassium iodide was refluxed with heating at 100° C. for 2 hours. After the reaction solution was ice-cooled, 100 ml of hydrochloric acid (1 N) was gradually dropwise added to the solution, then 100 ml of ethyl acetate was added thereto to extract a product formed. The organic layer of the product extracted was dried over sodium sulfate and concentrated, thereby 8 g of an intermediate was obtained.

Synthesis of Compound 2-16

Ten (10) ml of a 5 N sodium hydroxide solution was added to a solution of 20 ml of ethanol containing 8 g of the intermediate synthesized and the mixture was stirred with heating at 80° C. for 1 hour. The reaction solution was cooled to room temperature, and then 50 ml of acetone was added thereto to crystallize the product. The crystallized product was filtered, thereby 5 g of Compound 2-16 was obtained.

$^1$H NMR ($D_2O$): δ 1.15 (t, 3H), 3.59 (q, 2H), 3.62 (d, 2H), 3.71 (d, 2H), 3.86 (d, 2H), 4.22 (d, 2H), 6.95 (s+d, 2H), 7.54 (d, 1H).

The compounds according to the present invention can be used by being dissolved in water or an appropriate water-miscible organic solvent, such as alcohols (e.g., methanol, ethanol, propanol, fluorinated alcohol), ketones (e.g., acetone, methyl ethyl ketone), dimethylformamide, dimethylsulfoxide (DMSO), methyl cellosolve and the like.

Further, the compounds according to the present invention can be used by being dissolved in oils such as dibutyl phthalate, tricresyl phosphate, glyceryl triacetate, or diethyl phthalate, or auxiliary solvents such as ethyl acetate or cyclohexanone by well-known emulsifying dispersing methods to make mechanically an emulsifying dispersion. Alternatively, powders of the compounds according to the present invention may be dispersed in water using a ball mill or a colloid mill by a solid dispersion method, or dispersion may be performed by ultrasonic waves.

The addition amount of the compounds according to the present invention represented by formula (I-1) or (II-1) is preferably from $10^{-3}$ to 10 mol, more preferably from $10^{-2}$ to 1 mol, per mol of Ag. They can be used alone or in combination of two or more.

The compounds according to the present invention represented by formula (I-1) or (II-1) can be used in combination with aromatic polycarboxylic acids (e.g., phthalic acid, 4-methylphthalic acid, 3-aminophthalic acid, homophthalic acid, trimellitic acid), monobase of monovalent metals thereof (e.g., sodium phthalate, potassium phthalate, sodium 4-methylphthalate, sodium homophthalate), or polybase of monovalent metals thereof (e.g., disodium phthalate, dipotassium phthalate, disodium 4-methylphthalate, disodium homophthalate, disodium trimellitate, trisodium trimellitate). When the compounds represented by formula (I-1) or (II-1) are used in combination with these compounds, the compounds according to the present invention are preferably used in an amount of 10 mol % or more of the total amount.

The compounds represented by formula (I-1) or (II-1) can be added to any layer so long as the layer is positioned on the same side with the image-forming layer containing a reducible silver salt (an organic silver salt) (preferably a photothermographic or thermographic image-forming layer containing a photosensitive silver halide). The compound is preferably added to the image-forming layer, layers farther than the image-forming layer from the support side (an interlayer or a protective layer), or a plurality of layers of any of these layers.

For obtaining a high contrast image in the present invention, a nucleating agent is preferably contained in a photothermographic image-forming material. As nucleating agent for use in the present invention, substituted alkene derivatives, substituted isooxazole derivatives, and specific acetal compounds represented by the following formulae (III), (IV) and (V), respectively, are preferably used.

The compounds represented by formula (III), (IV) or (V) are described below.

(III)

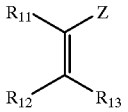

(IV)

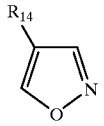

(V)

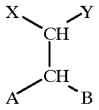

In formula (III), $R_{11}$, $R_{12}$ and $R_{13}$ each represents a hydrogen atom or a substituent; and Z represents an electron attractive group or a silyl group. In formula (III), $R_{11}$, and Z, $R_{12}$ and $R_{13}$, $R_{11}$ and $R_{12}$, or $R_{13}$ and Z may be bonded to each other to form a cyclic structure. In formula (IV), $R_{14}$ represents a substituent. In formula (V), X and Y each represents a hydrogen atom or a substituent; and A and B each represents an alkoxyl group, an alkylthio group, an alkylamino group, an aryloxy group, an arylthio group, an anilino group, a heterocyclic oxy group, a heterocyclic thio group, or a heterocyclic amino group. In formula (V), X and Y, or A and B may be bonded to each other to form a cyclic structure.

The compounds represented by formula (III) are described in detail below.

In formula (III), $R_{11}$, $R_{12}$ and $R_{13}$ each represents a hydrogen atom or a substituent; and Z represents an electron attractive group or a silyl group. In formula (III), $R_{11}$ and Z, $R_{12}$ and $R_{13}$, $R_{11}$ and $R_{12}$, or $R_{13}$ and Z may be bonded to each other to form a cyclic structure.

When $R_{11}$, $R_{12}$ and $R_{13}$ each represents a substituent, examples of the substituents include a halogen atom (e.g., fluorine, chlorine, bromine, iodine), an alkyl group (including an aralkyl group, a cycloalkyl group, and an active methine group), an alkenyl group, an alkynyl group, an aryl group, a heterocyclic group (including an N-substituted nitrogen-containing heterocyclic group), a quaternized nitrogen-containing heterocyclic group (e.g., a pyridinio group), an acyl group, an alkoxycarbonyl group, an aryloxycarbonyl group, a carbamoyl group, a carboxyl group or a salt thereof, an imino group, an N-substituted imino group, a thiocarbonyl group, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxyl group or a salt thereof, an alkoxyl group (including a group containing an ethyleneoxy group or a propyleneoxy group as a repeating unit), an aryloxy group, a heterocyclic oxy group, an acyloxy group, an alkoxy- or aryloxycarbonyloxy group, a carbamoyloxy group, a sulfonyloxy group, an amino group, an alkyl-, aryl- or heterocyclic amino group, an acylamino group, a sulfonamido group, a ureido group, a thioureido group, an imido group, an alkoxy- or aryloxycarbonylamino group, a sulfamoylamino group, a semicarbazide group, a thiosemicarbazide group, a hydrazino group, a quaternary ammonio group, an oxamoylamino group, an alkyl- or arylsulfonylureido group, an acylureido group, an acylsulfamoylamino group, a nitro group, a mercapto group, an alkyl-, aryl- or heterocyclic thio group, an acylthio group, an alkyl- or arylsulfonyl group, an alkyl- or arylsulfinyl group, a sulfo group or a salt thereof, a sulfamoyl group, an acylsulfamoyl group, a sulfonylsulfamoyl group or a salt thereof, a phosphoryl group, a group containing phosphoric acid amide or phosphate, a silyl group, and a stannyl group.

These substituents may further be substituted with these substituents.

The electron attractive group represented by Z in formula (III) means a substituent which can take a Hammett's substituent constant op value of a positive value. Specific examples of such groups include a cyano group, an alkoxycarbonyl group, aryloxycarbonyl group, a carbamoyl group, an imino group, an N-substituted imino group, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxyl group (or a salt thereof), a sulfo group (or a salt thereof), a heterocyclic group, an alkenyl group, an alkynyl group, an acyloxy group, an acylthio group, a sulfonyloxy group, and an aryl group substituted with such an electron attractive group. The heterocyclic group herein is a saturated or unsaturated heterocyclic group, e.g., a pyridyl group, a quinolyl group, a pyrazinyl group, a quinoxalinyl group, a benzotriazolyl group, an imidazolyl group, a benzimidazolyl group, a hydantoin-1-yl group, a succinimido group, and a phthalimido group can be exemplified as examples thereof.

The electron attractive group represented by Z in formula (III) may further have a substituent. As examples of such substituents, the same substituents as described above as the substituents of $R_{11}$, $R_{12}$ and $R_{13}$ in formula (III) when they each represents a substituent can be exemplified.

In formula (III), $R_{11}$ and Z, $R_{12}$ and $R_{13}$, $R_{11}$ and $R_{12}$, or $R_{13}$ and Z may be bonded to each other to form a cyclic structure. The cyclic structure formed at this time is a non-aromatic carbocyclic or non-aromatic heterocyclic ring.

The preferred range of the compounds represented by formula (III) is described below.

Specific examples of the silyl groups represented by Z in formula (III) include a trimethylsilyl group, a t-butyldimethylsilyl group, a phenyldimethylsilyl group, a triethylsilyl group, a triisopropylsilyl group, and a trimethylsilyldimethylsilyl group.

Preferred electron attractive groups represented by Z in formula (III) are groups having total carbon atoms of from 0 to 30, e.g., a cyano group, an alkoxycarbonyl group, an aryloxycarbonyl group, a carbamoyl group, a thiocarbonyl group, an imino group, an N-substituted imino group, a sulfamoyl group, an alkylsulfonyl group, an arylsulfonyl group, a nitro group, a perfluoroalkyl group, an acyl group, a formyl group, a phosphoryl group, an acyloxy group, an acylthio group, and a phenyl group substituted with an arbitrary electron attractive group. More preferred groups are a cyano group, an alkoxycarbonyl group, a carbamoyl group, an imino group, a sulfamoyl group, an alkylsulfonyl group, an arylsulfonyl group, an acyl group, a formyl group, a phosphoryl group, a trifluoromethyl group, and a phenyl group substituted with an arbitrary electron attractive group. Particularly preferred groups are a cyano group, a formyl group, an acyl group, an alkoxycarbonyl group, an imino group, and a carbamoyl group.

In formula (III), Z more preferably represents an electron attractive group.

Preferred substituents represented by $R_{11}$, $R_{12}$ and $R_{13}$ in formula (III) are groups having total carbon atoms of from 0 to 30, and specific examples include the groups having the same meaning as the foregoing electron attractive groups represented by Z in formula (III), an alkyl group, a hydroxyl group (or a salt thereof), a mercapto group (or a salt thereof), an alkoxyl group, an aryloxy group, a heterocyclic oxy group, an alkylthio group, an arylthio group, a heterocyclic thio group, an amino group, an alkylamino group, an arylamino group, a heterocyclic amino group, a ureido group, an acylamino group, a sulfonamido group, and a substituted or unsubstituted aryl group.

In formula (III), $R_{11}$ preferably represents an electron attractive group, an aryl group, an alkylthio group, an alkoxyl group, an acylamino group, a hydrogen atom, or a silyl group.

When $R_{11}$ represents an electron attractive group, preferred groups are those having total carbon atoms of from 0 to 30, e.g., a cyano group, a nitro group, an acyl group, a formyl group, an alkoxycarbonyl group, an aryloxycarbonyl group, a thiocarbonyl group, an imino group, an N-substituted imino group, an alkylsulfonyl group, an arylsulfonyl group, a carbamoyl group, a sulfamoyl group, a trifluoromethyl group, a phosphoryl group, a carboxyl group (or a salt thereof), or a saturated or unsaturated heterocyclic group. More preferred groups include a cyano group, an acyl group, a formyl group, an alkoxycarbonyl group, a carbamoyl group, an imino group, an N-substituted imino group, a sulfamoyl group, a carboxyl group (or a salt thereof), and a saturated or unsaturated heterocyclic group. Particularly preferred groups include a cyano group, a formyl group, an acyl group, an alkoxycarbonyl group, a carbamoyl group, and a saturated or unsaturated heterocyclic group.

When $R_{11}$ represents an aryl group, preferred aryl groups are substituted or unsubstituted phenyl groups having total carbon atoms of from 6 to 30, and arbitrary substituents can be selected but electron attractive substituents are preferred.

In formula (III), $R_{11}$ more preferably represents an electron attractive group or an aryl group.

Specific examples of preferred substituents represented by $R_{12}$ and $R_{13}$ in formula (III) include the groups having the same meaning as the foregoing electron attractive groups represented by Z in formula (III), an alkyl group, a hydroxyl group (or a salt thereof), a mercapto group (or a salt thereof), an alkoxyl group, an aryloxy group, a heterocyclic oxy group, an alkylthio group, an arylthio group, a heterocyclic thio group, an amino group, an alkylamino group, an anilino group, a heterocyclic amino group, an acylamino group, and a substituted or unsubstituted phenyl group.

In formula (III), more preferably either of $R_{12}$ and $R_{13}$ represents a hydrogen atom and the other represents a substituent. Preferred examples of the substituents include an alkyl group, a hydroxyl group (or a salt thereof), a mercapto group (or a salt thereof), an alkoxyl group, an aryloxy group, a heterocyclic oxy group, an alkylthio group, an arylthio group, a heterocyclic thio group, an amino group, an alkylamino group, an anilino group, a heterocyclic amino group, an acylamino group (in particular, a perfluoroalkanamido group), a sulfonamido group, a substituted or unsubstituted phenyl group, and a heterocyclic group. More preferred examples of substituents include a hydroxyl group (or a salt thereof), a mercapto group (or a salt thereof), an alkoxyl group, an aryloxy group, a heterocyclic oxy group, an alkylthio group, an arylthio group, a heterocyclic thio group, and a heterocyclic group. Particularly preferred groups include a hydroxyl group (or a salt thereof), an alkoxyl group, and a heterocyclic group.

It is also preferred that Z and $R_{11}$, or $R_{12}$ and $R_{13}$ in formula (III) are bonded to each other to form a cyclic structure. The cyclic structure formed in this case is preferably a 5- to 7-membered non-aromatic carbocyclic or heterocyclic ring, and the total carbon atoms including the carbon atoms of the substituents are preferably from 1 to 40, more preferably from 3 to 30.

A more preferred compound represented by formula (III) is a compound in which Z represents a cyano group, a formyl group, an acyl group, an alkoxycarbonyl group, an imino group, or a carbamoyl group, $R_{11}$ represents an electron attractive group or an aryl group, and either of $R_{12}$ and $R_{13}$ represents a hydrogen atom and the other represents a hydroxyl group (or a salt thereof), a mercapto group (or a salt thereof), an alkoxyl group, an aryloxy group, a heterocyclic oxy group, an alkylthio group, an arylthio group, a heterocyclic thio group, or a heterocyclic group.

A particularly preferred compound represented by formula (III) is a compound in which Z and $R_{11}$ are bonded to each other to form a non-aromatic 5- to 7-membered ring, and either of $R_{12}$ and $R_{13}$ represents a hydrogen atom and the other represents a hydroxyl group (or a salt thereof), a mercapto group (or a salt thereof), an alkoxyl group, an aryloxy group, a heterocyclic oxy group, an alkylthio group, an arylthio group, a heterocyclic thio group, or a heterocyclic group. At this time, Z, which forms a non-aromatic ring together with $R_{11}$, preferably represents an acyl group, a carbamoyl group, an oxycarbonyl group, a thiocarbonyl group, or a sulfonyl group, and $R_{11}$ preferably represents an acyl group, a carbamoyl group, an oxycarbonyl group, a thiocarbonyl group, a sulfonyl group, an imino group, an N-substituted imino group, an acylamino group, or a carbonylthio group.

The compounds represented by formula (IV) are described in detail below.

In formula (IV), as the substituents represented by $R_{141}$ the same substituents as described in $R_{11}$, $R_{12}$ and $R_{13}$ in formula (III) can be exemplified.

In formula (IV), the substituent represented by $R_{14}$ is preferably an electron attractive group or an aryl group. When $R_{14}$ represents an electron attractive group, preferred groups are those having total carbon atoms of from 0 to 30, e.g., a cyano group, a nitro group, an acyl group, a formyl group, an alkoxycarbonyl group, an aryloxycarbonyl group, an alkylsulfonyl group, an arylsulfonyl group, a carbamoyl group, a sulfamoyl group, a trifluoromethyl group, a phosphoryl group, an imino group, or a saturated or unsaturated heterocyclic group. More preferred group is a cyano group, an acyl group, a formyl group, an alkoxycarbonyl group, a carbamoyl group, a sulfamoyl group, an alkylsulfonyl group, an arylsulfonyl group, or a heterocyclic group. Particularly preferred group is a cyano group, a formyl group, an acyl group, an alkoxycarbonyl group, a carbamoyl group, or a heterocyclic group.

When $R_{14}$ represents an aryl group, preferred aryl groups are substituted or unsubstituted phenyl groups having total carbon atoms of from 6 to 30, and those described above as the substituents of $R_{11}$, $R_{12}$ and $R_{13}$ in formula (III) when they each represents a substituent can be exemplified as substituents thereof.

In formula (IV), $R_{14}$ particularly preferably represents a cyano group, an alkoxycarbonyl group, a carbamoyl group, a heterocyclic group, or a substituted or unsubstituted phenyl group, and most preferably represents a cyano group, a heterocyclic group, or an alkoxycarbonyl group.

The compounds represented by formula (V) are described in detail below.

In formula (V), X and Y each represents a hydrogen atom or a substituent; and A and B each represents an alkoxyl group, an alkylthio group, an alkylamino group, an aryloxy group, an arylthio group, an anilino group, a heterocyclic thio group, a heterocyclic oxy group, or a heterocyclic amino group. In formula (V), X and Y, or A and B may be bonded to each other to form a cyclic structure.

In formula (V), as substituents represented by X and Y, the same substituents as the substituents represented by $R_{11}$, $R_{12}$ and $R_{13}$ in formula (III) described above can be exemplified. Specifically, an alkyl group (including a perfluoroalkyl group, a trichloromethyl group), an aryl group, a heterocyclic group, a halogen atom, a cyano group, a nitro group, an alkenyl group, an alkynyl group, an acyl group, a formyl group, an alkoxycarbonyl group, an aryloxycarbonyl group, an imino group, an N-substituted imino group, a carbamoyl group, a thiocarbonyl group, an acyloxy group, an acylthio group, an acylamino group, an alkylsulfonyl group, an arylsulfonyl group, a sulfamoyl group, a phosphoryl group, a carboxyl group (or a salt thereof), a sulfo group (or a salt thereof), a hydroxyl group (or a salt thereof), a mercapto group (or a salt thereof), an alkoxyl group, an aryloxy group, a heterocyclic oxy group, an alkylthio group, an arylthio group, a heterocyclic thio group, an amino group, an alkylamino group, an anilino group, a heterocyclic amino group, and a silyl group can be exemplified.

These groups may further be substituted. X and Y may be bonded to each other to form a cyclic structure. The cyclic structure formed at this time may be a non-aromatic carbocyclic or non-aromatic heterocyclic ring.

Preferred substituents represented by x and Y in formula (V) are groups having total carbon atoms of from 0 to 40, more preferably from 1 to 30, e.g., a cyano group, an alkoxycarbonyl group, an aryloxycarbonyl group, a carbamoyl group, an imino group, an N-substituted imino group, a thiocarbonyl group, a sulfamoyl group, an alkylsulfonyl group, an arylsulfonyl group, a nitro group, a perfluoroalkyl group, an acyl group, a formyl group, a phosphoryl group, an acylamino group, an acyloxy group, an acylthio group, a heterocyclic group, an alkylthio group, an alkoxyl group, and an aryl group can be exemplified.

In formula (V), X and Y each more preferably represents a cyano group, a nitro group, an alkoxycarbonyl group, a carbamoyl group, an acyl group, a formyl group, an acylthio group, an acylamino group, a thiocarbonyl group, a sulfamoyl group, an alkylsulfonyl group, an arylsulfonyl group, an imino group, an N-substituted imino group, a phosphoryl group, a trifluoromethyl group, a heterocyclic group, or a substituted phenyl group, and particularly preferably represents a cyano group, an alkoxycarbonyl group, a carbamoyl group, an alkylsulfonyl group, an arylsulfonyl group, an acyl group, an acylthio group, an acylamino group, a thiocarbonyl group, a formyl group, an imino group, an N-substituted imino group, a heterocyclic group, or a phenyl group substituted with an arbitrary electron attractive group.

It is also preferred that X and Y are bonded to each other to form a non-aromatic carbocyclic or non-aromatic heterocyclic ring. The cyclic structure formed in this case is preferably a 5- to 7-membered ring, and the total carbon atoms are preferably from 1 to 40, more preferably from 3 to 30. X and Y which form a cyclic structure are preferably an acyl group, a carbamoyl group, an oxycarbonyl group, a thiocarbonyl group, a sulfonyl group, an imino group, an N-substituted imino group, an acylamino group or a carbonylthio group.

In formula (V), A and B each represents an alkoxyl group, an alkylthio group, an alkylamino group, an aryloxy group, an arylthio group, an anilino group, a heterocyclic thio group, a heterocyclic oxy group, or a heterocyclic amino group. A and B may be bonded to each other to form a cyclic structure.

In formula (V), the groups represented by A and B preferably have total carbon atoms of from 1 to 40, more preferably from 1 to 30, and these groups may further have a substituent.

In formula (V), A and B are more preferably bonded to each other to form a cyclic structure (that is, form a 5- to 7-membered non-aromatic heterocyclic ring), and the total carbon atoms are preferably from 1 to 40, more preferably from 3 to 30. Examples in which A and B are bonded (—A—B—) are, e.g., —O—$(CH_2)_2$—O—, —O—$(CH_2)_3$—O—, —S—$(CH_2)_2$—S—, —S—$(CH_2)_3$—S—, —S—ph—S—, —N$(CH_3)$—$(CH_2)_2$—O—, —N$(CH_3)$—$(CH_2)_2$—S—, —O—$(CH_2)_2$—S—, —O—$(CH_2)_3$—S—, —N$(CH_3)$—ph—O—, —N$(CH_3)$—ph—S—, —N(ph)—$(CH_2)_2$—S—, etc.

The compound represented by formula (III), (IV) or (V) for use in the present invention may contain an adsorptive group to silver halide. As such an adsorptive group, an alkylthio group, an arylthio group, a thiourea group, a thioamido group, a mercapto heterocyclic group, and a triazole group can be exemplified. These groups, are disclosed in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. These adsorptive groups to silver halide may be in the form of precursors. As such precursors, those disclosed in JP-A-2-285344 can be exemplified.

The compound represented by formula (III), (IV) or (V) for use in the present invention may include ballast groups or polymers which are normally used in immobile photographic additives such as couplers. In particular, compounds in which a ballast group is incorporated are preferably used in the present invention. Such a ballast group has 8 or more carbon atoms and is a group which is photographically comparatively inactive and can be selected from, e.g., an alkyl group, an aralkyl group, an alkoxyl group, a phenyl group, an alkylphenyl group, a phenoxy group or an alkylphenoxy group. Further, those disclosed, for example, in JP-A-1-100530 can be exemplified as such a polymer.

The compound represented by formula (III), (IV) or (V) for use in the present invention may contain a cationic group (specifically, a group containing a quaternary ammonium group, a quaternized nitrogen-containing heterocyclic group), a group containing an ethyleneoxy group or a propyleneoxy group as a repeating unit, an alkyl-, aryl-, or heterocyclic thio group, or a dissociative group capable of dissociation by the function of a base (e.g., a carboxyl group, a sulfo group, an acylsulfamoyl group, a carbamoylsulfamoyl group, etc.). In particular, a group in which a group containing an ethyleneoxy group or a propyleneoxy group as a repeating unit is contained, or an alkyl-, aryl-, or heterocyclic thio group is contained is a preferred embodiment of the present invention. As specific examples thereof, compounds disclosed in JP-A-7-234471, JP-A-5-333466, JP-A-6-19032, JP-A-6-19031, JP-A-5-45761, U.S. Pat. Nos. 4,994,365, 4,988,604, JP-A-3-259240, JP-A-7-5610, JP-A-7-244348, and German Patent 4,006,032 can be exemplified.

Specific examples of the compounds represented by formula (III), (IV) or (V) are shown below, but the present invention is not limited thereto. In addition to these, Nucleating Agent 2 used in the examples of the present invention can also be exemplified.

C-1

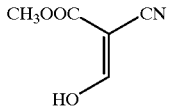

C-2

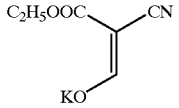

C-3

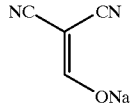

C-4

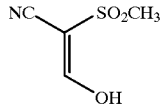

C-5

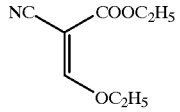

C-6

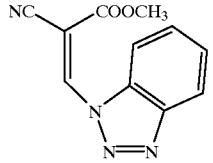

C-7

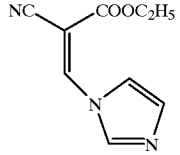

-continued
C-8
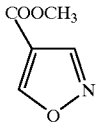
C-9
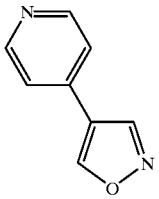
C-10
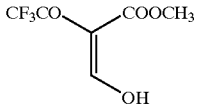
C-11
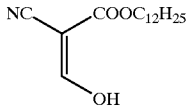
C-12
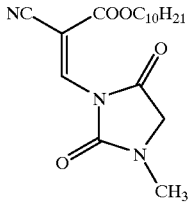
C-13
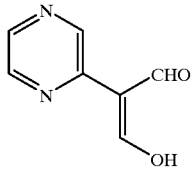
C-14
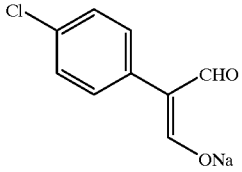
C-15
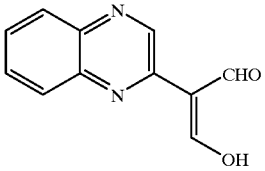
C-16
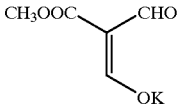

-continued
C-17
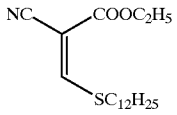
C-18
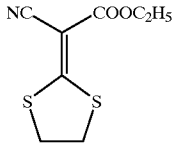
C-19
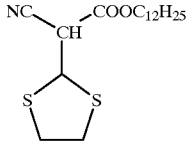
C-20
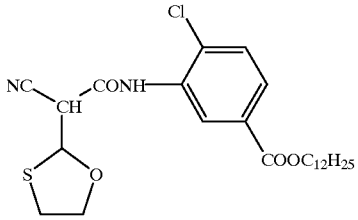
C-21
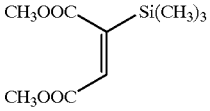
C-22
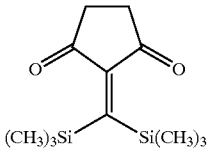
C-23
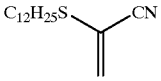
C-24
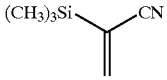
C-25
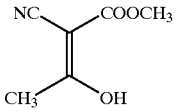
C-26
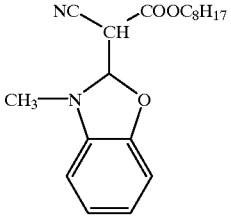

-continued
C-27
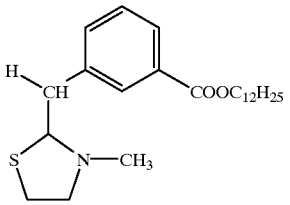
C-28
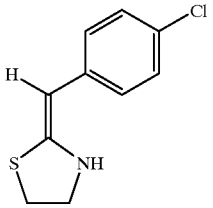
C-29
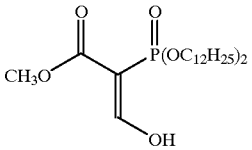
C-30
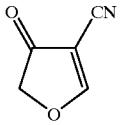
C-31
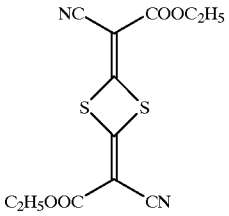
C-32
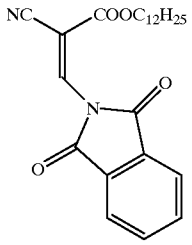
C-33
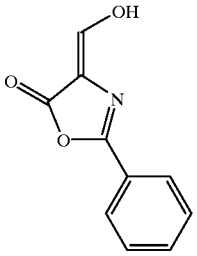

-continued
C-34
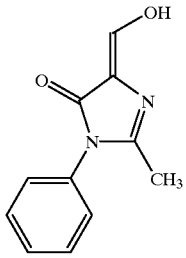
C-35
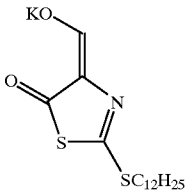
C-36
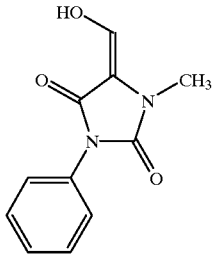
C-37
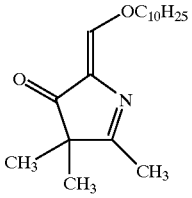
C-38
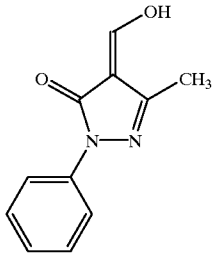
C-39
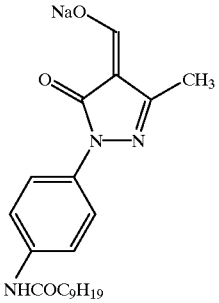

-continued
C-40
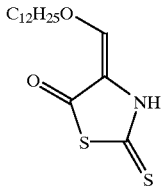
C-41
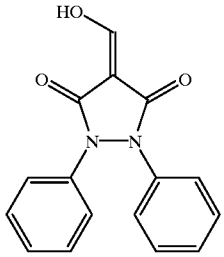
C-42
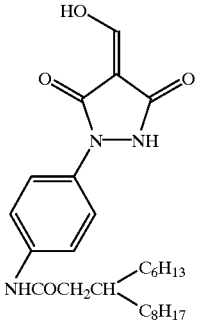
C-43
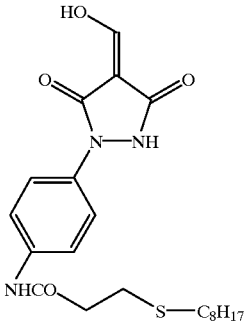
C-44
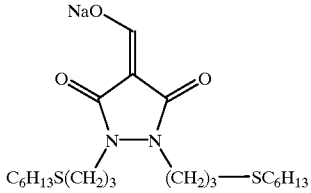
C-45
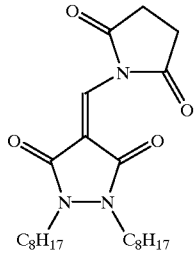

-continued
C-46
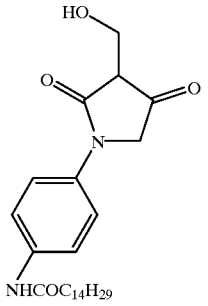
C-47
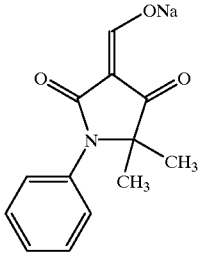
C-48
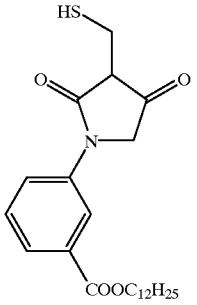
C-49
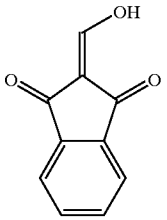
C-50
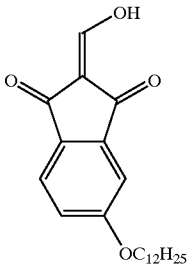

-continued
C-51
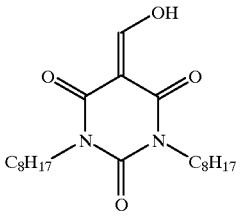
C-52
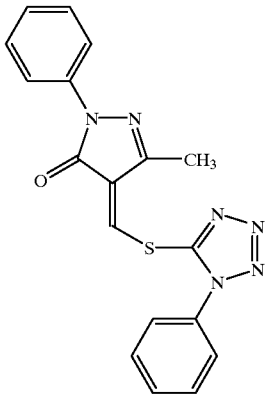
C-53
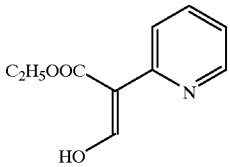
C-54
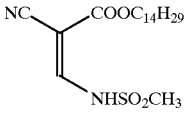
C-55
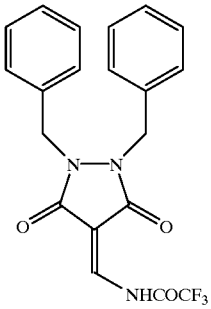
C-56
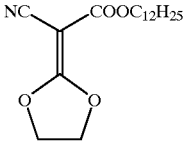

-continued

C-57

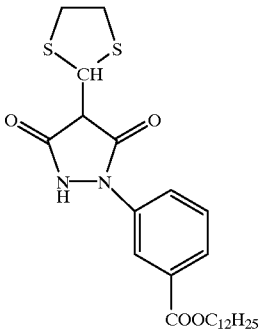

C-57

C-58

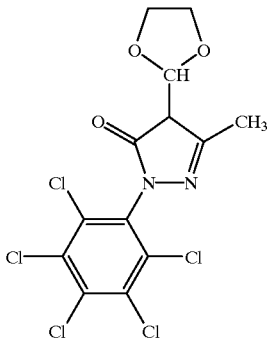

C-59

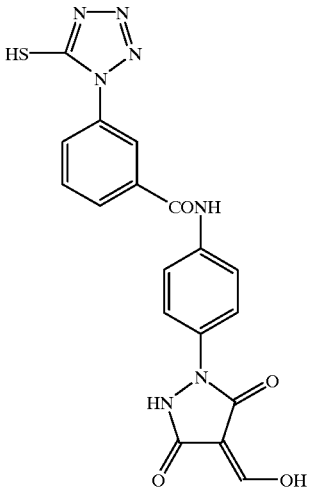

C-60

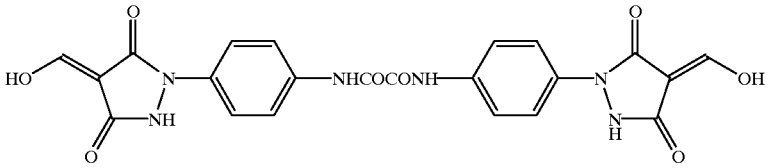

The compounds represented by formula (III), (IV) or (V) can easily be synthesized according to well-known methods by referring to the methods disclosed, e.g., in U.S. Pat. Nos. 5,545,515, 5,635,339, 5,654,130, WO 97/34196, Japanese Patent Application Nos. 9-354107, 9-309813, and 9-272002.

The compounds represented by formula (III), (IV) or (V) can be used alone or in combination of two or more. Further, the compounds represented by formula (III), (IV) or (V) can be used in combination with the compounds disclosed in, e.g., U.S. Pat. Nos. 5,545,515, 5,635,339, 5,654,130 WO 97/34196, U.S. Pat. No. 5,686,228, JP-A-11-119372, JP-A-11-119373, JP-A-11-109546, JP-A-11-95365, JP-A-11-95366, and Japanese Patent Application Nos. 9-354107, 9-309813, and 9-332388.

Hydrazine derivatives may be used as a nucleating agent in the present invention, e.g., hydrazine derivatives disclosed in JP-A-10-339932 and JP-A-10-161270 can be used. In addition, the following hydrazine derivatives can also be used, i.e., the compounds disclosed on pp. 3 and 4 in JP-B-6-77138; the compound represented by formula (I), specifically Compounds 1 to 38, pp. 8 to 18, JP-B-6-93082; the compounds represented by formulae (4), (5) and (6), specifically Compounds 4-1 to 4-10, pp. 25 and 26, Compounds 5-1 to 5-42, pp. 28 to 36, Compounds 6-1 to 6-7, pp. 39 and 40, JP-A-6-230497; the compounds represented by formulae (1) and (2), specifically Compounds 1-1) to 1-17) and 2-1), pp. 5 to 7, JP-A-6-289520; the compounds disclosed on pp. 6 to 19 in JP-A-6-313936; the compounds disclosed on pp. 3 to 5 in JP-A-6-313951; the compound represented by formula (I), specifically Compounds I-1 to I-38, pp. 5 to 10, JP-A-7-5610; the compound represented by formula (II), specifically Compounds II-1 to II-102, pp. 10 to 27, JP-A-7-77783; the compounds represented by formula (H) and (Ha), specifically Compounds H-1 to H-44, pp. 8 to 15, JP-A-7-104426; the compounds represented by formulae (A), (B), (C), (D), (E) and (F) in EP-A-713131, these are compounds having, in the vicinity of the hydrazine group, an anionic group, or a nonionic group which forms an intramolecular hydrogen bond with the hydrogen atom of the hydrazine, specifically Compounds N-1 to N-30; and the compound represented by formula (1), specifically Compounds D-1 to D-55, EP-A-713131.

Various hydrazine derivatives described in *Known Techniques* (1 to 207), pp. 25 to 34, published by Aztec Co., Ltd. (Mar. 22, 1991), and Compounds D-2 and D-39 disclosed on pp. 6 and 7 in JP-A-62-86354 can be used as well.

The nucleating agent of the present invention can be used in the form of a solution in water or an appropriate organic solvent, such as alcohols (e.g., methanol, ethanol, propanol, fluorinated alcohol), ketones (e.g., acetone, methyl ethyl ketone), dimethylformamide, dimethylsulfoxide, and methyl cellosolve.

Further, the nucleating agent for use in the present invention can also be used in the form of an emulsion dispersion mechanically prepared according to well known emulsifying dispersion methods by dissolving using oils such as dibutyl phthalate, tricresyl phosphate, glyceryl triacetate and diethyl phthalate, or auxiliary solvents such as ethyl acetate and cyclohexanone, or they can be used in the form of a dispersion prepared according to a solid dispersion method in which powders of nucleating agent are dispersed in water using a ball mill, a colloid mill or ultrasonic wave.

The nucleating agent for use in the present invention may be added to any of an image-forming layer or other layers on the image-forming layer side of the support, but is preferably added to an image-forming layer or adjacent layers thereto.

The nucleating agent is preferably added in an amount of from $1\times10^{-6}$ to 1 mol, more preferably from $1\times10^{-5}$ to $5\times10^{-1}$, and most preferably from $2\times10^{-5}$ to $2\times10^{-1}$, per mol of the silver.

The compound represented by formula (III), (IV) or (V) can be used in combination with hydrazine derivatives.

For forming a high contrast image, nucleating accelerators can be used in the present invention in combination with the above-described nucleating agents. For example, amine compounds disclosed in U.S. Pat. No. 5,545,505, specifically Compounds AM-1 to AM-5; hydroxamic acids disclosed in U.S. Pat. No. 5,545,507, specifically Compounds HA-1 to HA-11; acrylonitriles disclosed in U.S. Pat. No. 5,545,507, specifically Compounds CN-1 to CN-13; hydrazine compounds disclosed in U.S. Pat. No. 5,558,983, specifically Compounds CA-1 to CA-6; and onium salts disclosed in JP-A-9-297368, specifically Compounds A-1 to A-42, B-1 to B-27, and C-1 to C-14 can be used.

Synthesizing methods, addition methods, and addition amounts of each of the foregoing nucleating agents and nucleating accelerators are described in the above-cited respective patents.

Organic silver salts can be used as a reducible silver salt in the present invention. Organic silver salts are comparatively stable against light and capable of forming a silver image when heated at 80° C. or more in the presence of an exposed photocatalyst (a latent image of photosensitive silver halide and the like) and a reducing agent. Organic silver salts may be arbitrary organic materials containing the source which can reduce silver ions. Silver salts of organic acids, in particular, silver salts of long chain aliphatic carboxylic acids having from 10 to 30, preferably from 15 to 28, of carbon atoms are preferably used in the present invention. Complexes of organic or inorganic silver salts having ligands of complex stability constant of from 4.0 to 10.0 are also preferred. A silver-supplying material can account for preferably about 5 to 70 wt % of an image-forming layer. Preferred organic silver salts contain silver salts of organic compounds having a carboxyl group. These examples contain silver salts of aliphatic carboxylic acids and silver salts of aromatic carboxylic acids but organic silver salts are not limited thereto. Preferred examples of silver salts of aliphatic carboxylic acids include silver behenate, silver arachidate, silver stearate, silver oleate, silver laurate, silver caproate, silver myristate, silver palmitate, silver maleate, silver fumarate, silver tartrate, silver linoleate, silver butyrate, silver camphorate, and mixtures of these.

Organic acid silver preferably used in the present invention can be produced by reacting the solution or the suspension of the above-described alkali metal salts (e.g., Na salt, K salt, Li salt) of organic acids with silver nitrate. Organic acid alkali metal salts according to the present invention can be obtained by the alkali treatment of the above organic acids. organic acid silver of the present invention can be produced in an appropriate reaction vessel in a batch system or continuous system. Stirring in a reaction vessel can be arbitrarily selected according to the characteristics required of particles. Any of the following methods can be preferably used in the present invention for producing organic acid silver, e.g., a method of gradually or hastily adding a silver nitrate aqueous solution to a reaction vessel containing a solution or a suspension of organic acid alkali metal salt, a method of gradually or hastily adding a previously prepared solution or suspension of organic acid alkali metal salt to a reaction vessel containing a silver nitrate aqueous solution, and a method of simultaneously adding a previously prepared silver nitrate aqueous solution and solution or suspension of organic acid alkali metal salt to a reaction vessel.

A silver nitrate aqueous solution and a solution or a suspension of organic acid alkali metal salt can be used respectively in arbitrary concentrations for adjusting the particle size of the organic acid silver to be prepared, and they can be added at an arbitrary addition rate. A silver nitrate aqueous solution and a solution or a suspension of organic acid alkali metal salt can be added at a constant addition rate or can be added at an accelerated or decelerated addition rate according to an arbitrary time function. They may be added to the liquid level or in the liquid of the reaction solution. When a previously prepared silver nitrate aqueous solution and solution or suspension of organic acid alkali metal salt are simultaneously added to a reaction vessel, either can precede but the addition of a silver nitrate aqueous solution preferably precedes. The precedence degree is preferably from 0 to 50 vol %, and particularly preferably from 0 to 25 vol %, of the total addition amount. The method of addition with controlling the pH or the silver potential of the reaction solution during reaction as disclosed in JP-A-9-127643 is also preferably used.

pH values of a silver nitrate aqueous solution and a solution or a suspension of organic acid alkali metal salt to be added can be adjusted according to characteristics required of the particles. Arbitrary acids or alkalis can be added for adjusting pH. Further, according to characteristics required of the particles, the temperature in the reaction vessel can be selected optionally, for example, for controlling the particle size of the organic acid silver to be produced. The temperatures of a silver nitrate aqueous solution and a solution or a suspension of organic acid alkali metal salt to be added can also be adjusted arbitrarily. For ensuring the flowability, the temperature of a solution or a suspension of organic acid alkali metal salt is preferably maintained at 50° C. or higher.

It is preferred to produce the organic acid silver for use in the present invention in the presence of tertiary alcohols. The tertiary alcohols for use in the present invention preferably have total carbon atoms of 15 or less, more preferably 10 or less. As a preferred tertiary alcohol, tert-butanol can be exemplified but the present invention is not limited thereto.

Tertiary alcohols for use in the present invention can be added at any stage of the production of organic acid silver but are preferably added during preparation of organic acid alkali metal salt to dissolve the organic acid alkali metal salt before use. The use amount of tertiary alcohols for use in the present invention is from 0.01 to 10, preferably from 0.03 to 1, by weight ratio based on $H_2O$ as a solvent in the production of the organic acid silver.

Silver salts and derivatives of compounds containing a mercapto group or a thione group can be used in the present invention. Preferred examples of these compounds include silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido) benzothiazole, silver salt of thioglycolic acid such as S-alkylthioglycolic acid (carbon atoms of the alkyl group are from 12 to 22), silver salt of dithiocarboxylic acid such as dithioacetic acid, silver salt of thioamide, silver salt of 5-carboxyl-1-methyl-2-phenyl-4-thiopyridine, silver salt of mercaptotriazine, silver salt of 2-mercaptobenzoxazole, silver salts disclosed in U.S. Pat. No. 4,123,274, e.g., silver salt of 1,2,4-mercaptothiazole derivatives such as silver salt of 3-amino-5-benzylthio-1,2,4-thiazole, and silver salts disclosed in U.S. Pat. No. 3,301,678, e.g., silver salt of thione compounds such as silver salt of 3-(3-carboxyethyl)-4-methyl-4-thiazoline-2-thione. Compounds containing an imino group can also be used. Preferred examples of these compounds include silver salt of benzotriazole and derivatives thereof, e.g., silver salt of benzotriazole such as silver methylbenzotriazole, silver salt of halogen-substituted benzotriazole such as silver 5-chlorobenzotriazole, silver salt of 1,2,4-triazole or 1-H-tetrazole as disclosed in U.S. Pat. No. 4,220,709, silver salt of imidazole and imidazole derivatives. Various silver acetylides as disclosed in U.S. Pat. Nos. 4,761,361 and 4,775,613 can also be used.

The shape of the organic silver salt for use in the present invention is not particularly restricted but scale shape crystals or needle shape crystals having a short axis and a long axis are preferably used. In the present invention, a short axis is from 0.01 to 0.20 μm, preferably from 0.01 to 0.15 μm, and a long axis is from 0.10 to 5.0 μm, preferably from 0.10 to 4.0 μm. The particle size distribution of organic silver salt is preferably monodispersion. Monodispersion means that the values in terms of percentage obtained by dividing the standard deviations of the respective lengths of short axis and long axis by the respective lengths of short axis and long axis respectively are preferably 100% or less, more preferably 80% or less, and most preferably 50% or less. The shape of organic silver salt can be obtained from the transmission electron microscopic image of an organic silver salt dispersion. As another method of measuring monodispersing property, a method of obtaining the standard deviation of the volume weighted average diameter of organic silver salt can be used. The value obtained in terms of percentage (variation coefficient) by dividing the standard deviation of the volume weighted average diameter by the volume weighted average diameter is preferably 100% or less, more preferably 80% or less, and most preferably 50% or less. The volume weighted average diameter can be obtained from the particle size (volume weighted average diameter) obtained by irradiating the organic silver salt dispersed in a solution with laser beams, and finding the autocorrelation function to the time variation of fluctuation of light scattering. organic silver salts which can be used in the present invention can be preferably desalted. Methods of desalting are not particularly limited and any known method can be used. For example, well-known methods such as centrifugal filtration, suction filtration, ultrafiltration, and washing of floc formed by agglomeration can be preferably used.

In the present invention, it is preferred to employ a dispersing method in which the flow rate of a water dispersion solution, which contains an organic silver salt which is an image-forming medium and does not substantially contain a photosensitive silver salt, is converted to a high flow rate and then the pressure is lowered, to thereby obtain a solid dispersion of organic silver salt having a high S/N ratio, a small particle size and without agglomeration.

After having been subjected to these steps, the organic silver salt solid dispersion is mixed with a photosensitive silver salt aqueous solution to prepare a coating solution of a photosensitive image-forming medium. The thus-prepared coating solution makes it possible to obtain a photothermographic image-forming material exhibiting low haze, low fog and high sensitivity. On the contrary, if a photosensitive silver salt is present with the organic silver salt when dispersion is performed by high pressure and high flow rate, fog increases and sensitivity is liable to be extremely lowered. If an organic solvent is used as a dispersion medium in place of water, haze is heightened, fog increases, and sensitivity is liable to be lowered. While when a conversion method comprising converting a part of an organic silver salt in a dispersion solution to a photosensitive silver salt is employed instead of the method of mixing a photosensitive silver salt aqueous solution, sensitivity is liable to be lowered.

In the above, a water dispersion solution which is dispersed by high pressure and high flow rate conversion does not substantially contain photosensitive silver salt and the content is 0.1 mol % or less based on the non-photosensitive organic silver salt, where the addition of a photosensitive silver salt is not performed positively.

Solid dispersing apparatuses and techniques for performing the foregoing dispersion are described in detail, for example, in Toshio Kajiuchi, Hiroshi Usui, *Rheology of Dispersion System and Techniques of Dispersion*, pp. 357 to 403, Shinoyama Publishing Co., Ltd. (1991), *Advancement of Chemical Engineering*, the 24th Series, pp. 184 and 185, compiled by the Tokai Branch of the Chemical Engineering Society, published by Maki Shoten Publishing Co., Ltd. (1990), etc. The dispersing method according to the present invention is a method in which a water dispersion solution containing at least an organic silver salt is fed to piping by high pressure using a high pressure pump and the like, passed through a fine slit in the piping, and then the pressure applied to the dispersion solution is suddenly reduced to thereby effect fine dispersion.

The reason why the dispersion to fine particles can be brought about by using a high pressure homogenizer is thought to be due to dispersion forces such as (a) "shear force" generated when a dispersoid passes through a narrow gap at high pressure and a high flow rate, and (b) "cavitation force" generated when the dispersoid is released from high pressure to atmospheric pressure. As a dispersing apparatus of this type, a Gaulin homogenizer has so far been used, wherein a dispersoid fed at high pressure is converted to high flow rate in a narrow gap on cylindrical plane, the dispersoid is impinged against the surrounding walls by that force, and emulsification and dispersion are effected by that shock waves. The applied pressure is in general within the range of from 100 to 600 kg/cm$^2$ and a flow rate is from several meters to 30 meters/second, and some means have been elaborated to heighten a dispersion efficiency, such as to provide sawtooth blades at high flow rate zone to increase the number of times of impinging. On the other hand, apparatuses which make it possible to realize dispersion at higher pressure and a higher flow rate have been developed. By way of representative examples, a micro-fluidizer (manufactured by Micro Fluidex International Corp.) and a nanomizer (manufactured by Tokushuki Kakogyo Co., Ltd.) are exemplified.

As dispersing apparatuses suited for the present invention, micro-fluidizers M-110S-EH (equipped with G10Z interaction chamber), M-110Y (equipped with H10Z interaction chamber), M-140K (equipped with G10Z interaction chamber), HC-5000 (equipped with L30Z or H230Z interaction chamber), HC-8000 (E230Z or L30Z interaction chamber) (manufactured by Micro Fluidex International Corp.) can be exemplified.

By using these apparatuses, it is possible to obtain an organic silver salt dispersion most suited to the present invention by feeding a water dispersion solution containing at least an organic silver salt to piping by applying high pressure using a high pressure pump and the like, applying high pressure to the solution by passing it through a fine slit in the piping, and then suddenly reducing the pressure applied to the dispersion solution to atmospheric pressure.

It is preferred to perform preliminary dispersion of a starting solution prior to dispersing operation. As preliminary dispersing means, known dispersing means, e.g., a high speed mixer, a homogenizer, a high speed impinging mill, a banbury mixer, a homomixer, a kneader, a ball mill, a vibrating ball mill, a planetary ball mill, an attritor, a sand mill, a beads mill, a colloid mill, a jet mill, a roller mill, a trommel and a high speed stone mill, can be used. In addition to mechanical dispersion, a starting material may be coarsely dispersed in a solvent by pH controlling, and then atomized by changing pH in the presence of an auxiliary dispersant. At this time, an organic solvent may be used for coarse dispersion and the organic solvent is in general removed after completion of the atomization.

In the present invention, it is possible to achieve the dispersion of the organic silver salt of the desired particle size by adjusting flow rate, differential pressure at the time of pressure reduction, and the number of times of processing. From the viewpoint of photographic characteristics and particle size, the flow rate is preferably from 200 to 600 m/second, more preferably from 300 to 600 m/second, and differential pressure at pressure reduction is preferably from 900 to 3,000 kg/cm$^2$, more preferably from 1,500 to 3,000 kg/cm$^2$. The number of times of dispersion processing can be selected according to necessity, in general, from 1 to 10 times, but in view of productivity, processing times are preferably from 1 to 3 or so. It is disadvantageous in light of dispersion properties and photographic characteristics to maintain the temperature of a water dispersion solution high, and when the temperature exceeds 90° C., the particle size is liable to increase and fog is also liable to increase. Accordingly, it is preferred in the present invention to include a cooling process in steps prior to conversion to high pressure/high flow rate, after pressure reduction, or in both steps. The temperature of the water dispersion is preferably maintained from 5 to 90° C. by cooling process, more preferably from 5 to 80° C., and particularly preferably from 5 to 65° C. In particular, it is effective to provide such a cooling process during high pressure dispersion of from 1,500 to 3,000 kg/cm$^2$. A cooler can be arbitrarily selected from, e.g., a double pipe, a double pipe using a static mixer, a shell and tube heat exchanger, and a coiled heat exchanger, according to the required heat exchange amount. For increasing heat exchange efficiency, it is necessary to select appropriate diameter, thickness and material of the pipe with taking the pressure used into consideration. As a cooling medium in a cooler, well water of 20° C., chilled water of from 5 to 10° C. treated with a refrigerator, or, if necessary, a cooling medium such as ethylene glycol/water of −30° C. can be used according to heat exchange amount.

In the present invention, it is preferred to disperse organic silver salts in the presence of a dispersant soluble in an aqueous solvent (an auxiliary dispersant). Preferred examples of auxiliary dispersants include synthetic anion polymers such as polyacrylic acid, acrylic acid copolymers, maleic acid copolymers, maleic acid monoester copolymers, and acrylomethylpropane sulfonic acid copolymers, semi-synthetic anion polymers such as carboxymethyl starch and carboxymethyl cellulose, anionic polymers such as alginic acid and pectic acid, compounds disclosed in JP-A-7-350753, well-known anionic, nonionic and cationic surfactants, other well-known polymers such as polyvinyl alcohol, polyvinyl pyrrolidone, carboxymethyl cellulose, hydroxypropyl cellulose, and hydroxypropylmethyl cellulose, and natural high molecular compounds such as gelatin, and these compounds can be appropriately selected. Polyvinyl alcohols and water-soluble cellulose derivatives are particularly preferably used.

An auxiliary dispersant is in general mixed with the powder of organic silver salt or organic silver salt in a wet cake-like state before dispersion and fed to a dispersing apparatus as a slurry. Alternatively, an auxiliary dispersant may be previously mixed with organic silver salt and subjected to heat treatment or treatment with a solvent and then made into a powder or a wet cake of organic silver salt. pH adjustment may be performed before, after or during dispersion with an appropriate pH adjustor.

In addition to mechanical dispersion, organic silver salt may be coarsely dispersed in a solvent by pH controlling, and then atomized by changing pH in the presence of an auxiliary dispersant. At this time, an organic solvent may be used for coarse dispersion and the organic solvent is in general removed after completion of the atomization.

The prepared dispersion can be preserved with stirring or in a highly viscous state with hydrophilic colloid (for example, in a jelly-like state using gelatin) for the purpose of preventing the precipitation of fine particles during preservation. Further, it is preferred to add preservatives for inhibiting the proliferation of various bacteria.

The particle size of the organic silver salt solid fine particle dispersion (volume weighted average diameter) according to the present invention can be obtained from the particle size (volume weighted average diameter) obtained by irradiating the solid fine particle dispersion dispersed in a solution with laser beams, and finding the autocorrelation function to the time variation of fluctuation of light scattering. A solid fine particle dispersion preferably has the average particle size of from 0.05 to 10.0 μm, more preferably from 0.1 to 5.0 μm, and most preferably from 0.1 to 2.0 μm.

The particle size distribution of organic silver salt is preferably monodispersion. Specifically, the value obtained in terms of percentage (variation coefficient) by dividing the standard deviation of the volume weighted average diameter by the volume weighted average diameter is preferably 80% or less, more preferably 50% or less, and most preferably 30% or less.

The shape of organic silver salt can be obtained from the transmission electron microscopic image of an organic silver salt dispersion.

The organic silver salt solid fine particle dispersion for use in the present invention comprises at least an organic silver salt and water. The ratio of an organic silver salt and water is not particularly limited, but preferably an organic silver salt accounts for from 5 to 50 wt %, particularly preferably from 10 to 30 wt %, of the total composition. The foregoing auxiliary dispersant is preferably used but the use amount is preferably the possible minimum amount within the range capable of obtaining the smallest particle size. The amount is preferably from 1 to 30 wt %, particularly preferably from 3 to 15 wt %, based on the organic silver salt.

An image-forming material can be prepared by mixing a water dispersion solution of an organic silver salt and a water dispersion solution of a photosensitive silver salt according to the present invention. The mixing ratio of an organic silver salt and a photosensitive silver salt can be selected according to purposes, but the ratio of a photosensitive silver salt to an organic silver salt is preferably from 1 to 30 mol %, more preferably from 3 to 20 mol %, and particularly preferably from 5 to 15 mol %. Mixture of two or more kinds of water dispersion solutions of organic silver salts and two or more kinds of water dispersion solutions of photosensitive silver salts is preferably used for adjusting photographic characteristics.

The organic silver salt according to the present invention can be used in a desired amount but is preferably from 0.1 to 5 $g/m^2$, more preferably from 1 to 3 $g/m^2$, as silver amount, in terms of a coating amount per $m^2$ of the image-forming material.

The halogen composition of the photosensitive silver halide for use in the present invention is not limited in particular. Silver chloride, silver chlorobromide, silver bromide, silver iodobromide, and silver iodochlorobromide can be used in the present invention. The distribution of the halogen composition in the grain may be uniform, the halogen composition may be changed stepwise or may be continuously changed. Silver halide grains having a core/shell structure can be preferably used. Grain structures are preferably from a double structure to a quintuple structure. Core/shell grains having a double structure to a quadruple structure can be more preferably used. Techniques of localizing silver bromide on the surface of silver chloride or silver chlorobromide grains can preferably be used.

The photosensitive silver halide for use in the present invention can be produced using the methods well-known in this industry, for example, the methods disclosed in *Research Disclosure*, No. 17029 (June, 1978) and U.S. Pat. No. 3,700,458 can be used. Specifically, photosensitive silver halide is produced by adding a silver-supplying compound and a halogen-supplying compound to gelatin or other polymer solution, then mixing with an organic silver salt. The grain size of photosensitive silver halide is preferably small for the purpose of suppressing the white turbidity after image formation to low degree, specifically preferably 0.20 μm or less, more preferably from 0.01 to 0.15 μm, and still more preferably from 0.02 to 0.12 μm. The grain size in the present invention means the edge length when silver halide grains have a so-called regular crystal form such as a cubic or octahedral form, and when silver halide grains are tabular grains it means the diameter of a circle having the same area as the projected area of the main plane of the grain. When silver halide grains do not have regular crystal forms, e.g., in the case of a spherical or cylindrical form, the grain size means the diameter of the sphere having the same volume as the volume of the silver halide grains.

Silver halide grains may have a crystal form such as a cubic, octahedral, tabular, spherical, cylindrical, or pebble-like form. Cubic grains and tabular grains are particularly preferably used in the present invention. When tabular silver halide grains are used, they preferably have an average aspect ratio of from 100/1 to 2/1, more preferably from 50/1 to 3/1. Silver halide grains having rounded corners can also be preferably used in the present invention. A plane index (Miller index) of the outer surface of photosensitive silver halide grains is not particularly limited, but it is preferred that the proportion occupied by {100} planes which have high ratio of spectral sensitizing efficiency when spectral sensitizing dyes are adsorbed is high. The proportion of {100} plane is preferably 50% or more, more preferably 65% or more, and still more preferably 80% or more. The proportion of {100} plane in the Miller index can be obtained by the method described in T. Tani, *J. Imaging Sci.*, 29, 165 (1985), which makes use of adsorption dependence of {111} plane and {100} plane in adsorption of sensitizing dyes.

The photosensitive silver halide grains for use in the present invention contain metals or metal complexes belonging to groups VII or VIII (from group 7 to group 10) of the Periodic Table. Preferred metals or central metals of metal complexes belonging to groups VII or VIII of the Periodic Table are rhodium, rhenium, ruthenium, osmium and iridium. These metal complexes may be used alone, or two or more of the complexes of the same or different metals can be used in combination. The content of these metals or metal complexes is preferably from $1\times10^{-9}$ mol to $1\times10^{-3}$ mol, more preferably from $1\times10^{-8}$ mol to $1\times10^{-4}$ mol, per mol of the silver. Specific structures of the metal complexes which can be used in the present invention are disclosed in JP-A-7-225449.

Water-soluble rhodium compounds can be used as a rhodium compound in the present invention, for example, rhodium(III) halide compounds, or rhodium complex salts having halogen, amines, or oxalato as a ligand, such as hexachlororhodium(III) complex salts, pentachloroaquorhodium(III) complex salts, tetrachlorodiaquorhodium(III) complex salts, hexabromorhodium(III) complex salts, hexamminerhodium (III) complex salts, trioxalatorhodium(III) complex salts and the like. These rhodium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of rhodium compound can be used. It is also possible to include and dissolve other silver halide grains which have been previously doped with rhodium during the preparation of silver halide instead of using water-soluble rhodium.

The addition amount of these rhodium compounds is preferably from $1\times10^{-8}$ mol to $5\times10^{-6}$ mol, and particularly preferably from $5\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Rhenium, ruthenium, and osmium for use in the present invention are added in the form of water-soluble complex salts as disclosed in JP-A-63-2042, JP-A-1-285941, JP-A-2-20852 and JP-A-2-20855. Particularly preferred compounds are complexes having six ligands represented by the following formula:

$$[ML_6]^{n-}$$

wherein M represents Ru, Re or Os, L represents a ligand, and n represents 0, 1, 2, 3 or 4.

In this case, counter ions are not important and ammonium or alkali metal ions are used.

Examples of preferred ligands include a halide ligand, a cyanide ligand, a carbonyl ligand, a nitrosyl ligand,. and a thionitrosyl ligand. Specific examples of complexes for use in the present invention are shown below but the present invention is not limited thereto.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]3-$ |
| $[RuCl_6]^{3-}$ | $[RuCl_4(H_2O)_2]^{-}$ | $[RuCl_5(H_2O)]^{2-}$ |
| $[RuCl_5(NO)]^{2-}$ | $[RuBr_5(NS)]^{2-}$ | |
| $[Ru(CO)_3Cl_3]^{2-}$ | $[Ru(CO)Cl_5]^{2-}$ | $[Ru(CO)Br_5]2-$ |
| $[OsCl_6]^{3-}$ | $[OsCl_5(NO)]^{2-}$ | $[Os(NO)(CN)_5]^{2-}$ |
| $[Os(NS)Br_5]^{2-}$ | $[Os(O)_2(CN)_4]^{4-}$ | |

The addition amount of these compounds is preferably from $1\times10^{-9}$ mol to $1\times10^{-5}$ mol, and particularly preferably from $1\times10^{-8}$ mol to $1\times10^{-6}$ mol, per mol of the silver halide.

These compounds can be added optionally during the preparation of silver halide emulsion grains and at any stage prior to coating of the emulsion, but they are particularly preferably added during emulsion formation and incorporated into the silver halide grains.

Various methods can be used for adding these compounds during grain formation of silver halide and incorporating them into silver halide grains, for example, a method in which a metal complex powder per se or an aqueous solution dissolved therein a metal complex powder with NaCl and KCl is previously added to a solution of water-soluble salt or water-soluble halide for grain formation, a method in which a metal complex powder is simultaneously added as the third solution when a solution of silver salt and a solution of halide are mixed to prepare silver halide grains by a triple jet method by three solutions, or a method in which a necessary amount of an aqueous solution of a metal complex powder is added to a reaction vessel during grain formation. A method of adding a metal complex powder per se or an aqueous solution dissolved therein a metal complex powder with NaCl and KCl is added to a water-soluble halide solution is particularly preferred.

When these compounds are added to surfaces of grains, a necessary amount of an aqueous solution of metal complexes can be added to a reaction vessel immediately after grain formation, during or at the time of finishing of physical ripening, or during chemical ripening.

Various iridium compounds can be used in the present invention, for example, hexachloroiridium, hexammineiridium, trioxalatoiridium, hexacyanoiridium, pentachloronitrosyliridium and the like. These iridium compounds are dissolved in water or an appropriate solvent and used. A conventional method such as a method in which an aqueous solution of hydrogen halide (e.g., hydrochloric acid, hydrobromic acid, hydrofluoric acid) or alkali halide (e.g., KCl, NaCl, KBr, NaBr) is added to stabilize the solution of iridium compound can be used. It is also possible to include and dissolve other silver halide grains which have been previously doped with iridium during the preparation of silver halide instead of using water-soluble iridium.

Further, the silver halide grains for use in the present invention may contain metal atoms such as cobalt, iron, nickel, chromium, palladium, platinum, gold, thallium, copper, or lead. With respect to cobalt, iron, chromium and ruthenium compounds, hexacyano metal complexes can preferably be used. Specifically, a ferricyanic acid ion, a ferrocyanic acid ion, a hexacyanocobaltic acid ion, a hexacyanochromic acid ion and a hexacyanoruthenic acid ion can be exemplified, but the present invention is not limited thereto. Metal complexes may be contained in silver halide uniformly, may be contained in high concentration in a core part, or may be contained in high concentration in a shell part without any limitation.

The preferred addition amount of these metals is from $1\times10^{-9}$ mol to $1\times10^{-4}$ mol per mol of the silver halide. Further, these metals can be added as a metal salt in the form of a single salt, a double salt or a complex salt during the preparation of grains.

Photosensitive silver halide grains can be desalted by washing according to methods well-known in this industry, e.g., a noodle washing method or a flocculation method, but silver halide grains may be or may not be desalted.

The oxidation number of the gold sensitizers which are used when the silver halide emulsion according to the present invention is subjected to gold sensitization may be monovalent or trivalent and gold compounds usually used as gold sensitizers can be used. Representative examples thereof include, for example, chloroauric acid, potassium chloroaurate, auric trichloride, potassium auric thiocyanate, potassium iodoaurate, tetracyanoauric acid, ammonium aurothiocyanate, and pyridyl trichloro-gold.

The addition amount of the gold sensitizers varies according to various conditions but is preferably from $1\times10^{-7}$ mol to $1\times10^{-3}$ mol, more preferably from $1\times10^{-6}$ mol $5\times10^{-4}$ mol, per mol of the silver halide as a criterion.

The silver halide emulsion of the present invention preferably uses a combination of gold sensitization with other sensitization methods. Conventionally known chemical sensitization methods such as sulfur sensitization, selenium sensitization, tellurium sensitization and noble metal sensitization can be used as other sensitization methods. When sensitization is performed in combination with gold sensitization, a combination of sulfur sensitization and gold sensitization, a combination of selenium sensitization and gold sensitization, a combination of sulfur sensitization, selenium sensitization and gold sensitization, a combination of sulfur sensitization, tellurium sensitization and gold sensitization, and a combination of sulfur sensitization, selenium sensitization, tellurium sensitization and gold sensitization are preferred, for example.

The sulfur sensitization preferably used in the present invention is usually carried out by adding a sulfur sensitizer and stirring the emulsion at high temperature of 40° C. or more for a certain period of time. Various well-known sulfur compounds can be used as a sulfur sensitizer, for example, in addition to sulfur compounds contained in gelatin, various sulfur compounds, e.g., thiosulfates, thioureas, thiazoles, and rhodanines can be used. Preferred sulfur compounds are thiosulfates and thioureas. The addition amount of a sulfur sensitizer is varied in accordance with various conditions such as the pH and temperature during chemical ripening and the grain size of the silver halide grains, but is preferably from $10^{-7}$ to $10^{-2}$ mol and more preferably from $10^{-5}$ to $10^{-3}$ mol, per mol of the silver halide.

Various well-known selenium compounds can be used as a selenium sensitizer in the present invention. The selenium sensitization is usually carried out by adding labile and/or non-labile selenium compounds and stirring the emulsion at high temperature, preferably 40° C. or more, for a certain period of time. The compounds disclosed in JP-B-44-15748, JP-B-43-13489, JP-A-4-25832, JP-A-4-109240 and JP-A-4-324855 can be used as labile selenium compounds. The compounds represented by formulae (VIII) and (IX) disclosed in JP-A-4-324855 are particularly preferably used.

The tellurium sensitizer for use in the present invention is a compound which forms silver telluride in the surfaces or interiors of silver halide grains, which silver telluride is presumed to become sensitization speck. The formation rate of the silver telluride in the silver halide emulsion can be examined according to the method disclosed in JP-A-5-313284. Examples of the tellurium sensitizers which can be used in the present invention include diacyltellurides, bis(oxycarbonyl)tellurides, bis(carbamoyl)tellurides, diacyltellurides, bis(oxycarbonyl)ditellurides, bis(carbamoyl)ditellurides, compounds having a P═Te bond, tellurocarboxylates, Te-organyltellurocarboxylates, di(poly)-tellurides, tellurides, tellurols, telluroacetals, tellurosulfonates, compounds having a P—Te bond, Te-containing heterocyclic rings, tellurocarbonyl compounds, inorganic tellurium compounds, and colloidal tellurium. Specific examples of tellurium sensitizers which can be used in the present invention are those disclosed in the following patents and literature: U.S. Pat. Nos. 1,623,499, 3,320,069, 3,772,031, British Patents 235,211, 1,121,496, 1,295,462, 1,396,696, Canadian Patent 800,958, JP-A-4-204640, JP-A-4-271341, JP-A-4-333043, JP-A-5-303157, *J. Chem. Soc. Chem. Commun.*, 635 (1980), ibid., 1102 (1979), ibid., 645 (1979), *J. Chem. Soc. Perkin. Trans.*, 1, 2191 (1980), S. Patai compiled, *The Chemistry of organic Selenium and Tellurium Compounds*, Vol. 1 (1986), and ibid., Vol. 2 (1987). The compounds represented by formulae (II), (III) and (IV) disclosed in JP-A-5-313284 are particularly preferred.

The amount of the selenium and tellurium sensitizers to be used in the present invention varies according to the silver halide grains used and the conditions of chemical ripening, but is generally about $1\times10^{-8}$ to $1\times10^{-2}$ mol, preferably about $1\times10^{-7}$ to $1\times10^{-3}$ mol, per mol of the silver halide. There is no particular limitation on the conditions of chemical sensitization in the present invention, but pH is from 5 to 8, pAg is from 6 to 11, preferably from 7 to 10, and temperature is from 40 to 95° C., preferably from 45 to 85° C.

Cadmium salt, sulfite, lead salt and thallium salt may be coexist in the silver halide emulsion for use in the present invention in the process of the formation or physical ripening of silver halide grains.

Reduction sensitization can be used in the present invention. As specific compounds for use in reduction sensitization, for example, stannous chloride, aminoiminomethanesulfinic acid, hydrazine derivatives, borane compounds, silane compounds and polyamine compounds can be used in addition to ascorbic acid and thiourea dioxide. Reduction sensitization can be performed by carrying out ripening with maintaining the pH and pAg of the emulsion at 7 or more and 8.3 or less, respectively. Moreover, reduction sensitization can be effected by introducing a single addition area of silver ions during grain formation.

Thiosulfonic acid compounds may be added to the silver halide emulsion of the present invention according to the method disclosed in European Patent 293917.

The silver halide emulsion in the image-forming material of the present invention may be one kind, or two or more kinds of silver halide emulsions (for example, those differing in average grain sizes, differing in halogen compositions, differing in crystal habits, or differing in the conditions of chemical sensitization) may be used in combination.

The photosensitive silver halide according to the present invention is preferably used in an amount of from 0.01 to 0.5 mol, more preferably from 0.02 to 0.3 mol, and most preferably from 0.03 to 0.25 mol, per mol of the organic silver salt. With respect to mixing methods and mixing conditions of photosensitive silver halide and organic silver salts prepared separately, there are a method of mixing respective photosensitive silver halide grains and organic silver salt having been prepared using a high speed stirrer, a ball mill, a sand mill, a colloid mill, a vibrating mill or a homogenizer, and a method of mixing photosensitive silver halide having been prepared at any time during preparation of organic silver salt to complete the production of organic silver salt. There is no restriction as to methods so long as the effect of the present invention can be sufficiently exhibited.

The preferred addition time of silver halide to the coating solution of image-forming layer is from 180 minutes before coating to immediately before coating, preferably from 60 minutes before to 10 seconds before coating. Mixing methods and mixing conditions are not particularly restricted so long as the effect of the present invention can be sufficiently exhibited. As specific mixing methods, a method of performing mixture in a tank in such a manner that the average residence time, which is calculated from the addition flow rate and the charging amount to the coater, coincides with the desired time, and a method of using a static mixer and the like as described in N. Harnby, M. F. Edwards, A. W. Nienow, translated by Koji Takahashi, *Liquid Mixing Techniques*, Chap. 8, published by Nikkan Kogyo Shinbunsha (1989) can be used.

Sensitizing dyes for use in the present invention are not restricted so long as they can spectrally sensitize silver halide grains in a desired wavelength region when they adsorbed onto silver halide grains. Sensitizing dyes such as a cyanine dye, a merocyanine dye, a complex cyanine dye, a complex merocyanine dye, a holopolar cyanine dye, a styryl dye, a hemicyanine dye, an oxonol dye and a hemioxonol dye can be used. Useful sensitizing dyes which can be used in the present invention are described, for example, in *Research Disclosure*, Vol. 17643, Item IV-A, p. 23 (December, 1978), ibid., Vol. 1831, Item X, p. 437 (August, 1979) or the literature cited therein. In particular, sensitizing dyes having suitable spectral sensitivity for spectral characteristics of light sources of various laser imager, scanner, image setter, and process camera can be advantageously selected.

As examples of spectral sensitization to red light, to an He—Ne laser, a red light semiconductor laser and a so-called red light source such as LED, Compounds I-1 to I-38 disclosed in JP-A-54-18726, Compounds I-1 to I-35 disclosed in JP-A-6-75322, Compounds I-1 to I-34 disclosed in JP-A-7-287338, Dyes 1 to 20 disclosed in JP-B-55-39818, Compounds I-1 to I-37 disclosed in JP-A-62-284343, and Compounds I-1 to I-34 disclosed in JP-A-7-287338 are advantageously selected.

To semiconductor laser light sources having a wavelength region of from 750 to 1,400 nm, various known dyes, e.g., cyanine, merocyanine, styryl, hemicyanine, oxonol, hemioxonol and xanthene dyes, can advantageously exhibit spectral sensitization. Useful cyanine dyes are cyanine dyes having a basic nucleus such as a thiazoline nucleus, an oxazoline nucleus, a pyrroline nucleus, a pyridine nucleus, an oxazole nucleus, a thiazole nucleus, a selenazole nucleus, and an imidazole nucleus. Preferred useful cyanine dyes also include an acidic nucleus such as a thiohydantoin nucleus, a rhodanine nucleus, an oxazolidinedione nucleus, a thiazolinedione nucleus, a barbituric acid nucleus, a thiazolinone nucleus, a malononitrile nucleus, and a pyrazolone nucleus in addition to the above basic nucleus. Of the above cyanine and merocyanine dyes, those having an imino group or a carboxyl group are particularly effective. For example, known sensitizing dyes as disclosed in U.S. Pat. Nos. 3,761,279, 3,719,495, 3,877,943, British Patents 1,466,201, 1,469,117, 1,422,057, JP-B-3-10391, JP-B-6-52387, JP-A-5-341432, JP-A-6-194781, JP-A-6-301141 can be optionally selected.

Particularly preferred structures of dyes for use in the present invention include cyanine dyes having a thioether bond-containing substituent (e.g., dyes disclosed in JP-A-62-58239, JP-A-3-138638, JP-A-3-138642, JP-A-4-255840, JP-A-5-72659, JP-A-5-72661, JP-A-6-222491, JP-A-2-230506, JP-A-6-258757, JP-A-6-317868, JP-A-6-324425, JP-W-7-500926, U.S. Pat. No. 5,541,054), dyes having a carboxylic acid group (e.g., dyes disclosed in JP-A-3-163440, JP-A-6-301141, U.S. Pat. No. 5,441,899), merocyanine dyes, polynuclear merocyanine dyes, polynuclear cyanine dyes (e.g., dyes disclosed in JP-A-47-6329, JP-A-49-105524, JP-A-51-127719, JP-A-52-80829, JP-A-54-61517, JP-A-59-214846, JP-A-60-6750, JP-A-63-159841, JP-A-6-35109, JP-A-6-59381, JP-A-7-146537, JP-A-7-146537, JP-W-55-50111, British Patent 1,467,638, U.S. Pat. No. 5,281,515).

Further, dyes forming J-band are disclosed in U.S. Pat. Nos. 5,510,236, 3,871,887 (dyes in Example 5), JP-A-2-96131 and JP-A-59-48753, which are preferably used in the present invention.

These sensitizing dyes may be used alone or in combination. A combination of sensitizing dyes is often used for the purpose of supersensitization. Further, dyes which themselves do not have a spectral sensitizing function or substances which substantially do not absorb visible light but show supersensitization can be incorporated into the emulsion with sensitizing dyes. Useful sensitizing dyes, combinations of dyes which show supersensitization, substances which show supersensitization are described in *Research Disclosure*, Vol. 17643, Item IV-J, p. 23 (December, 1978), and JP-B-49-25500, JP-B-43-4933, JP-A-59-19032 and JP-A-59-192242.

For the inclusion of the sensitizing dyes in the silver halide emulsion, they may be directly dispersed in the emulsion, or they may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide, etc., and then added to the emulsion.

In addition, various methods can be used for the inclusion of the sensitizing dyes in the emulsion, for example, a method in which the sensitizing dyes are -dissolved in a volatile organic solvent, the solution is dispersed in water or hydrophilic colloid and this dispersion is added to the emulsion as disclosed in U.S. Pat. No. 3,469,987, a method in which the sensitizing dyes are dissolved in acid and the solution is added to the emulsion, or the sensitizing dyes are added to the emulsion as an aqueous solution coexisting with acid or base as disclosed in JP-B-44-23389, JP-B-44-27555 and JP-B-57-22091, a method in which the dyes are added to the emulsion as an aqueous solution or colloidal dispersion coexisting with a surfactant as disclosed in U.S. Pat. Nos. 3,822,135 and 4,006,025, a method in which the dyes are directly dispersed in a hydrophilic colloid and the dispersion is added to the emulsion as disclosed in JP-A-53-102733 and JP-A-58-105141, or a method in which the dyes are dissolved using a compound capable of red-shifting and the solution is added to the emulsion as disclosed in JP-A-51-74624 can be used. Further, ultrasonic waves can be used for dissolution.

The time of the addition of the sensitizing dyes for use in the present invention to the silver halide emulsion of the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical sensitization, as disclosed in U.S. Pat. Nos. 2,735,766, 3,628,960, 4,183,756, 4,225,666, JP-A-58-184142 and JP-A-60-196749, or immediately before or during chemical ripening, after chemical ripening and before coating as disclosed in JP-A-58-113920. Also, as disclosed in U.S. Pat. No. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, otherwise one part is added prior to chemical ripening or during ripening stage and the remaining after completion of chemical sensitization. The kinds of compounds added separately and combinations of compounds may be varied.

The use amount of the sensitizing dyes according to the present invention may be selected according to characteristics such as sensitivity and fog, but is preferably from $10^{-6}$ to 1 mol, more preferably from $10^{-4}$ to $10^{-1}$ mol per mol of the silver halide in the photosensitive layer (the image-forming layer).

It is preferred for the photothermographic or thermographic image-forming material of the present invention to contain a reducing agent for organic silver salts. A reducing agent for organic silver salts may be an arbitrary substance, preferably an organic substance, for reducing silver ions to metal silver. Conventional photographic developing agents such as phenidone, hydroquinone and catechol are useful, but a hindered phenol reducing agent is preferably used. A reducing agent is preferably contained in an amount of from 5 to 50 mol %, more preferably from 10 to 40 mol %, per mol of the silver contained in the side on which the image-forming layer is provided. A reducing agent may be added to any layer provided on the side on which the image-forming layer is provided. When a reducing agent is added to layers other than the image-forming layer, it is preferred to use somewhat much amount, e.g., from 10 to 50 mol % per mol of the silver. A reducing agent may be a so-called precursor which has been derived to have a function effectively only at the time of development.

A variety of reducing agents for a photothermographic or thermographic image-forming material using an organic silver salt are disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-1023721, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,667,958, 3,679,426, 3,751,252, 3,751,255, 3,761,270, 3,782,949, 3,839,048, 3,928,686, 5,464,738, German Patent 2,321,328, and European Patent 692732, for example, amidoxime (e.g., phenylamidoxime, 2-thienylamidoxime, and p-phenoxyphenylamidoxime); azine (e.g., 4-hydroxy-3,5-dimethoxybenzaldehydeazine); combinations of aliphatic carboxylic acid arylhydrazide and ascorbic acid (e.g., 2,2'-bis(hydroxymethyl)propionyl-β-phenylhydrazine and ascorbic acid); combinations of polyhydroxybenzene and hydroxylamine, reductone, and/or hydrazine (e.g., combinations of hydroquinone and bis(ethoxyethyl)hydroxylamine, piperidinohexose reductone or formyl-4-methylphenylhydrazine); hydroxamic acid (e.g., phenylhydroxamic acid, p-hydroxyphenylhydroxamic acid, and β-anilinehydroxamic acid); combinations of azine and sulfonamidophenol (e.g., combinations of phenothiazine and 2,6-dichloro-4-benzenesulfonamidophenol); α-cyanophenylacetate derivatives (e.g., ethyl-α-cyano-2-methylphenylacetate, and ethyl-α-cyanophenylacetate); bis-β-naphthol (e.g., 2,2'-dihydroxy-1,1'-binaphthyl, 6,6'-dibromo-2,2'-dihydroxy-1,1'-binaphthyl, and bis(2-hydroxy-1-naphthyl)methane); combinations of bis-β-naphthol and 1,3-dihydroxybenzene derivatives (e.g., 2,4-dihydroxybenzophenone or 2',4'-dihydroxyacetophenone); 5-pyrazolone (e.g., 3-methyl-1-phenyl-5-pyrazolone); reductones (e.g., dimethylaminohexose reductone, anhydrodihydroaminohexose reductone, and anhydrodihydropiperidonehexose reductone); sulfonamidophenol reducing agents (e.g., 2,6-dichloro-4-benzenesulfonamidophenol and p-benzenesulfonamidophenol); 2-phenylindane-1,3-dione; chroman (e.g., 2,2-dimethyl-7-t-butyl-6-hydroxychroman); 1,4-dihydropyridine (e.g., 2,6-dimethoxy-3,5-dicarboethoxy-1,4-dihydropyridine); bisphenol (e.g., bis(2-hydroxy-3-t-butyl-5-methylphenyl)methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane); ascorbic acid derivatives (e.g., palmitic acid-1-ascorbil, stearic acid ascorbil); aldehyde and ketone of benzyl and acetyl; 3-pyrazolidone and a certain kind of indane-1,3-dione; chromanol (tocopherol), etc, can be exemplified. Particularly preferred reducing agents are bisphenol and chromanol.

Reducing agents for use in the present invention may be added in any form, e.g., a solution, a powder, or a solid fine particle dispersion. Solid fine particle dispersion is performed using well-known atomizing means, e.g., a ball mill, a vibrating ball mill, a sand mill, a colloid mill, a jet mill, a roller mill, etc. Auxiliary dispersants may be used for solid fine particle dispersion.

When "a toning agent", which is known as an additive for improving images, is used, optical density sometimes increases. A toning agent contributes to, in some cases, black silver image formation. A toning agent is preferably added to the side on which an image-forming layer is provided in an amount of from 0.1 to 50 mol %, more preferably from 0.5 to 20 mol %, per mol of the silver. A toning agent may be a so-called precursor which has been derived to have a function effectively only at the time of development.

A variety of toning agents for the image-forming material using an organic silver salt are disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, JP-B-49-10727, JP-B-54-20333, U.S. Pat. Nos. 3,080,254, 3,446,648, 3,782,941, 4,123,282, 4,510,236, British Patent 1,380,795, Belgian Patent 841,910, etc., for example, phthalimide and N-hydroxyphthalimide; cyclic imide (e.g., succinimide, pyrazolin-5-one, quinazolinone, 3-phenyl-2-pyrazolin-5-one, 1-phenylurazol, quinazoline, and 2,4-thiazolidinedione); naphthalimide (e.g., N-hydroxy-1,8-naphthalimide); cobalt complexes (e.g., cobalt hexamminetrifluoroacetate); mercaptan (e.g., 3-mercapto-1,2,4-triazole, 2,4-dimercaptopyrimidine, 3-mercapto-4,5-diphenyl-1,2,4-triazole, and 2,5-dimercapto-1,3,4-thiadiazole); N-(aminomethyl)aryldicarboxyimide (e.g., (N,N-dimethylaminomethyl)phthalimide and N,N-(dimethylaminomethyl)naphthalene-2,3-dicarboxyimide); blocked pyrazole, isothiuronium derivatives, and a certain kind of photodiscoloring agent (e.g., N,N'-hexamethylenebis(1-carbamoyl-3,5-dimethylpyrazole), 1,8-(3,6-diazaoctane)bis-(isothiuroniumtrifluoroacetate), and 2-tribromomethyl-sulfonyl)-(benzothiazole)); 3-ethyl-5-[(3-ethyl-2-benzothiazolinylidene)-1-methylethylidene]-2-thio-2,4-oxazolidinedione); phthalazinone, phthalazinone derivatives or metal salts thereof, or derivatives such as 4-(1-naphthyl)-phthalazinone, 6-chlorophthalazinone, 5,7-dimethoxyphthalazinone, and 2,3-dihydro-1,4-phthalazinedione; combinations of phthalazinone and phthalic acid derivatives (e.g., phthalic acid, 4-methylphthalic acid, 4-nitrophthalic acid, and tetrachlorophthalic anhydride); phthalazine, phthalazine derivatives or metal salts thereof (e.g., 4-(1-naphthyl)-phthalazine, 5-methylphthalazine, 6-methylphthalazine, 6-isopropylphthalazine, 6-isobutylphthalazine, 6-t-butylphthalazine, 6-methoxyphthalazine, 6-chlorophthalazine, 5,7-dimethoxyphthalazine, and 2,3-dihydrophthalazine); combinations of phthalazine or derivatives thereof and phthalic acid compounds (e.g., phthalic acid, 4-methylphthalic acid, 4-nitrophthalic acid, and tetrachlorophthalic anhydride); quinazolinedione, benzoxazine, naphthooxazine derivatives; rhodium complexes which function not only as toning agents but also as halide ion sources for forming silver halide on the site (e.g., ammonium hexachlororhodium(III), rhodium bromide, rhodium nitrate, and potassium hexachlororhodium(III); inorganic peroxides and persulfate (e.g., ammonium peroxide disulfide, and hydrogen peroxide); benzoxazine-2,4-dione (e.g., 1,3-benzoxazine-2,4-dione, 8-methyl-1,3-benzoxazine-2,4-dione, and 6-nitro-1,3-benzoxazine-2,4-dione); pyrimidine and asymmetric triazine (e.g., 2,4-dihydroxypyrimidine and 2-hydroxy-4-aminopyrimidine); azauracil and tetraazapentalene derivatives (e.g., 3,6-dimercapto-1,4-diphenyl-1H,4H-2,3a,5,6α-tetraazapentalene, and 1,4-di(o-chlorophenyl)-3,6-dimercapto-1H,4H-2,3a,5,6a-tetraazapentalene), etc., can be exemplified.

Toning agents for use in the present invention may be added in the form of, e.g., a solution, a powder, or a solid fine particle dispersion. Solid fine particle dispersion is performed using well-known atomizing means, e.g., a ball mill, a vibrating ball mill, a sand mill, a colloid mill, a jet mill, a roller mill, etc. Auxiliary dispersants may be used for solid fine particle dispersion.

In the present invention, it is preferred that an organic silver salt-containing layer (an image-forming layer) is formed by coating and drying a coating solution in which 30 wt % or more of the solvent is occupied by water. Further, it is preferred that a polymer latex, which is soluble or dispersible in a water system solvent (water solvent), in particular, an equilibrium moisture content at 25° C. 60% RH of which is 2 wt % or less, is used as the binder of an organic silver salt-containing layer (hereinafter referred to as "the polymer according to the present invention). The most preferred polymer of the present invention is a polymer so prepared that ionic conductivity becomes 2.5 mS/cm or less. Such a polymer can be produced by a method of subjecting the polymer synthesized to purifying treatment using a separating function film.

"A water system solvent" in which the polymer of the present invention is soluble or dispersible as used herein is water or water mixed with a water-miscible organic solvent in concentration of 70 wt % or less. As water-miscible organic solvents, alcohols such as methyl alcohol, ethyl alcohol, and propyl alcohol, cellosolves such as methyl cellosolve, ethyl cellosolve, and butyl cellosolve, ethyl acetate and dimethylformamide can be exemplified.

The system of a so-called dispersing state in which polymers are not dissolved thermodynamically is also called a water system solvent in the present invention.

"An equilibrium moisture content at 25° C. 60% RH" used in the present invention can be represented as follows with the weight of the polymer in humidity condition equilibrium at 25° C. 60% RH being WI and the weight of the polymer at 25° C. dry state being WO:

$$\text{An equilibrium moisture content at 25° C. 60\% RH} = [(W1-W0)/WO] \times 100 \text{ (wt \%)}$$

As for the definition and the measuring method of moisture content, e.g., *Polymer Engineering, Lecture* 14, "Test Method of Polymeric Materials", compiled by Kobunshi-Gakkai, published by Chijin Shokan Co. Ltd. can be referred to.

The equilibrium moisture content at 25° C. 60% RH of the polymer according to the present invention is preferably 2 wt % or less, more preferably from 0.01 wt % to 1.5 wt %, and still more preferably from 0.02 wt % to 1 wt %.

The polymers according to the present invention are not particularly restricted so long as they are soluble or dispersible in the above-described water system solvent and have equilibrium moisture content at 25° C. 60% RH of 2 wt % or less. Of these polymers, polymers which are dispersible in a water system solvent are particularly preferred.

As examples of dispersion conditions, there are latexes in which fine particles of solid polymers are dispersed and dispersions in which polymer molecules are dispersed in a molecular state or with forming micells, and any of these can be preferably used.

Hydrophobic polymers such as an acrylic resin, a polyester resin, a rubber-based resin (e.g., an SBR resin), a polyurethane resin, a vinyl chloride resin, a vinyl acetate resin, a vinylidene chloride resin, and a polyolefin resin can be preferably used. Polymers may be straight chain, branched or crosslinked polymers. As polymers, any of homopolymers in which single monomers are polymerized and copolymers in which two or more monomers are copolymerized may be used. When copolymers are used, both of random copolymers and block copolymers may be used. The molecular weight of polymers is from 5,000 to 1,000,000, preferably from 10,000 to 200,000, in number average molecular weight. If the molecular weight is too small, the mechanical strength of the emulsion layer is insufficient, while when it is too large, the film property is disadvantageously deteriorated.

The polymers according to the present invention comprise the foregoing polymers dispersed in a water system dispersion medium. "Water system dispersion medium" used herein means a dispersion system in which 30 wt % or more of the composition is occupied by water. As dispersion conditions, any of emulsified dispersion, micell dispersion, dispersion in which polymers having hydrophilic parts are dispersed in a molecular state can be used but latexes are particularly preferably used.

Specific examples of preferred polymers are shown below. In the following, polymers are indicated as raw material monomers, the numerical values in parentheses are wt % and the molecular weights are number average molecular weights.

P-1: Latex comprising MMA (70)-EA (27)-MAA (3) (molecular weight: 37,000)

P-2: Latex comprising MMA (70)-2EHA (20)-St (5)-AA (5) (molecular weight: 40,000)

P-3: Latex comprising St (50)-Bu (47)-MAA (3) (molecular weight: 45,000)

P-4: Latex comprising St (68)-Bu (29)-AA (3) (molecular weight: 60,000)

P-5: Latex comprising St (70)-Bu (27)-IA (3) (molecular weight: 120,000)

P-6: Latex comprising St (75)-Bu (24)-AA (1) (molecular weight: 108,000)

P-7: Latex comprising St (60)-Bu (35)-DVB (3)-MAA (2) (molecular weight: 150,000)

P-8: Latex comprising St (70)-Bu (25)-DVB (2)-AA (3) (molecular weight: 280,000)

P-9: Latex comprising VC (50)-MMA (20)-EA (20)-AN (5)-AA (5) (molecular weight: 80,000)

P-10: Latex comprising VDC (85)-MMA (5)-EA (5)-MAA (5) (molecular weight: 67,000)

P-11: Latex comprising Et (90)-MAA (10) (molecular weight: 12,000)

Abbreviations in the above show the following monomers. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

The above-described polymers are commercially available and the following polymers can be used. As examples of acrylic resins, Sebian A-4635, 46583, 4601 (manufactured by Daicel Chemical Industries Ltd.), Nipol Lx811, 814, 821, 820, 857 (manufactured by Nippon Zeon Co., Ltd.), as examples of polyester resins, FINETEX ES650, 611, 675, 850 (manufactured by Dainippon Chemicals and Ink Co., Ltd.), WD-size and WMS (manufactured by Eastman Chemical Co.), as examples of polyurethane resins, HYDRAN AP10, 20, 30, 40 (manufactured by Dainippon Chemicals and Ink Co., Ltd.), as examples of rubber-based resins, LACSTAR 7310K, 3307B, 4700H, 7132C (manufactured by Dainippon Chemicals and Ink Co., Ltd.), Nipol Lx416, 410, 438C, 2507 (manufactured by Nippon Zeon Co., Ltd.), as examples of vinyl chloride resins, G351 and G576 (manufactured by Nippon Zeon Co., Ltd.), as examples of vinylidene chloride resins, L502 and L513 (manufactured by Asahi Chemical Industry Co., Ltd.), and as examples of olefin resins, Chemipearl S120 and SA100 (manufactured by Mitsui Petrochemical Industries, Ltd.) can be exemplified.

These polymers may be used alone as polymer latexes or two or more polymers may be blended, if necessary.

Styrene/butadiene copolymer latexes are particularly preferably used in the present invention. The weight ratio of the styrene monomer unit and the butadiene monomer unit in styrene/butadiene copolymers is preferably from 40/60 to 95/5. The ratio occupied by the styrene monomer unit and the butadiene monomer unit in the copolymer is preferably from 60 to 99 wt %. The preferred molecular weight is the same as above.

Preferred styrene/butadiene copolymer latexes which can be used in the present invention are the foregoing P-3 and P-8 and commercially available products LACSTAR-3307B, 7132C, and Nipol Lx416.

Hydrophilic polymers such as gelatin, polyvinyl alcohol, methyl cellulose, and hydroxypropyl cellulose may be added to the organic silver salt-containing layer of the image-forming material of the present invention, according to necessity. The addition amount of these hydrophilic polymers is preferably 30 wt % or less, more preferably 20 wt % or less, based on the total binder of the organic silver salt-containing layer.

The organic silver salt-containing layer according to the present invention is preferably formed of polymer latexes. The weight ratio of the total binder/the organic silver in the organic salt-containing layer is preferably from 1/10 to 10/1, more preferably from 1/5 to 4/1.

Such an organic silver salt-containing layer is, in general, also a photosensitive layer (an emulsion layer) containing photosensitive silver halide. In this case, the weight ratio of the total binder/silver halide is preferably from 400 to 5, more preferably from 200 to 10.

The total binder amount in the image-forming layer of the present invention is preferably from 0.2 to 30 $g/m^2$, more preferably from 1 to 15 $g/m^2$. The image-forming layer of the present invention may contain a crosslinking agent for cross-linking and a surfactant for improving coating property.

The solvent for the coating solution of the organic silver salt-containing layer of the image-forming material of the present invention (solvent and dispersion medium are briefly expressed solvent collectively) is a water system solvent containing 30 wt % or more of water. As components other than water, water-miscible organic solvents such as methyl alcohol, ethyl alcohol, isopropyl alcohol, methyl cellosolve, ethyl cellosolve, dimethylformamide and ethyl acetate may be arbitrarily used in the coating solution. The water content in the solvent of the coating solution is preferably 50 wt % or more, more preferably 70 wt % or more. Preferred examples of the composition of the solvent include, in addition to water, water/methyl alcohol=90/10 (wt %), water/methyl alcohol=70/30, water/methyl alcohol/dimethylformamide=80/15/5, water/methyl alcohol/ethyl cellosolve=85/10/5, water/methyl alcohol/isopropyl alcohol=85/10/5, etc.

The addition of antifoggants, stabilizers and stabilizer precursors to the silver halide emulsion or/and the organic silver salt according to the present invention prevents generation of additional fog and stabilizes decrease of sensitivity during storage. Appropriate antifoggants, stabilizers and stabilizer precursors which can be used alone or in combination are shown below: thiazonium salts disclosed in U.S. Pat. Nos. 2,131,038 and 2,694,716; azaindenes disclosed in U.S. Pat. Nos. 2,886,437 and 2,444,605; mercury salts disclosed in U.S. Pat. No. 2,728,663; urazols disclosed in U.S. Pat. No. 3,287,135; sulfocatechols disclosed in U.S. Pat. No. 3,235,652; oximes, nitrons and nitroindazoles disclosed in British Patent 623,448; polyvalent metals disclosed in U.S. Pat. No. 2,839,405; thiuronium salts disclosed in U.S. Pat. No. 3,220,839; palladium, platinum and gold salt disclosed in U.S. Pat. Nos. 2,566,263 and 2,597,915; halogen-substituted organic compounds disclosed in U.S. Pat. Nos. 4,108,665 and 4,442,202; triazines disclosed in U.S. Pat. Nos. 4,128,557, 4,137,079, 4,138,365 and 4,459,360; and phosphorus compounds disclosed in U.S. Pat. No. 4,411,985.

Antifoggants which are preferably used in the present invention are organic halides and those compounds disclosed in the following patents can be exemplified: JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, U.S. Pat. Nos. 5,340,712, 5,369,000 and 5,464,737.

Antifoggants for use in the present invention may be added in the form of, e.g., a solution, a powder, or a solid fine particle dispersion. Solid fine particle dispersion is performed using well-known atomizing means, e.g., a ball mill, a vibrating ball mill, a sand mill, a colloid mill, a jet mill, a roller mill, etc. Auxiliary dispersants may be used for solid fine particle dispersion.

Although it is not necessary for the execution of the present invention, the addition of mercury(II) salts to the emulsion layer as an antifoggant sometimes brings about advantageous results. Preferred mercury(II) salts for this purpose are mercury acetate and mercury bromide. The amount of mercury used in the present invention is preferably from $1\times10^{-9}$ mol to $1\times10^{-3}$ mol, more preferably from $1\times10^{-9}$ mol to $1\times10^{-4}$ mol, per mol of the silver coated.

The photothermographic image-forming material according to the present invention may contain benzoic acids for the purpose of increasing sensitivity and preventing fog. Benzoic acids which can be used in the present invention may be any benzoic acid derivatives. The compounds disclosed in U.S. Pat. Nos. 4,784,939, 4,152,160, JP-A-9-329865, JP-A-9-329864 and JP-A-9-281637 can be exemplified as examples having preferred structures. Benzoic acids of the present invention can be added anywhere of the image-forming material, preferably added to the layers of the side on which an image-forming layer (a photosensitive layer) is provided, more preferably added to the organic silver salt-containing layer. The time of the addition of benzoic acids for use in the present invention may be at any stage of the preparation of the coating solution. When benzoic acids are added to the organic silver salt-containing layer, they may be added at any stage from the forming stage of the organic silver salt to the forming stage of the coating solution, but preferably they are added after preparation of the organic silver salt and immediately before coating of the coating solution. Benzoic acids for use in the present invention may be added in the form of, e.g., a powder, a solution, or a solid fine particle dispersion. They may be added as the mixed solution with other additives such as sensitizing dyes, reducing agents and toning agents. The addition amount of benzoic acids may be any amount, preferably from $1\times10^{-6}$ to 2 mol, more preferably from $1\times10^{-3}$ to 0.5 mol, per mol of the silver.

The image-forming material of the present invention can contain a mercapto compound, a disulfide compound and a thione compound for the purpose of controlling or accelerating development, improving spectral sensitization efficiency and improving storage stability before and after development.

When a mercapto compound is used, a mercapto compound having any structure can be used but a mercapto compound represented by formula Ar—SM or Ar—S—S—Ar is preferred. In the formulae, M represents a hydrogen atom or an alkali metal atom, and Ar represents an aromatic ring group or a condensed aromatic ring group having one or more nitrogen, sulfur, oxygen, selenium or tellurium atoms. The heterocyclic aromatic ring in these groups is preferably benzimidazole, naphthimizole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. This heterocyclic aromatic ring may have a substituent selected from the group consisting of a halogen atom (e.g., Br, Cl), a hydroxyl group, an amino group, a carboxyl group, an alkyl group (having 1 or more, preferably from 1 to 4 carbon atoms), and an alkoxyl group (having 1 or more, preferably from 1 to 4 carbon atoms). Examples of mercapto-substituted heterocyclic aromatic compounds include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis-benzothiazole, 3-mercapto-1,2,4-triazole, 4,5-diphenyl-2-imidazole thiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinoline thiol, 2,3,5,6-tetrachloro-4-pyridine thiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole, but the present invention is not limited thereto.

Mercapto compounds are preferably added in an amount of from 0.001 to 1.0 mol, more preferably from 0.01 to 0.3 mol, per mol of the silver in the emulsion layer.

The image-forming layer (photosensitive layer) of the present invention can contain, as a plasticizer and a lubricant, polyhydric alcohols (e.g., glycerins and diols disclosed in U.S. Pat. No. 2,960,404), fatty acids or fatty acid esters disclosed in U.S. Pat. Nos. 2,588,765 and 3,121,060, and silicone resins disclosed in British Patent 955,061.

The photothermographic or thermographic image-forming material according to the present invention can be provided with a surface protective layer for the purpose of preventing adhesion.

Any polymer can be used as the binder of the surface protective layer of the present invention. It is preferred, however, to contain polymers having a carboxylic acid residue in an amount of from 100 mg/m$^2$ to 5 g/m$^2$. The polymers having a carboxylic acid residue used herein include natural polymers (e.g., gelatin, alginic acid), modified natural polymers (e.g., carboxymethyl cellulose, phthalated gelatin), and synthetic polymers (e.g., polymethacrylate, polyacrylate, a polyalkyl methacrylate/acrylate copolymer, a polystyrene/polymethacrylate copolymer). The content of such a carboxylic acid residue of polymer is preferably from $1\times10^{-2}$ to 1.4 mol per 100 g of the polymer. Further, the carboxylic acid residue may form a salt with an alkali metal ion, an alkaline earth metal ion or an organic cation.

Any adhesion preventing material may be used as the surface protective layer according to the present invention. Examples of adhesion preventing materials include waxes, silica particles, styrene-containing elastomeric block copolymers (e.g., styrene/butadiene/styrene, styrene/isoprene/styrene), cellulose acetate, cellulose acetate butyrate, cellulose propionate, and mixtures of these. Further, the surface protective layer of the present invention may contain a crosslinking agent for crosslinking and a surfactant for improving coating property.

The image-forming layer or the protective layer of the image-forming layer according to the present invention can contain light absorbing substances or filter dyes disclosed in U.S. Pat. Nos. 3,253,921, 2,274,782, 2,527,583 and 2,956,879. Further, dyes can be mordanted as disclosed in U.S. Pat. No. 3,282,699. With respect to the use amount of filter dyes, the absorbance at exposure wavelength is preferably from 0.1 to 3.0, particularly preferably from 0.2 to 1.5.

The image-forming layer or the protective layer of the image-forming layer according to the present invention can contain a matting agent, e.g., starch, titanium dioxide, zinc oxide, silica, or polymer beads containing beads disclosed in U.S. Pat. Nos. 2,992,101 and 2,701,245. The matting degree of the emulsion surface is not particularly limited so long as white-spot unevenness does not occur, but Beck's smoothness is preferably from 50 to 10,000 seconds, particularly preferably from 80 to 10,000 seconds.

The coating solution of the image-forming layer of the present invention is preferably prepared at temperature of from 30 to 65° C., more preferably 35° C. or higher and lower than 60° C. (preferably 55° C. or lower). Further, the temperature of the image-forming layer-coating solution immediately after the addition of a polymer latex is preferably maintained at from 35° C. to 65° C. A reducing agent and an organic silver salt have been preferably mixed before the addition of a polymer latex.

The liquid containing the organic silver salt or the coating solution of the image-forming layer according to the present invention is preferably a so-called thixotropic liquid. Thixotropy is the property which lowers in viscosity as the shear rate increases. Any test apparatus can be used in the viscosity measurement in the present invention. RFS Fluid Spectrometer manufactured by Rheometrics Far East Co. is preferably used. Measurement is performed at 25° C. The viscosity at the shear rate of 0.1 $S^{-1}$ of the liquid containing the organic silver salt or the coating solution of the image-forming layer according to the present invention is preferably from 400 mPa·s to 100,000 mPa·s, more preferably from 500 mPa·s to 20,000 mPa·s. The viscosity at shear rate of 1,000 $S^{-1}$ is preferably from 1 mPa·s to 200 mPa·s, more preferably from 5 mPa·s to 80 mPa·s.

Various systems exhibiting thixotropy are known and described, for example, in *Lecture, Rheology*, Muroi, Morino, *High Molecular Latexes*, compiled by Kobunshi Kanko Kai, published by Kobunshi Kanko Kai. It is necessary for liquid to contain a large amount of solid fine particles to exhibit thixotropy. For heightening thixotropy, viscosity-increasing linear high molecules must be contained. Further, it is effective that solid fine particles contained have a large aspect ratio anisotropically, in addition, the use of alkali thickeners and surfactants is also effective.

The photothermographic photographic emulsion according to the present invention comprises one or more layers on a support. One layer constitution must contain an organic silver salt, a silver halide, a developing agent, and a binder, in addition to these, desired additional materials, e.g., a toning agent, a covering aid, and other auxiliary agents. Two layer constitution must contain an organic silver salt and a silver halide in the first emulsion layer (generally the layer adjacent to the support), and other several components in the second emulsion layer, or in both the first and second layers. There is another two layer constitution comprising a single emulsion layer containing all the components and a protective top coating layer, however. In the constitution of a multi-color photosensitive photothermographic material, each color may comprise a combination of these two layers. Alternatively, as disclosed in U.S. Pat. No. 4,708,928, a single layer may contain all the components. In the case of a multi-dye multi-color photosensitive photothermographic material, in general, a functional or non-functional barrier layer is provided between each emulsion layer (a photosensitive layer) to separate and retain each emulsion layer as disclosed in U.S. Pat. No. 4,460,681.

Various kinds of dyes and pigments can be used in the photosensitive layer of the present invention with a view to improving tone and preventing irradiation. Any dye and pigment may be used in the photosensitive layer of the present invention, e.g., pigments and dyes described in Color Index. Specifically, organic dyes such as pyrazoloazole dyes, anthraquinone dyes, azo dyes, azomethine dyes, oxonol dyes, carbocyanine dyes, styryl dyes, triphenylmethane dyes, indoaniline dyes, and indophenol dyes, and organic and inorganic pigments such as azo-based pigments, polycyclic pigments (e.g., phthalocyanine-based pigments, anthraquinone-based pigments), dyeing lake pigments, and azine pigments can be exemplified. Examples of preferred dyes include anthraquinone dyes (e.g., Compounds 1 to 9 disclosed in JP-A-5-341441, Compounds 3-6 to 3-18 and 3-23 to 3-38 disclosed in JP-A-5-165147), azomethine dyes (e.g., Compounds 17 to 47 disclosed in JP-A-5-341441), indoaniline dyes (e.g., Compounds 11 to 19 disclosed in JP-A-5-289227, Compound 47 disclosed in JP-A-5-341441, Compounds 2-10 and 2-11 disclosed in JP-A-5-165147), and azo dyes (e.g., Compounds 10 to 16 disclosed in JP-A-5-341441), and examples of preferred pigments include anthraquinone-based indanthrone pigments (e.g., C.I. Pigment Blue 60), phthalocyanine pigments (e.g., copper phthalocyanine such as C.I. Pigment Blue 15, nonmetal phthalocyanine such as C.I. Pigment Blue 16), dyeing lake pigment-based triarylcarbonyl pigments, indigo, and inorganic pigments (e.g., ultramarine blue, cobalt blue). These dyes and pigments may be added in the form of, e.g., a solution, an emulsion, a solid fine particle dispersion, or in the state mordanted by a high molecular mordanting agent. The amount of these compounds is determined by the desired absorbing amount but, in general, from 1 $\mu$g to 1 g per $m^2$ of the image-forming material is preferred. For adjusting red tint, dioxane-based pigments, quinacridone-based pigments, and diketopyrrolopyrrole-based pigments may be used in combination.

In the present invention, an antihalation layer can be provided farther than the photosensitive layer from the light source. It is preferred that an antihalation layer has the maximum absorption of exposure wavelength in the desired wavelength region of from 0.3 to 2, more preferably from 0.5 to 2, and the absorption in the visible region after processing is preferably 0.001 or more and less than 0.5, more preferably optical density of 0.001 or more and less than 0.3.

When antihalation dyes are used in the present invention, any compound can be used so long as they have objective absorption within the wavelength region, show little absorption in visible region after processing, and provide desirable absorbance spectrum of the antihalation layer. Examples of antihalation dyes are disclosed in the following patents but the present invention is not limited thereto. As a single dye, compounds disclosed in JP-A-59-56458, JP-A-2-216140, JP-A-7-13295, JP-A-7-11432, U.S. Pat. No. 5,380,635, 1.1, left lower column, p. 13 to 1.9, left lower column, p. 14 of JP-A-2-68539, and left lower column, p. 14 to right lower column, p. 16 of JP-A-3-24539, and as a dye which is decolored by processing, compounds disclosed in JP-A-52-139136, JP-A-53-132334, JP-A-56-501480, JP-A-57-16060, JP-A-57-68831, JP-A-57-101835, JP-A-59-182436, JP-A-7-36145, JP-A-7-199409, JP-B-48-33692, JP-B-50-16648, JP-B-2-41734, U.S. Pat. Nos. 4,088,497, 4,283,487, 4,548,896, and 5,187,049 can be used.

The photothermographic or thermographic image-forming material according to the present invention is preferably a so-called single side image-forming material comprising a support having provided on one side of the support at least one photosensitive layer (image-forming layer) containing a silver halide emulsion, and a backing layer on the other side of the support.

The single side image-forming material according to the present invention may contain a matting agent for improving transporting property. Matting agents in general comprise fine particles of water-insoluble organic or inorganic compounds. Optional matting agents can be used in the present invention. Organic matting agents disclosed in U.S. Pat. Nos. 1,939,213, 2,701,245, 2,322,037, 3,262,782, 3,539,344, 3,767,448, and inorganic matting agents disclosed in U.S. Pat. Nos. 1,260,772, 2,192,241, 3,257,206, 3,370,951, 3,523,022 and 3,769,020 are well-known in this industry and can be used in the present invention. In specific examples of organic compounds which can be used as matting agents, examples of water-dispersible vinyl polymers include polymethyl acrylate, polymethyl methacrylate, polyacrylonitrile, acrylonitrile-$\alpha$-methylstyrene copolymers, polystyrene, styrene/divinylbenzene copolymers, polyvinyl acetate, polyethylene carbonate, polytetrafluoroethylene, etc., examples of cellulose derivatives include methyl cellulose, cellulose acetate, cellulose acetate propionate, etc., examples of starch derivatives include carboxyl starch, carboxynitrophenyl starch, urea/formaldehyde/starch reaction products, etc., hardened gelatin treated with well-known hardening agents and hardened gelatin as microencapsulated hollow product by coacervation hardening can be preferably used. As examples of inorganic compounds, silicon dioxide, titanium dioxide, magnesium dioxide, aluminum oxide, barium sulfate, calcium carbonate, silver chloride and silver bromide desensitized by a well-known method, glass, and diatomaceous earth can be preferably used. These matting agents can be mixed with different kinds of substances, if necessary. The size and shape of the matting agent are not particularly limited and optional diameters can be selected. In the present invention, matting agents of the particle size of from 0.1 $\mu$m to 30 $\mu$m can be preferably used. The particle size distribution of the matting agent may be broad or narrow. On the other hand, as matting agents largely affect the haze of the coated film and the surface gloss, it is desired to adjust particle size, particle shape and particle size distribution to a necessary condition when matting agents are prepared or by mixing a plurality of matting agents.

The matting degree of the backing layer according to the present invention is preferably Beck's smoothness of from 1,200 seconds to 10 seconds, more preferably from 700 seconds to 50 seconds.

In the present invention, matting agents are preferably added to the outermost surface layer, the layer which functions as the outermost surface layer, or the layer near the outer surface. They are also preferably added to the layer functioning as a protective layer.

The binders preferably used in the backing layer of the present invention are transparent or translucent and generally colorless. Suitable examples include natural polymers, synthetic resins, synthetic polymers and synthetic copolymers, in addition, media which can form a film, e.g., gelatin, gum arabic, poly(vinyl alcohol), hydroxyethyl cellulose, cellulose acetate, cellulose acetate butyrate, poly (vinyl pyrrolidone), casein, starch, poly(acrylic acid), poly (methyl methacrylate), poly(vinyl chloride), poly (methacrylate), copoly(styrene/maleic anhydride), copoly (styrene/ acrylonitrile), copoly(styrene/butadiene), poly (vinyl acetals) (e.g., poly(vinyl formal), poly(vinyl butyral)), poly(esters), poly(urethanes), phenoxy resins, poly (vinylidene chloride), poly(epoxides), poly(carbonates), poly(vinyl acetate), cellulose esters, and poly(amides). Binders may be coated by using water, organic solvent or emulsions.

It is preferred that the backing layer has the maximum absorption in the desired wavelength region of from 0.3 to 2, more preferably from 0.5 to 2, and the absorption in the visible region after processing is preferably 0.001 or more and less than 0.5, more preferably optical density of 0.001 or more and less than 0.3. Examples of antihalation dyes for use in the backing layer are the same as those used in the above-described antihalation layer.

A backside resistive heating layer disclosed in U.S. Pat. Nos. 4,460,681 and 4,374,921 can also be used in the photosensitive photothermographic images in the present invention.

Hardening agents may be used in each of the image-forming layer (photosensitive layer), protective layer, and backing layer. Examples of hardening agents are described in T. H. James, *The Theory of the Photographic Process*, the 4th Ed., pp. 77 to 87, Macmillan Publishing Co., Inc. (1977), and polyvalent metal ions described on p. 78 of the above literature, polyisocyanates disclosed in U.S. Pat. No. 4,281,060 and JP-A-6-208193, epoxy compounds disclosed in U.S. Pat. No. 4,791,042, and vinyl sulfone compounds disclosed in JP-A-62-89048 are preferably used in the present invention.

Hardening agents are added as a solution. The preferred addition time of the solution to the protective layer coating solution is from 180 minutes before coating to immediately before coating, preferably from 60 minutes before to 10 seconds before coating. Mixing methods and mixing conditions are not particularly restricted so long as the effect of the present invention can be sufficiently exhibited. As specific mixing methods, a method of performing mixture in a tank in such a manner that the average residence time, which is calculated from the addition flow rate and the charging amount to the coater, coincides with the desired time, and a method of using a static mixer and the like as described in N. Harnby, M. F. Edwards, A. W. Nienow, translated by Koji Takahashi, *Liquid Mixing Techniques*, Chap. 8, published by Nikkan Kogyo Shinbun-sha (1989) can be used.

Surfactants may be used in the present invention for the purpose of improving coating property and electric charge. Any surfactant can be used arbitrarily, e.g., nonionic, anionic, cationic and fluorine-based surfactants. Specifically, fluorine-based high molecular surfactants disclosed in JP-A-62-170950 and U.S. Pat. No. 5,380,644, fluorine-based surfactants disclosed in JP-A-60-244945 and JP-A-63-188135, polysiloxane-based surfactants disclosed in U.S. Pat. No. 3,885,965, and polyalkylene oxide and anionic surfactants disclosed in JP-A-6-301140 can be exemplified.

Examples of the solvents for use in the present invention are described in, e.g., New Edition, *Solvent Pocketbook*, Ohm Publishing Co. (1994), but the present invention is not limited thereto. The solvents for use in the present invention preferably have a boiling point of from 40° C. to 180° C.

Examples of the solvents for use in the present invention include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

The photographic emulsion for heat development according to the present invention can be coated on various supports. Representative examples of the supports are polyester films, undercoated polyester films, poly(ethylene terephthalate) films [PET films], polyethylene naphthalate films, cellulose nitrate films, cellulose ester films, poly(vinyl acetal) films, polycarbonate films, and related materials or resinous materials, glass, paper, and metal. Flexible substrates, in particular, paper supports coated with baryta and/or partially acetylated α-olefin polymers, in particular, α-olefin polymers having from 2 to 10 carbon atoms such as polyethylene, polypropylene, ethylene/butene copolymer are representatively used in the present invention. Support may be transparent or translucent but is preferably transparent.

The photothermographic or thermographic image-forming material according to the present invention may be provided with an antistatic layer or an electrically conductive layer, e.g., layers containing soluble salts (e.g., chloride, nitrate), metal deposited layers, layers containing ionic polymers disclosed in U.S. Pat. Nos. 2,861,056 and 3,206,312, and insoluble inorganic salts disclosed in U.S. Pat. No. 3,428,451.

The method for obtaining color images with the photothermographic image-forming material according to the present invention is disclosed in JP-A-7-13295, from p. 10, left column, 1.43 to p. 11, left column, 1.40. Color dye image stabilizers are disclosed in British Patent 1,326,889, U.S. Pat. Nos. 3,432,300, 3,698,909, 3,574,627, 3,573,050, 3,764,337 and 4,042,394.

The photothermographic or thermographic image-forming material according to the present invention may be coated by any method. Specifically, extrusion coating, slide coating, curtain coating, immersion coating, knife coating, flow coating, and various coating methods including extrusion coating using hoppers disclosed in U.S. Pat. No. 2,681,294 can be used. Extrusion coating and slide coating described in Stephen F. Kistler, Peter M. Schweizer, *Liquid Film Coating*, pp. 399 to 536, Chapman & Hall Co. (1997) are preferably used, particularly preferably slide coating. Examples of the shapes of slide coaters for use in slide coating are described in ibid., p. 427, FIG. 11*b*.1. Two or more layers can be coated simultaneously by the methods described in ibid., pp. 399 to 536, U.S. Pat. No. 2,761,791 and British Patent 837,095, if desired.

The photothermographic image-forming material according to the present invention can include other additional layers, e.g., a dye-receiving layer for receiving transfer dye images, an opaque layer for the time when reflective printing is desired, a protective top coating layer, and a primer layer which is known in light/heat photographic techniques. The image-forming material according to the present invention is preferred in that image formation is feasible with that one sheet only and a functional layer such as an image-receiving layer which is necessary for image formation requires no different material.

Any method can be used for developing the image-forming material according to the present invention. However, in general, an imagewise exposed image-forming material is developed with increasing the temperature. The developing temperature is preferably from 80 to 250° C., more preferably from 100 to 140° C., and the developing time is preferably from 1 to 180 seconds, more preferably from 10 to 90 seconds.

The image-forming material according to the present invention may be exposed according to any method, but laser beams are preferably used as a light source. A gas laser, a YAG laser, a dye laser and a semiconductor laser are preferably used as exposure light sources in the present invention. A semiconductor and second harmonic generation light source can also be used.

The image-forming material according to the present invention shows low haze by exposure and liable to generate interference fringe. A technique of letting laser beams in aslant to the image-forming material as disclosed in JP-A-5-113548 and a method of using a multi-mode laser as disclosed in WO 95/31754 are known techniques to prevent generation of interference fringe. These techniques are preferably used in the present invention.

For exposing the image-forming material according to the present invention, it is preferred to perform exposure in such a manner that laser beams are overlapped so as to hide scanning lines as disclosed in *SPIE*, Vol. 169, "Laser Printing", pp. 116 to 129 (1979), JP-A-4-51043 and WO 95/31754.

The present invention is described in detail with reference to the examples, but it should not be construed as being limited thereto.

EXAMPLE I-1

Preparation of PET Support

PET having an intrinsic viscosity IV=0.66 (measured in phenol/tetrachloroethane (6/4 by weight) at 25° C.) was obtained according to ordinary method with terephthalic acid and ethylene glycol. After the obtained PET was pelletized and dried at 130° C. for 5 hours, melted at 300° C., extruded from T-die, and rapidly cooled, thereby an unstretched film having a film thickness after thermal fixation of 175 μm was obtained.

The film was stretched to 3.3 times in the lengthwise direction with rollers having different peripheral speeds, then 4.5 times in the crosswise direction by means of a tenter. The temperatures at that time were 110° C. and 130° C. respectively. Subsequently, the film was subjected to thermal fixation at 240° C. for 20 seconds, then relaxation by 4% in the crosswise direction at the same temperature. The chuck part of the tenter was then slit, and both edges of the film were knurled. The film was rolled under a tension of 4 kg/cm$^2$, thereby a roll of film having a thickness of 175 μm was obtained.

Corona Discharge Treatment of Support Surface

Both surfaces of the support were put under room temperature and corona discharge treatment was performed at 20 m/min with a solid state corona treating apparatus model 6KVA manufactured by Pillar Co. From the reading of electric current/voltage, treatment applied to the support at that time was revealed to be 0.375 kV·A·min/m$^2$. The frequency at treatment at that time was 9.6 kHz and the gap clearance between the electrode and the dielectric roll was 1.6 mm.

Preparation of Undercoated Support

Preparation of Coating Solution A for Undercoating

To 200 ml of polyester copolymer water-based dispersion Pesresin A-515GB (30 wt %, manufactured by Takamatsu Yushi Co., Ltd.) were added 1 g of polystyrene fine particles (average diameter: 0.2 μm), and 20 ml of Surfactant 1 (1 wt %). Distilled water was added to the above mixture to make the volume 1,000 ml, and this was designated coating solution A for undercoating.

Preparation of Coating Solution B for Undercoating

To 680 ml of distilled water were added 200 ml of styrene/butadiene copolymer water-based dispersion (styrene/butadiene/itaconic acid=47/50/3 (by weight), concentration: 30 wt %) and 0.1 g of polystyrene fine particles (average particle diameter: 2.5 μm), and further distilled water was added to the above mixture to make the volume 1,000 ml, and this was designated coating solution B for undercoating.

Preparation of Coating Solution C for Undercoating

Ten (10) grams of inert gelatin was dissolved in 500 ml of distilled water, and 40 g of water-based dispersion of fine particles of stannic oxide/antimony oxide composite (40 wt %) disclosed in JP-A-61-20033 was added thereto. Distilled water was added to the above mixture to make the volume 1,000 ml, and this was designated coating solution C for undercoating.

Preparation of Undercoated Support

On the support subjected to corona discharge treatment, coating solution A for undercoating was coated by means of a bar coater in a wet coating amount of 5 ml/m$^2$ and dried at 180° C. for 5 minutes. The dry film thickness was about 0.3 μm. The back surface of this support was subjected to corona discharge treatment, then coating solution B for undercoating was coated by means of a bar coater in a wet coating amount of 5 ml/m$^2$ so as to obtain the dry film thickness of about 0.3 μm, and dried at 180° C. for 5 minutes. Further, coating solution C for undercoating was coated thereon by means of a bar coater in a wet coating amount of 3 ml/m$^2$ so as to obtain the dry film thickness of about 0.03 μm, and dried at 180° C. for 5 minutes. Thus, the undercoated support was prepared.

Preparation of Organic Acid Silver Dispersion

While stirring 44.0 g of behenic acid (manufactured by Henkel Co., trade name: Edenor C22-85R), 730 ml of distilled water, and 60 ml of butanol at 79° C., 117 ml of 1 N NaOH aqueous solution was added thereto over 55 minutes and the mixture was allowed to reaction for 240 minutes. Then, 112.5 ml of an aqueous solution containing 19.2 g of silver nitrate was added thereto over 45 seconds and the solution was allowed to stand for 20 minutes, and then the temperature was lowered to 30° C. The solid content was then filtered by suction. The solid content was washed with water until the conductivity of the filtrate reached 30 μS/cm. The thus-obtained solid content was not dried and treated as a wet cake. Seven point four (7.4) grams of polyvinyl alcohol (trade name: PVA-205) and water were added to the wet cake of the amount corresponding to 100 g of dried solid content to make the entire amount 385 g, and then preliminarily dispersed in a homomixer.

The preliminarily dispersed starting solution was treated three times using a disperser (trade name: Micro-fluidizer M-110S-EH equipped with G10Z interaction chamber, manufactured by Micro Fluidex International Corp.). Pressure of the disperser was adjusted to 1,750 kg/cm$^2$. Thus, silver behenate dispersion B was obtained. Silver behenate particles contained in the thus-obtained silver behenate dispersion were needle shape particles having an average short axis length of 0.04 $\mu$m, average long axis length of 0.8 $\mu$m, and variation coefficient of 30%. Particle size was measured by Master Sizer X (manufactured by Malvern Instruments Ltd.). Coiled heat exchangers were respectively installed before and after the interaction chamber. The desired temperature of dispersion was set by adjusting the temperature of the cooling medium.

Preparation of 25 wt % Dispersion of Reducing Agent

Water (220 g) was added to 100 g of 1,1-bis(2-hydroxy-3,5-dimethylphenyl)-3,5,5-trimethylhexane and 80 g of a 20 wt % aqueous solution of modified polyvinyl alcohol Poval MP203 (manufactured by Kuraray Co., Ltd.), and thoroughly mixed to make a slurry. Zirconia beads (1,000 g) having an average diameter of 0.5 mm were added to a reaction vessel with the above-obtained slurry and dispersed in a disperser (¼ G sand grinder mill, manufactured by Imex Co., Ltd.) for 3 hours, thereby the dispersion of the reducing agent was obtained. The particles of the reducing agent contained in the thus-obtained reducing agent dispersion had an average diameter of 0.65 $\mu$m.

Preparation of 20 wt % Dispersion of Mercapto Compound

Water (280 g) was added to 80 g of 3-mercapto-4-phenyl-5-heptyl-1,2,4-triazole and 40 g of a 20 wt % aqueous solution of modified polyvinyl alcohol Poval MP203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 15 hours, thereby the dispersion of the mercapto compound was obtained. The particles of the mercapto compound contained in the thus-obtained mercapto compound dispersion had an average particle diameter of 0.54 m.

Preparation of 30 wt % Dispersion of Organic Polyhalogen Compound

Water (224 g) was added to 48 g of tribromomethylphenylsulfone, 48 g 3-tribromomethylsulfonyl-4-phenyl-5-tridecyl-1,2,4-triazole, and 48 g of a 20 wt % aqueous solution of modified polyvinyl alcohol Poval MP203 (manufactured by Kuraray Co., Ltd.), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 5 hours, thereby a dispersion of the organic polyhalogen compound was obtained. The particles of the polyhalogen compound contained in the thus-obtained polyhalogen compound dispersion had an average particle diameter of 0.70 $\mu$m.

Preparation of 10 wt % Aqueous Solution of Compound 1-1

Compound 1-1 (50 g) according to the present invention was dissolved in 450 g of distilled water.

Aqueous solutions of other compounds listed in Table I-1 represented by formula (I-1) according to the present invention can also be prepared in the same manner.

Preparation of Methanol Solution of Phthalazine Compound

6-Isopropylphthalazine (26 g) was dissolved in 100 ml of methanol and used.

Preparation of 20 wt % Dispersion of Pigment

Water (250 g) was added to 64 g of C.I. Pigment Blue 60 and 6.4 g of Demol N (manufactured by Kao Corporation), and thoroughly mixed to make a slurry. Zirconia beads (800 g) having an average diameter of 0.5 mm were added to a reaction vessel with the above-obtained slurry and dispersed in a disperser (¼ G sand grinder mill, manufactured by Imex Co., Ltd.) for 25 hours, thereby the dispersion of the pigment was obtained. The particles of the pigment contained in the thus-obtained pigment dispersion had an average particle diameter of 0.21 $\mu$m.

Preparation of Silver Halide Grains 1

To 1,421 ml of distilled water was added 6.7 ml of a 1 wt % of potassium bromide solution, further 8.2 ml of 1 N nitric acid and 21.8 g of phthalated gelatin were added. This mixed solution was stirred in a titanium-coated stainless reaction vessel with maintaining the temperature at 35° C. Solution al (37.04 g of silver nitrate was diluted with distilled water to make 159 ml) and solution b1 (32.6 g of potassium bromide was diluted with distilled water to make 200 ml) were prepared. The entire amount of solution al was added to the reaction vessel at a constant flow rate by a controlled double jet method with maintaining pAg at 8.1 over 1 minute (solution b1 was added by a controlled double jet method). Then, 30 ml of a 3.5 wt % hydrogen peroxide aqueous solution was added, further, 36 ml of a 3 wt % benzimidazole aqueous solution was added. Solution a2 (solution a1 was again diluted with distilled water to make 317.5 ml) and solution b2 (dipotassium hexachloroiridate was dissolved so as to make $1\times10^{-4}$ mol per mol of the silver of solution b1, diluted with distilled water to reach the final volume of 2 times of solution b1, i.e., 400 ml) were prepared. The entire amount of solution a2 was added to the reaction vessel at a constant flow rate by a controlled double jet method with maintaining pAg at 8.1 over 10 minutes (solution b2 was added by a controlled double jet method). Then, 50 ml of a methanol solution of 0.5 wt % 2-mercapto-5-methylbenzimidazole was added, further, pAg was raised to 7.5 with silver nitrate, pH was adjusted with 1 N sulfuric acid to 3.8, and stirring was stopped. The reaction solution was subjected to precipitation, desalting and washing processes, 3.5 g of deionized gelatin was added, and 1 N sodium hydroxide was added to adjust pH to 6.0 and pAg to 8.2, thereby silver halide dispersion was obtained.

The grains in thus-prepared silver halide emulsion were pure silver bromide grains having an average equivalent-sphere diameter of 0.031 $\mu$m and equivalent-sphere diameter variation coefficient of 11%. Grain size was average of 1,000 grains obtained by electron microscope. {100} Plane ratio of this grain was 85% according to the Kubelka-Munk method.

The temperature of the above emulsion was raised to 50° C. with stirring, then 5 ml of a 0.5 wt % methanol solution of N,N'-dihydroxy-N",N"-diethylmelamine and 5 ml of a 3.5 wt % methanol solution of phenoxyethanol were added thereto, and 1 minute after, $3\times10^{-5}$ mol per mol of the silver of sodium benzenethiosulfonate was added. Further 2 minutes after, solid dispersion of spectral sensitizing dye 1 (a gelatin aqueous solution) was added in an amount of $5\times10^{-3}$ mol per mol of the silver, and further 2 minutes after, $5\times10^{-5}$ mol per mol of the silver of a tellurium compound was added and the reaction solution was subjected to ripening for 50 minutes. Immediately before completion of ripening, 2-mercapto-5-methylbenzimidazole was added in an amount of $1\times10^{-3}$ mol per mol of the silver. The temperature was lowered and chemical sensitization was terminated. Thus, silver halide grain 1 was prepared.

Preparation of Silver Halide Grain 2

Phthalated gelatin (22 g) and 30 mg of potassium bromide were dissolved in 700 ml of water, pH was adjusted to 5.0 at 35° C. An aqueous solution (159 ml) containing 18.6 g of silver nitrate and 0.9 g of ammonium nitrate, and an aqueous solution containing potassium bromide and potassium iodide in a ratio of 92/8 were added to the foregoing solution by a controlled double jet method over 10 minutes with maintaining pAg at 7.7. Subsequently, 476 ml of an aqueous solution containing 55.4 g of silver nitrate and 2 g of ammonium nitrate, and 1 liter of an aqueous solution containing $1\times10^{-5}$ mol of dipotassium hexachloroiridate and 1 mol of potassium bromide were added to the foregoing solution by a controlled double jet method over 30 minutes with maintaining pAg at 7.7. Subsequently, 1 g of 4-hydroxy-6-methyl-1,3,3a,7-tetraazaindene was added thereto, and then pH value was lowered, and the reaction solution was subjected to coagulation precipitation, and desalted. Then, 0.1 g of phenoxyethanol was added to adjust pH to 5.9 and pAg to 8.2, thereby the preparation of silver iodobromide grains was terminated. The thus-obtained silver halide grains were cubic grains having an iodine content: core 8 mol %, average 2 mol %, average grain size: 0.05 μm, projected area variation coefficient: 8%, and {100} plane ratio: 88%.

The temperature of the thus-obtained silver halide grains was raised to 60° C., 85 μmol of sodium thiosulfate, $1.1\times10^{-5}$ mol of 2,3,4,5,6-pentafluorophenyldiphenylphosphineselenide, $1.1\times10^{-5}$ mol of a tellurium compound, $3.5\times10^{-8}$ mol of chloroauric acid, and $2.7\times10^{-4}$ mol of thiocyanic acid were added to the above silver halide grains and ripened for 120 minutes, then rapidly cooled to 40° C. Spectral sensitizing dye 1 in an amount of $1\times10^{-4}$ mol and 2-mercapto-5-methylbenzimidazole in an amount of $5\times10^{-4}$ mol were added thereto and the reaction solution was rapidly cooled to 30° C. to thereby obtain silver halide emulsion 2.

Preparation of Coating Solution for Emulsion Layer

Coating Solution for Emulsion Layer

The above-obtained organic acid silver dispersion (100 g) and 5 g of a 20 wt % aqueous solution of polyvinyl alcohol PVA-205 (manufactured by Kuraray Co., Ltd.) were mixed and maintained at 40° C. The above-prepared 25 wt % reducing agent dispersion (25.4 g), 1.2 g of a 20 wt % water dispersion of C.I. Pigment Blue 60, each of the compound according to the present invention shown in Table I-1, 11.5 g of a 30 wt % dispersion of organic polyhalogen compound, and 3.5 g of a 20 wt % dispersion of mercapto compound were added to the above mixed solution. After that, 110 g of 40 wt % SBR latex purified by ultrafiltration (UF) and maintained at 40° C. was added thereto and stirred thoroughly, 6 ml of a methanol solution of a phthalazine compound was then added, thereby a solution containing an organic acid silver was obtained. Five (5) grams of silver halide grain 1 and 5 g of silver halide grain 2 had been previously mixed thoroughly, then this solution was mixed with the organic acid silver-containing solution in a static mixer immediate before coating to thereby prepare an emulsion layer coating solution. This coating solution was fed to a coating die in a coating silver amount of 1.4 g/m$^2$.

The above emulsion layer coating solution was revealed to have viscosity of 85 (mPa·s) at 40° C. (No. 1 rotor) measured by Model B viscometer (manufactured by Tokyo Keiki Co., Ltd.). The viscosity of the coating solution measured by RFS Fluid Spectrometer (manufactured by Rheometrics Far East Co.) at 25° C. was 1,500, 220, 70, 40, 20 (mPa·s) at shear rate of 0.1, 1, 10, 100, 1,000 (1/sec), respectively.

Further, UF purified SBR latex was obtained in the following manner.

SBR latex shown below was diluted with distilled water to 10 times, and purified by module FS03-FC-FUY03A1 for UF-purification (Daisen Membrane System Co., Ltd.) until the ionic conductivity becomes 1.5 mS/cm. The concentration of the latex at this time was 40 wt %.

SBR Latex

Latex of -St (68)-Bu (29)-AA (3)-Average particle size: 0.1 μm, equilibrium moisture content at 25° C. 60% RH: 0.6 wt %, concentration: 45 wt %, ionic conductivity: 4.2 mS/cm (ionic conductivity was measured using a conductometer CM-30S (manufactured by Toa Denpa Kogyo Co., Ltd., starting solution of the latex (40 wt %) was measured at 25° C.), pH: 8.2

Preparation of Interlayer Coating Solution of Emulsion Surface

Preparation of Interlayer Coating Solution

To 772 g of a 10 wt % aqueous solution of polyvinyl alcohol PVA-205 (manufactured by Kuraray Co., Ltd.) and 226 g of a 27.5 wt % solution of latex of methyl methacrylate/styrene/2-ethylhexyl acrylate/hydroxyethyl methacrylate/acrylic acid copolymer (copolymerization weight ratio: 59/9/26/5/1) were added 2 ml of a 5 wt % aqueous solution of Aerosol OT (manufactured by American Cyanamide Co.), 4 g of benzyl alcohol, 1 g of 2,2,4-trimethyl-1,3-pentanediol monoisobutyrate, and 10 mg of benzisothiazolinone to make an interlayer coating solution. The coating solution was fed to a coating die so as to reach the coating amount of 5 ml/m$^2$.

The viscosity of the coating solution was 21 (mPa·s) at 40° C. (No. 1 rotor) measured by Model B viscometer.

Preparation of Coating Solution for First Emulsion Surface

Protective Layer

First Protective Layer Coating Solution

Inert gelatin (80 g) was dissolved in water, 28 ml of 1 N sulfuric acid, 5 ml of a 5 wt % aqueous solution of Aerosol OT (manufactured by American Cyanamide Co.), and 1 g of phenoxyethanol were added thereto. Water was added to make the total amount 1,000 g, thereby a first protective layer coating solution was obtained. The coating solution was fed to a coating die in coating amount of 10 ml/m$^2$.

The viscosity of the coating solution was 17 (mPa·s) at 40° C. (No. 1 rotor) measured by Model B viscometer.

Preparation of Coating Solution for Second Emulsion Surface

Protective Layer

Second Protective Layer Coating Solution

Inert gelatin (100 g) was dissolved in water, 20 ml of a 5% solution of potassium N-perfluorooctylsulfonyl-N-propylalanine, 16 ml of a 5 wt % aqueous solution of Aerosol OT (manufactured by American Cyanamide Co.), 25 g of polymethyl methacrylate fine particles (average particle size: 4.0 $\mu$m), 44 ml of 1 N sulfuric acid, and 10 mg of benzisothiazolinone were added thereto. Water was added to make the total amount 1,555 g, then 445 ml of an aqueous solution containing 4 wt % of chrome alum and 0.67 wt % of phthalic acid was mixed using a static mixer immediately before coating, thereby a second protective layer coating solution was obtained. The coating solution was fed to a coating die in coating amount of 10 ml/m$^2$.

The viscosity of the coating solution was 10 (mPa·s) at 40° C. (No. 1 rotor) measured by Model B viscometer.

Preparation of Back Coating Layer

Preparation of Solid Fine Particle Dispersion Solution of Basic Precursor

A basic precursor compound (64 g) and 10 g of surfactant Demol N (manufactured by Kao Corporation) were mixed with 246 ml of distilled water. The mixed solution was dispersed using beads in a sand mill (¼ Gallon sand grinder mill, manufactured by Imex Co., Ltd.), thereby a solid fine particle dispersion solution of a basic precursor having an average particle size of 0.2 $\mu$m was obtained.

Preparation of Solid Fine Particle Dispersion Solution of Dye

A cyanine dye compound (9.6 g) and 5.8 g of sodium p-alkylbenzenesulfonate were mixed with 305 ml of distilled water. The mixed solution was dispersed using beads in a sand mill (¼ Gallon sand grinder mill, manufactured by Imex Co., Ltd.), thereby the solid fine particle dispersion solution of the dye having an average particle size of 0.2 $\mu$m was obtained.

Preparation of Antihalation Layer Coating Solution

Gelatin (16.5 g), 9.6 g of polyacrylamide, 70 g of the above solid fine particle dispersion solution of the basic precursor, 56 g of the above solid fine particle dispersion solution of the dye, 1.5 g of polymethyl methacrylate fine particles (average particle size: 6.5 $\mu$m), 2.2 g of sodium polyethylenesulfonate, 0.2 g of a 1 wt % aqueous solution of colored dye compound, and 844 ml of $H_2O$ were mixed. Thus, an antihalation layer coating solution was prepared.

Preparation of Protective Layer Coating Solution

To a reaction vessel maintained at 40° C. were added and mixed 50 g of gelatin, 0.2 g of sodium polystyrenesulfonate, 2.4 g of N,N'-ethylenebis(vinyl sulfone acetamide), 1 g of sodium t-octylphenoxyethoxyethanesulfonate, 30 mg of benzisothiazolinone, 32 mg of $C_8F_{17}SO_3K$, 64 mg of $C_8F_{17}SO_2N(C_3H_7)—(CH_2CH_2O)_4(CH_2)_4—SO_3Na$, and 950 ml of $H_2O$ to prepare a protective layer coating solution.

The structures of the compounds used above are shown below.

Surfactant 1

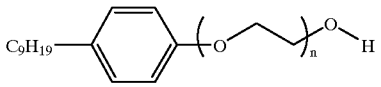

n = about 8.5

Spectral Sensitizing Dye 1

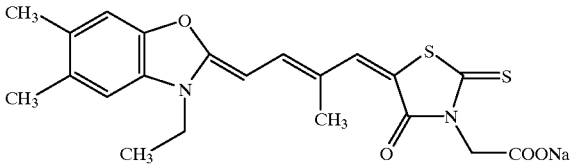

Tellurium Compound

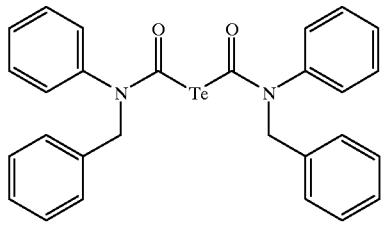

-continued

Basic Precursor Compound

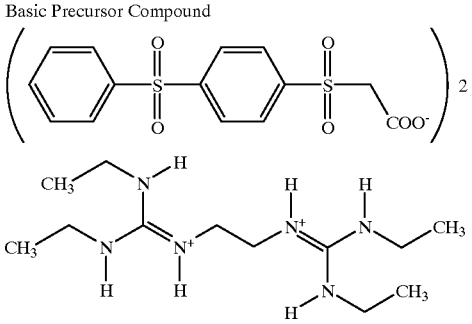

Cyanine Dye Compound

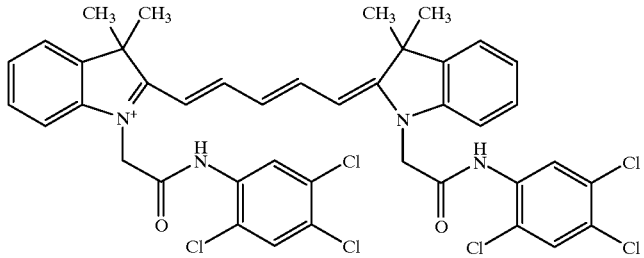

Colored Dye Compound

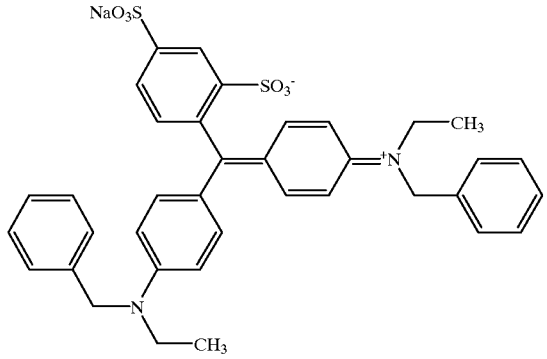

Preparation of Photothermographic Material

On the above undercoated support, the antihalation layer coating solution and the protective layer coating solution were simultaneously multilayer-coated and dried in such a manner that the coating amount of the solid content of the solid fine particle dye of the antihalation layer coating solution became 0.04 g/m$^2$ and the gelatin coating amount of the protective layer coating solution became 1 g/m$^2$. After the antihalation backing layer was formed, an emulsion layer, an interlayer, a first protective layer and a second protective layer were simultaneously multilayer-coated by slide bead coating on the opposite side of the backing layer side in this order from the undercoating side, thereby the heat-developable photosensitive material was prepared. After the back side was coated, emulsion side was coated without winding.

Coating speed was 160 m/min. The distance between the tip of the coating die and the support was 0.18 mm. The pressure in the low pressure chamber was set lower than atmospheric pressure by 392 Pa. In the subsequent chilling zone, air of dry-bulb temperature of 18° C. and wet-bulb temperature of 12° C. was blown at 7 m/sec for 30 seconds. After the coating solution was dried, dry air of dry-bulb temperature of 30° C. and wet-bulb temperature of 18° C. was blown at helical floating type drying zone at blowout wind speed from the hole of 20 m/second for 20 seconds, thereby the solvent in the coating solution was evaporated.

Photosensitive material 1 in which a 10 wt % aqueous solution of 4-n-hexyloxyphthalic acid was added to the emulsion coating solution, and photosensitive material 2 in which an aqueous solution of 4-hydroxyphthalic acid was added to the emulsion coating solution were prepared as comparative samples respectively.

Each photosensitive material was evaluated. The results obtained are shown in Table I-1.

Evaluation of Photoaraphic Properties

After each sample was exposed using a 647 nm Kr laser (maximum output: 500 mW) with forming an angle of inclination by 30° with normal line, each sample was developed at 120° C. for 15 seconds. Evaluation of the obtained sample was performed using a densitometer. The results of measurement was evaluated by Dmin (fog), sensitivity (the reciprocal of the exposure amount giving the density higher than Dmin by 1.0). The sensitivity of Sample No. 3 was taken as 100.

The image tone falling into the range of density 1 was visually evaluated based on the following criteria.

⊙: Blue black tone

○: A little warm tone but negligible

Δ: Considerably warm tone but practicable

X: Remarkably warm tone and impracticable

Evaluation of Forcedly Aged Storage Stability

Each sample was cut to 30.5 cm×25.4 cm, and corners were made round corners each having inside diameter of 0.5 cm, and allowed to stand at 25° C. 50% RH for one day. Samples were stored in a moisture-proof bag and sealed, ten sheets to every one bag. The bag was stored in a box of 35.1 cm×26.9 cm×3.0 cm and stored at 50° C. for 5 days (forced aging). For comparison, samples were subjected to the same procedure except that the storage temperature was 4° C., and fog density was determined. Aging storage was evaluated as fog increase.

(Fog increase)=(fog of the sample forcedly aged)−(fog of comparative sample)

The lower the fog increase, the better is the storage stability.

Evaluation of Storage Stability of Image Subjected to Light Irradiation

Photographic sample exposed and developed in the same manner as in evaluation of photographic properties was stuck on the inside of the window exposed to direct rays of the sun and allowed to stand for one month. The image of one month after was visually evaluated based on the following criteria.

⊙: No change was observed.

○: Tone was a little changed but negligible

Δ: Discoloration was observed in image but practicable

X: Dmin was discolored, fog was increased and impracticable

Evaluation of Image Storage Stability under Dark

After the photographic sample exposed and developed in the same manner as in evaluation of photographic properties was allowed to stand at 40° C. for one month under dark, the state of the photograph was visually evaluated based on the following criteria.

⊙: No change was observed.

○: Tone was a little changed but negligible

Δ: Discoloration was observed in image but practicable

X: Dmin was discolored, fog was increased and impracticable

From the results in Table I-1, the effect of the present invention is apparent.

TABLE I-1

| Sample No. | Compound of the Invention | Addition Amount (mmol/m$^2$) | Sensitivity | Fog | Tone | Fog after Forced Aging | Storage Stability with Light Irradiation | Storage Stability under Dark | Remarks |
|---|---|---|---|---|---|---|---|---|---|
| 1 | 4-n-hexyloxy-phthalic acid | 0.8 | 80 | 0.09 | Δ | 0.12 | Δ | Δ | Comparison |
| 2 | 4-hydroxy-phthalic acid | 0.8 | 97 | 0.08 | Δ | 0.60 | X | X | Comparison |
| 3 | 1-1 | 0.8 | 100 | 0.09 | ⊙ | 0.10 | ○ | ○ | Invention |
| 4 | 1-1 | 1.6 | 105 | 0.09 | ⊙ | 0.11 | ⊙ | ⊙ | Invention |
| 5 | 1-3 | 0.8 | 100 | 0.11 | ⊙ | 0.13 | ○ | ○ | Invention |
| 6 | 1-3 | 1.5 | 108 | 0.10 | ⊙ | 0.10 | ⊙ | ⊙ | Invention |
| 7 | 1-5 | 0.8 | 100 | 0.12 | ⊙ | 0.12 | ⊙ | ○ | Invention |
| 8 | 1-11 | 0.8 | 100 | 0.10 | ○ | 0.11 | ○ | ○ | Invention |
| 9 | 1-9 | 0.8 | 100 | 0.10 | ⊙ | 0.11 | ⊙ | ⊙ | Invention |
| 10 | 1-23 | 0.8 | 100 | 0.10 | ⊙ | 0.11 | ⊙ | ⊙ | Invention |

EXAMPLE I-2

Preparation of Silver Halide Emulsion

Emulsion A

Phthalated gelatin (11 g), 30 mg of potassium bromide and 10 mg of sodium benzenethiosulfonate were dissolved in 700 ml of water, pH was adjusted to 5.0 at 55° C. An aqueous solution (159 ml) containing 18.6 g of silver nitrate, and an aqueous solution containing potassium bromide in an amount of 1 mol per liter were added to the foregoing solution by a controlled double jet method over 6 minutes and 30 seconds with maintaining pAg at 7.7. Subsequently, 476 ml of an aqueous solution containing 55.5 g of silver nitrate, and a halide aqueous solution containing potassium bromide in an amount of 1 mol per liter were added to the foregoing solution by a controlled double jet method over 28 minutes and 30 seconds with maintaining pAg at 7.7. Then, pH value was lowered, and the reaction solution was subjected to coagulation precipitation, and desalted. Then, 0.17 g of compound A and 23.7 g of deionized gelatin (calcium content: 20 ppm or less) were added to adjust pH to 5.9 and pAg to 8.0. The obtained grains were cubic grains having an average grain sizer of 0.11 μm, projected area variation coefficient of 8%, and {100} plane ratio of 93%.

The temperature of the thus-obtained silver halide grains was raised to 60° C. and 76 μmol of sodium benzenethiosulfonate was added and 3 minutes after, 154 μm of sodium thiosulfate was added and ripening was conducted for 100 minutes.

Subsequently, $6.4\times10^{-4}$ mol of sensitizing dye A and $6.4\times10^{-3}$ mol of compound B, each per mol of the silver halide, were added with stirring. After 20 minutes, the temperature was rapidly cooled to 30° C., thus the preparation of silver halide emulsion A was terminated.

Sensitizing Dye A

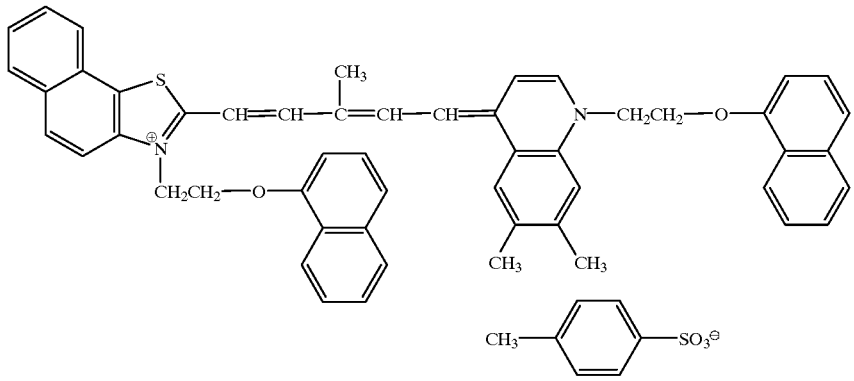

Compound A

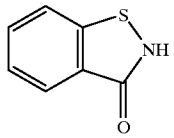

Compound B

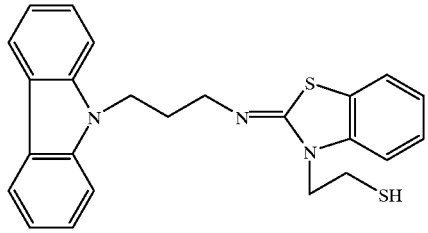

Preparation of Organic Acid Silver Dispersion

Organic Acid Silver A

Six point one (6.1) grams of arachic acid, 37.6 g of behenic acid, 700 ml of distilled water, 70 ml of tert-butanol, and 123 ml of a 1 N NaOH aqueous solution were mixed, stirred at 75° C. for 1 hour to continue the reaction, then the temperature was lowered to 65° C. Subsequently, 112.5 ml of an aqueous solution containing 22 g of silver nitrate was added to the reaction solution over 45 seconds, allowed to stand for 5 minutes, and the temperature was lowered to 30° C. The solid content was then filtered by suction filtration, and the solid content was washed with water until the conductivity of the filtrate reached 30 μS/cm. The thus-obtained solid content was not dried and treated as a wet cake. Five (5) grams of polyvinyl alcohol (trade name: PVA-205) and water were added to the wet cake of the amount corresponding to 100 g of dried solid content to make the entire amount 500 g, and then preliminarily dispersed in a homomixer.

The preliminarily dispersed starting solution was treated three times using a disperser (trade name: Micro-fluidizer M-110S-EH equipped with G10Z interaction chamber, manufactured by Micro Fluidex International Corp.). Pressure of the disperser was adjusted to 1,750 kg/cm$^2$. Thus, organic acid silver dispersion A was obtained. Organic acid silver particles contained in the thus-obtained organic acid silver dispersion were needle shape particles having an average short axis length of 0.04 μm, average long axis length of 0.8 μm, and variation coefficient of 30%. Particle size was measured by Master Sizer X (manufactured by Malvern Instruments Ltd.). Coiled heat exchangers were respectively installed before and after the interaction chamber. The desired temperature of dispersion was set by adjusting the temperature of the cooling medium. Thus, organic acid silver A containing 85 mol % of silver behenate was prepared.

Preparation of Solid Fine Particle Dispersion of 1,1-bis(2-Hydroxy-3,5-dimethylphenyl)-3,5,5-trimethylhexane Three point zero (3.0) grams of MP polymer MP-203 (manufactured by Kuraray Co., Ltd.) and 77 ml of water were added to 20 g of 1,1-bis(2-hydroxy-3,5-dimethylphenyl)-3,5,5-trimethylhexane and thoroughly mixed to make a slurry. The slurry was allowed to stand for three hours. Zirconia beads (360 g) having an average diameter of 0.5 mm were added to a reaction vessel together with the above slurry and dispersed in a disperser (¼ G sand grinder mill, manufactured by Imex Co., Ltd.) for 3 hours, thereby a solid fine particle dispersion of the reducing agent was obtained. Eighty (80) wt % of the particles contained in the dispersion had an average diameter of from 0.3 μm to 1.0 μm.

Preparation of Solid Fine Particle Dispersion of Tribromomethylphenylsulfone

Hydroxypropylmethyl cellulose (0.5 g), 0.5 g of compound C and 88.5 g of water were added to 30 g of tribromomethylphenylsulfone and thoroughly mixed to make a slurry. The slurry was allowed to stand for three hours. After that, a solid fine particle dispersion of an antifoggant was prepared in the same manner as the preparation of the solid fine particle dispersion of the reducing agent. Eighty (80) wt % of the thus-obtained particles had an average diameter of from 0.3 μm to 1.0 μm.

Preparation of Coating Solution for Emulsion Layer

The emulsion layer coating solution was prepared by adding the following binder, compositions, and silver halide emulsion A in the amount per mol of the silver of the above-prepared organic acid silver crystal dispersion.

| | |
|---|---|
| Binder (LACSTAR 3307B, SBR latex glass transition temperature: 17° C., manufactured by Dainippon Chemicals & Ink Co., Ltd.) | 470 g (as solid content) |
| 1,1-bis(2-Hydroxy-3,5-dimethylphenyl)-3,5,5-trimethylhexane | 110 g (as solid content) |
| Tribromomethylphenylsulfone | 25 g (as solid content) |
| Polyvinyl alcohol (MP-203, manufactured by Kuraray Co., Ltd.) | 46 g |
| 6-iso-Butylphthalazine | 0.12 mol |
| Dye A | 0.62 g |
| Silver halide emulsion A | 0.05 mol (as silver amount) |
| Nucleating agent 1, 2 or 3 | $2 \times 10^{-3}$ mol/mol-Ag |

Compound C

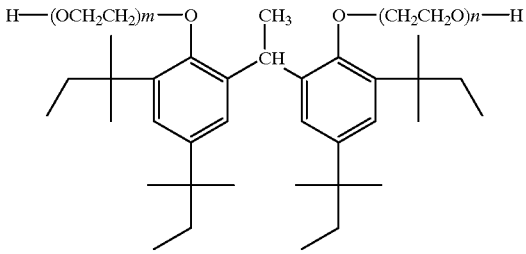

m + n = 27

Dye A

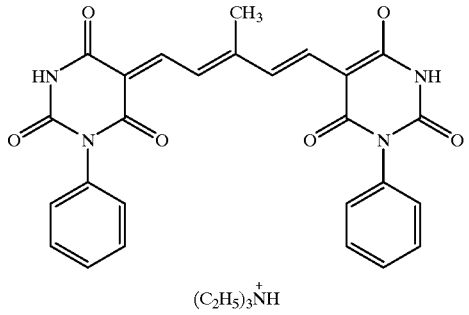

Nucleating Agents

1

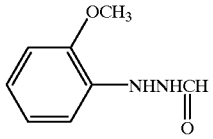

2

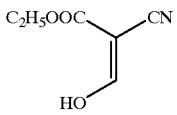

-continued

3

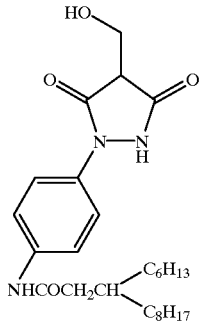

(equal to Compound C-42)

Preparation of Coating Solution for Emulsion Surface

Protective Layer

To 109 g of a polymer latex of a solid content of 27.5 wt % (a copolymer of methyl methacrylate/styrene/2-ethylhexyl acrylate/2-hydroxyethyl methacrylate/acrylic acid=59/9/26/5/1 having a glass transition temperature of 55° C.) was added 3.75 g of $H_2O$. As film-forming aids, 4.5 g of benzyl alcohol, 0.45 g of compound D, 0.125 g of compound E, 0.0125 mol of compound F, and 0.225 g of polyvinyl alcohol (PVA-217, manufactured by Kuraray Co., Ltd.) were added thereto, and $H_2O$ was further added to make the volume 150 g. Thus, the coating solution for emulsion surface protective layer was obtained.

Compound D

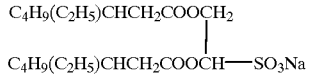

Compound E

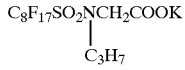

Compound F

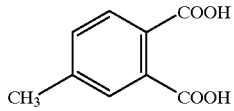

Preparation of PET Support Provided with Back/Undercoating Layer (1) Support

PET having an intrinsic viscosity IV=0.66 (measured in phenol/tetrachloroethane (6/4 by weight) at 25° C.) was obtained according to an ordinary method using terephthalic acid and ethylene glycol. After the obtained PET was pelletized and dried at 130° C. for 4 hours, melted at 300° C., extruded from T-die, and rapidly cooled, thereby an stretched film having a film thickness after thermal fixation of 120 μm was obtained.

The film was stretched to 3.3 times in the lengthwise direction with rollers having different peripheral speeds, then 4.5 times in the crosswise direction by means of a tenter. The temperatures at that time were 110° C. and 130° C. respectively. Subsequently, the film was subjected to thermal fixation at 240° C. for 20 seconds, then relaxation by 4% in the crosswise direction at the same temperature. The chuck part of the tenter was then slit, and both edges of the film were subjected to knurl treatment. The film was rolled under a tension of 4.8 kg/cm$^2$, thereby a roll of film having a breadth of 2.4 ml, a length of 3,500 m and a thickness of 120 $\mu$m was obtained.

| | |
|---|---|
| (2) Undercoating Layer (a) | |
| Polymer latex (1) (styrene/butadiene/hydroxyethyl methacrylate/divinylbenzene (67/30/2.5/0.5 (wt %)) | 160 mg/m$^2$ |
| 2,4-Dichloro-6-hydroxy-s-triazine | 4 mg/m$^2$ |
| Matting agent (polystyrene, average particle size: 2.4 $\mu$m) | 3 mg/m$^2$ |
| (3) Undercoating Layer (b) | |
| Alkali-processed gelatin ($Ca^{2+}$ content: 30 ppm, jelly strength: 230 g) | 50 mg/m$^2$ |
| Dye A | coating amount giving optical density of 1.0 at 780 nm |
| (4) Electrically Conductive Layer | |
| JURIMER ET-410 (manufactured by Nihon Pure Chemical Co., Ltd.) | 96 mg/m$^2$ |
| Gelatin | 50 mg/m$^2$ |
| Compound A | 0.2 mg/m$^2$ |
| Polyloxyethylenephenyl ether | 10 mg/m$^2$ |
| Sumitex Resin M-3 (a water-soluble melamine compound, manufactured by Sumitomo Chemical Co., Ltd.) | 18 mg/m$^2$ |
| Dye A | coating amount giving optical density of 1.0 at 780 nm |
| $SnO_2$/Sb (9/1 by weight, acicular fine particles, long axis/short axis = 20 to 30, manufactured by Ishihara Sangyo Kaisha Ltd. | 120 mg/m$^2$ |
| Matting agent (polymethyl methacrylate, average particle diameter: 5 $\mu$m) | 7 mg/m$^2$ |
| (5) Protective Layer | |
| Polymer latex (2) (methyl methacrylate/styrene/2-ethylhexyl acrylate/2-hydroxyethyl methacrylate/acrylic acid = 59/9/26/5/1 (wt %)) | 1,000 mg/m$^2$ |
| Polystyrenesulfonate (molecular weight: 1,000 to 5,000) | 2.6 mg/m$^2$ |
| CELLOZOL 524 (manufactured by Chuo Yushi Co., Ltd.) | 30 mg/m$^2$ |
| Sumitex Resin M-3 (a water-soluble melamine compound, manufactured by Sumitomo Chemical Co., Ltd.) | 218 mg/m$^2$ |

Undercoating layer (a) and undercoating layer (b) were successively coated on one side of the support and coated at 180° C. for 4 minutes. An electrically conductive layer and a protective layer were subsequently coated on the side opposite to the side on which undercoating layer (a) and undercoating layer (b) were coated, dried at 180° C. for 30 seconds. Thus, a PET support having back/undercoating layers was prepared.

The above PET support having back/undercoating layers was let in a heat processing zone having an overall length of 30 m set at 150° C., traveled under its own weight at a tensile strength of 14 g/m$^2$ and a traveling rate of 20 m/minute, then passed through a zone of 40° C. for 15 seconds, and wound at a tensile strength of winding of 10 kg/cm$^2$.

Preparation of Photothermographic Image-Forming Material

The foregoing emulsion layer coating solution was coated on the undercoating layer of the PET support having back/undercoating layers in a silver coating amount of 1.6 g/m$^2$. Further, the above-prepared coating solution for an emulsion surface protecting layer was coated thereon in a polymer latex coating amount of 2.0 g/m$^2$.

Samples of photothermographic image-forming materials were prepared in the same manner as above, except that Compounds 1-1, 1-6, 1-9, 1-10, 1-15, 1-22 and 1-23 represented by formula (I-1) according to the present invention were respectively used in place of compound F used in the emulsion surface protecting layer each in an equimolar amount. Comparative samples in which compound F was replaced with 4-methoxyphthalic acid or 4-hexyloxyphthalic acid were also prepared.

Evaluation of Photographic Properties

Exposure Process

Each of the above-obtained coated samples was subjected to exposure by a xenon flash lamp having emission time of $10^{-6}$ sec. through an interference filter having a peak at 780 nm and stepwedge, and development process at 115° C. for 20 sec.

Evaluation was carried out in the same manner as in Example I-1. The samples according to the present invention were found to show high sensitivity, low fog and high density. Further, the storage stability and tone before and after image formation were also excellent.

On the other hand, the sample in which compound F was used showed high fog, in particular the sample containing 4-methoxyphthalic acid showed high fog and the sample containing 4-hexyloxyphthalic acid showed low density.

Further, the same results were obtained with respect to nucleating agents 1, 2 and 3.

EXAMPLE II-1

Emulsion coating solutions and photosensitive samples were prepared in the same manner as in Example I-1, except that the compounds according to the present invention were prepared as follows.

Preparation of 10 wt % Aqueous Solution of Compound 2-15

Compound 2-15 (50 g) was dissolved in 450 g of distilled water.

Aqueous solutions of other compounds listed in Table II-1 represented by formula (II-1) can also be prepared in the same manner.

Each of the thus-prepared samples was evaluated in the same manner as in Example I-1. The results obtained are shown in Table II-1.

The effect of the present invention is apparent from the results shown in Table II-1.

TABLE II-1

| Sample No. | Compound of the Invention | Addition Amount (mmol/m$^2$) | Sensitivity | Fog | Tone | Fog after Forced Aging | Storage Stability with Light Irradiation | Storage Stability under Dark | Remarks |
|---|---|---|---|---|---|---|---|---|---|
| 1 | 4-n-hexyloxy-phthalic acid | 0.8 | 80 | 0.09 | Δ | 0.12 | Δ | Δ | Comparison |
| 2 | 4-hydroxy-phthalic acid | 0.8 | 97 | 0.08 | Δ | 0.60 | X | X | Comparison |
| 3 | 2-1 | 0.8 | 100 | 0.09 | ◎ | 0.10 | ○ | ○ | Invention |
| 4 | 2-10 | 0.8 | 100 | 0.09 | ◎ | 0.11 | ○ | ○ | Invention |
| 5 | 2-10 | 1.0 | 103 | 0.11 | ◎ | 0.12 | ◎ | ◎ | Invention |
| 6 | 2-10 | 1.2 | 108 | 0.11 | ◎ | 0.10 | ◎ | ◎ | Invention |
| 7 | 2-15 | 0.8 | 100 | 0.10 | ○ | 0.12 | ◎ | ○ | Invention |
| 8 | 2-15 | 1.5 | 100 | 0.12 | ◎ | 0.11 | ◎ | ◎ | Invention |
| 9 | 2-19 | 0.8 | 100 | 0.10 | ◎ | 0.11 | ◎ | ◎ | Invention |
| 10 | 2-22 | 0.8 | 100 | 0.10 | ◎ | 0.11 | ◎ | ◎ | Invention |

EXAMPLE II-2

Samples of photothermographic image-forming materials were prepared in the same manner as in Example I-2, except that Compounds 2-1, 2-7, 2-10, 2-12, 2-14, 2-15, 2-16, 2-18 and 2-22 represented by formula (II-1) according to the present invention were respectively used in place of compound F used in the emulsion surface protecting layer each in an equimolar amount. Comparative samples in which compound F was replaced with 4-methoxyphthalic acid or 4-hexyloxyphthalic acid were also prepared.

Photographic properties of each of the thus-prepared photothermographic image-forming samples were evaluated in the same manner as in Example I-2.

As a result, the same excellent results as in Example II-1 could also be obtained when the compounds represented by formula (II-1) of the present invention were used.

EXAMPLE III-1

Light-sensitive material A was prepared in the same manner as Sample No. 8 in Example II-1 with the exception that the preparation of organic acid silver salts dispersion was changed to ones prepared by the following methods.

Preparation of Fatty Acid Silver Salt A

Behenic acid (trade name: Edenor C22-85R) (87.6 g) manufactured by Henckel Co., 423 ml of distilled water, 49.2 ml of a 5 N aqueous solution of NaOH and 120 ml of tert-butanol were mixed, and stirred at 75° C. for 1 hour to conduct the reaction, thereby obtaining a sodium behenate solution. Separately, 206.2 ml of an aqueous solution containing 40.0 g of silver nitrate (pH 4.0) was prepared, and the temperature thereof was kept at 10° C. A reaction vessel in which 635 ml of distilled water and 30 ml of tert-butanol were placed was kept at a temperature of 30° C., and the sodium behenate solution previously prepared and the aqueous solution of silver nitrate were wholly added thereto at a constant flow rate for 62 minutes and 10 seconds and for 60 minutes, respectively. At this time, only the aqueous solution of silver nitrate was added for 7 minutes and 20 seconds after the start of addition of the aqueous solution of silver nitrate. Thereafter, addition of the sodium behenate solution was started, and only the sodium behenate solution was added for 9 minutes and 30 seconds after addition of the aqueous solution of silver nitrate was completed. At this time, the temperature in the reaction vessel was adjusted to 30° C., and the temperature of the outside was controlled so that the liquid temperature was not elevated. Further, a pipe of an addition system of the sodium behenate solution was lagged with steamed jacket, and the opening of a valve for steam was controlled so that the liquid temperature at an outlet of a tip of an addition nozzle became 75° C. Further, a pipe of an addition system of the aqueous solution of silver nitrate was lagged by circulating cool water in the outer space of a double pipe. A position of adding the sodium behenate solution and a position of adding the aqueous solution of silver nitrate are arranged symmetrically centered on a stirring shaft, and at such a height that they do not come into contact with the reaction solution.

After addition of the sodium behenate solution was completed, the solution was allowed to stand with stirring for 20 minutes at a temperature left as it was, and then, the temperature was lowered to 25° C. Then, solid matter was filtered by suction filtration, and washed with water until a filtrate showed a conductivity of 30 μS/cm. Thus, fatty acid silver salt A was obtained. The resulting solid matter was not dried and stored as a wet cake.

The shape of the resulting silver behenate particles was evaluated taking electron photomicrographs. As a result, the silver behenate particles were crystals in a scale shape having an average equivalent-sphere diameter of 0.52 μm, an average long side/short side of 1.5, an average aspect ratio of 5.1, an average particle thickness of 0.14 μm and a coefficient of variation of equivalent-sphere diameters of 15%.

As a result, the excellent effect of the present invention could be obtained in Light-sensitive material A similar to Sample No. 8 in Example II-1.

EFFECT OF THE INVENTION

According to the present invention, an image having high sensitivity, low fog and blue black tone can be formed, and a photothermographic or thermographic image-forming material excellent in the storage stability before and after image formation and good in handling property can be obtained.

While the invention has been described in detail and with reference to specific examples thereof, it will be apparent to one skilled in the art that various changes and modifications can be made therein without departing from the spirit and scope thereof.

What is claimed is:

1. An image-forming material comprising a support and a constituent layer(s) comprising at least (a) a thermographic image-forming layer containing a reducible silver salt, a reducing agent of the reducible silver salt and a binder or (b) a photothermographic image-forming layer containing a light-sensitive silver halide as a photocatalyst, reducible silver salt, a reducing agent of the reducible silver salt and a binder, wherein the image-forming material comprises a compound represented by formula (I-1) or (II-1) in at least one constituent layer:

(I-1)

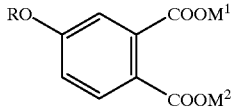

wherein R represents a secondary alkyl group or a cycloalkyl group; and $M^1$ and $M^2$ each represents a hydrogen atom, an alkali metal ion or an ammonium ion;

(II-1)

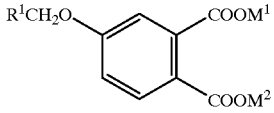

wherein $R^1$ represents a secondary alkyl group, a cycloalkyl group, an aryl group, or a primary alkyl group substituted with a substituent bonded via a hetero atom selected from the group consisting of an oxygen atom, a nitrogen atom and a sulfur atom; and $M^1$ and $M^2$ each represents a hydrogen atom, an alkali metal ion or an ammonium ion.

2. The image-forming material as claimed in claim 1, wherein the constituent layer(s) comprises at least (b) the photothermographic layer.

3. The image-forming material as claimed in claim 1, wherein the compound is represented by formula (II-1).

4. The image-forming material as claimed in claim 1, wherein the constituent layer contains a nucleating agent.

5. The image-forming material as claimed in claim 1, wherein the compound is added to the image-forming layer or to a layer farther than the image-forming layer from the support side.

6. The image-forming material as claimed in claim 1, wherein the compound is represented by formula (II-a):

(II-a)

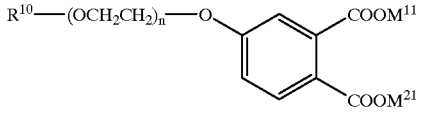

wherein $R^{10}$ represents a hydrogen atom or an alkyl group; n represents an integer of from 1 to 6: and $M^{11}$ and $M^{21}$ each represents a hydrogen atom, an alkali metal ion or an ammonium ion.

7. The image-forming material as claimed in claim 1, wherein the compound is contained of $10^{-3}$ to 10 mol per mol of Ag.

8. The image-forming material as claimed in claim 1, wherein the heat-sensitive imaging layer or the light-sensitive imaging layer was provided by coating and drying a coating composition which contains the binder in the state of aqueous latex or polymer dissolved or dispersed in a water-base solvent.

9. The image-forming material as claimed in claim 1, wherein the constituent layer(s) comprises at least (a) the thermographic image-forming layer.

10. The image-forming material as claimed in claim 1, wherein the compound is represented by formula (I-1).

11. The image-forming material as claimed in claim 1, wherein the secondary alkyl group represented by R or $R^1$ has 3–16 carbon atoms.

12. The image-forming material as claimed in claim 1, wherein the cycloalkyl group represented by R or $R^1$ has 3–16 carbon atoms.

13. The image-forming material as claimed in claim 1, wherein the alkyl groups represented by R or $R^1$ are substituted and the substituents are selected from the group consisting of a halogen atom and groups bonded via a carbon atom, an oxygen atom, a nitrogen atom or a sulfur atom.

14. The image-forming material as claimed in claim 1, wherein the substituents of R or $R^1$ are selected from the group consisting of a halogen atom, a hydroxyl group, an alkoxyl group, an alkyl-thio group, and a sulfonyl group.

15. The image-forming material as claimed in claim 1, wherein R or $R^1$ represent a secondary alkyl group.

16. The image-forming material as claimed in claim 1, wherein the compounds represented by formula (I-1) are selected from the group consisting of:

1-1

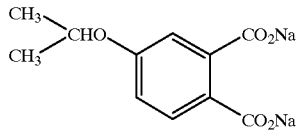

1-2

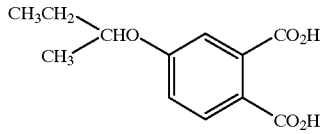

1-3

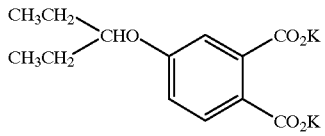

1-4

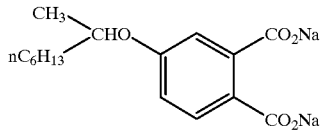

1-5

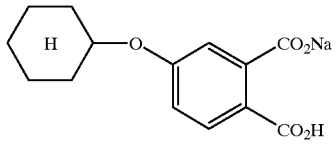

1-6

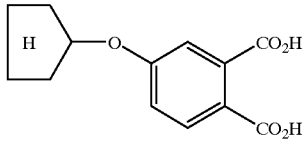

1-7

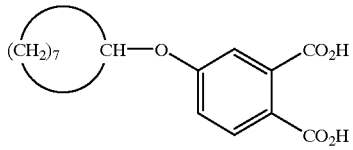

-continued 1-8

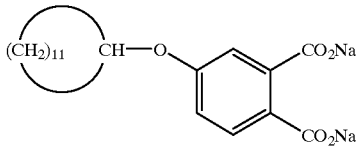

1-9

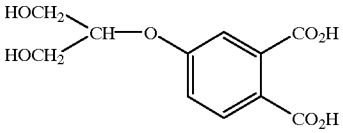

1-10

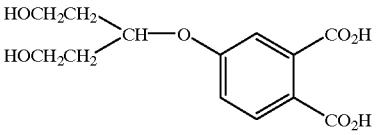

1-11

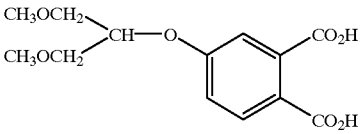

1-12

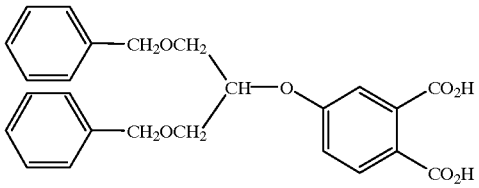

1-13

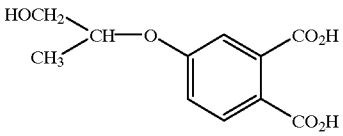

1-14

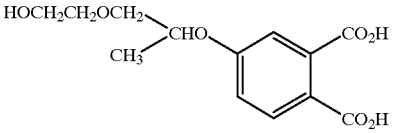

1-15

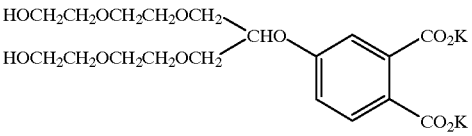

1-16

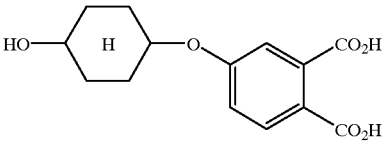

1-17

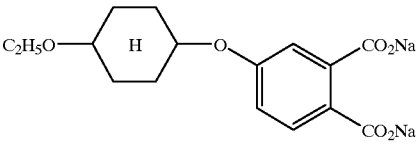

-continued 1-18

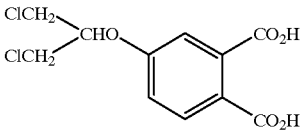

1-19

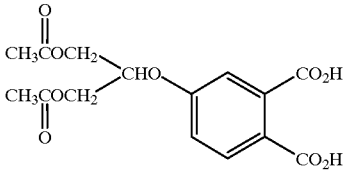

1-20

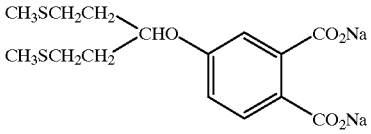

1-21

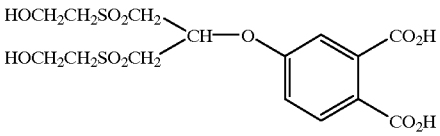

1-22

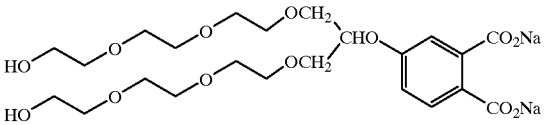

1-23

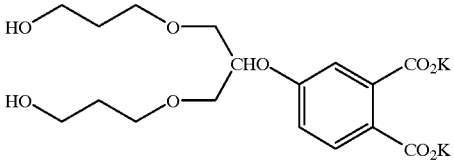

and 1-24

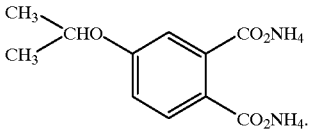

17. The image-forming material as claimed in claim 1, wherein the aryl group has from 6 to 18 carbon atoms.

18. The image-forming material as claimed in claim 1, wherein $R^1$ represents a primary alkyl group substituted with a hydroxyl group or an alkoxyl group.

19. The image-forming material as claimed in claim 1, wherein the compounds represented by formula (II-1) are selected from the group consisting of:

2-1
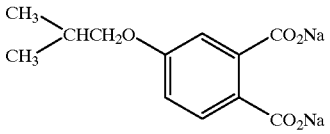
2-2
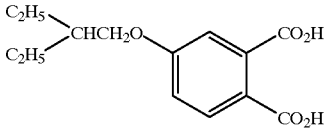
2-3
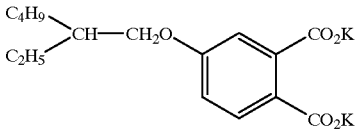
2-4
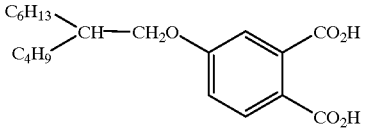
2-5
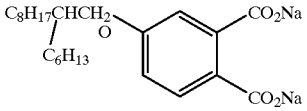
2-6
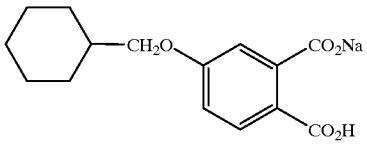
2-7
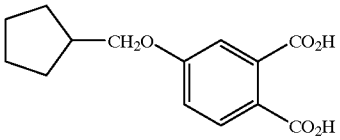
2-8
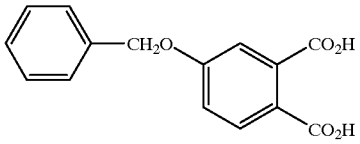
2-9
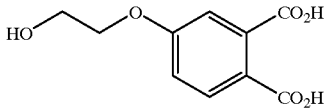
2-10
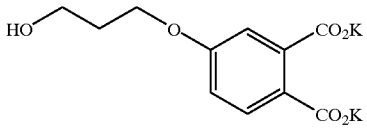
2-11
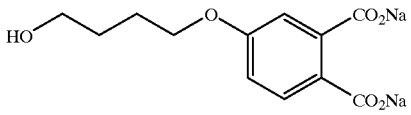

-continued
2-12
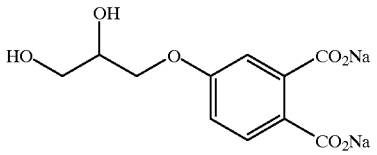
2-13
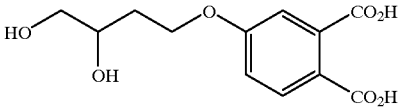
2-14
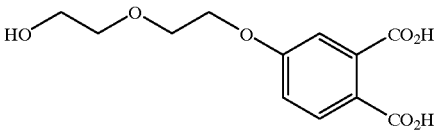
2-15
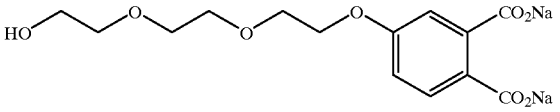
2-16
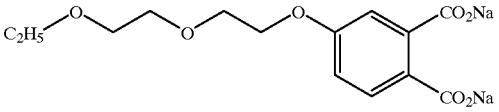
2-17
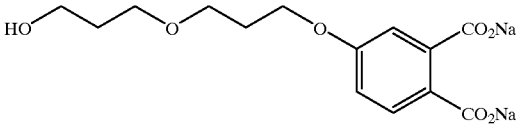
2-18
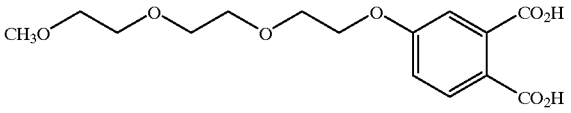
2-19
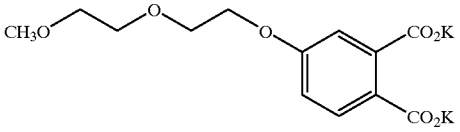
2-20
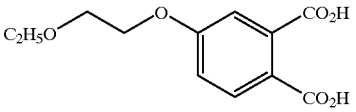
2-21
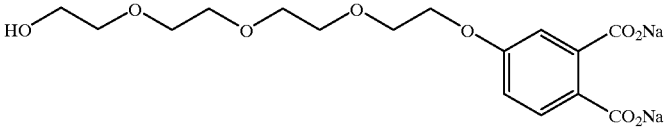
2-22
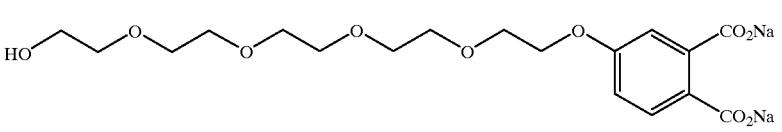

-continued
2-23
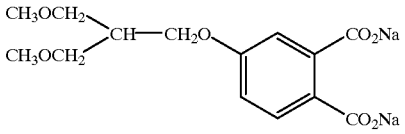
2-24
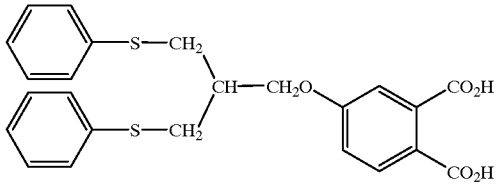
2-25
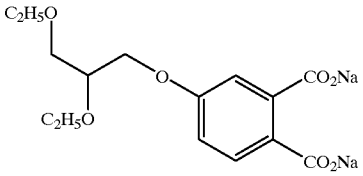
2-26
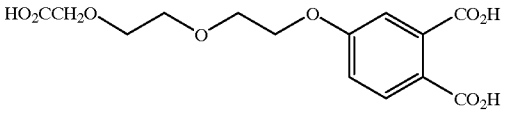
2-27
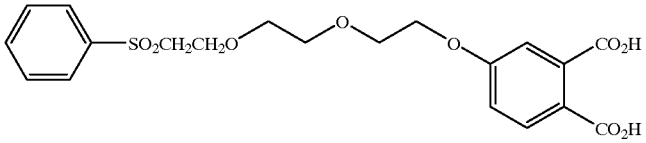
2-28
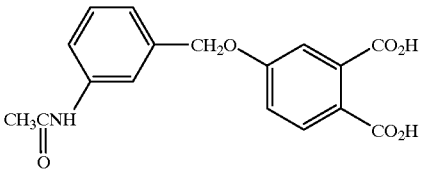
2-29
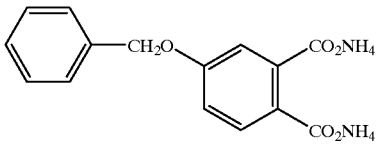
and
2-30
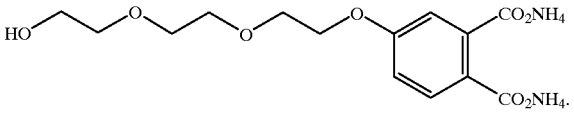
20. The image-forming material as claimed in claim 1, wherein the compounds represented by formula (I-1) or (II-1) are added to any layer so long as the layer is positioned on the same side with the image-forming layer containing a reducible silver salt.
* * * * *